US011709441B2

(12) United States Patent
Mitsumata et al.

(10) Patent No.: US 11,709,441 B2
(45) Date of Patent: Jul. 25, 2023

(54) IMAGE FORMING APPARATUS

(71) Applicant: CANON KABUSHIKI KAISHA, Tokyo (JP)

(72) Inventors: Akinori Mitsumata, Tokyo (JP); Takeo Kawanami, Kanagawa (JP); Nobuyuki Kobayashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/847,060

(22) Filed: Jun. 22, 2022

(65) Prior Publication Data

US 2022/0413415 A1 Dec. 29, 2022

(30) Foreign Application Priority Data

Jun. 25, 2021 (JP) ..... 2021-106014
Dec. 17, 2021 (JP) ..... 2021-205341

(51) Int. Cl.
*G03G 15/08* (2006.01)
*G03G 15/00* (2006.01)

(52) U.S. Cl.
CPC ..... *G03G 15/0889* (2013.01); *G03G 15/0886* (2013.01); *G03G 15/5062* (2013.01)

(58) Field of Classification Search
CPC ..... G03G 15/0886; G03G 15/0887; G03G 15/0889; G03G 15/5062
See application file for complete search history.

(56) References Cited

U.S. PATENT DOCUMENTS 6,334,037 B1 * 12/2001 Ise ..... G03G 15/0872 399/262
2021/0263446 A1 * 8/2021 Funatani ..... G03G 9/09328

FOREIGN PATENT DOCUMENTS

JP 2020086450 A 6/2020
JP 2020154300 A 9/2020

* cited by examiner

*Primary Examiner* — Hoang X Ngo
(74) *Attorney, Agent, or Firm* — Canon U.S.A., Inc. I.P. Division

(57) ABSTRACT

An image forming apparatus includes a developing container to store developer, an operation portion, an operation detection portion, a conveyance unit to convey a recording material, a detection unit, a door that is openable and closable, a door detection portion, an agitation member, a drive portion, and a control unit. The control unit controls the drive portion in such a manner that, in a case where the operation detection portion detects movement of the operation portion, a supply agitation operation in which the agitation member agitates the developer stored in the developing container is performed. The control unit controls the drive portion in such a manner that, in a case where, in a state in which the supply agitation operation is being performed, the door detection portion has detected an opened state of the door or the detection unit has detected the recording material, the supply agitation operation is stopped.

24 Claims, 43 Drawing Sheets

IMAGE FORMING APPARATUS

BACKGROUND

Field

Aspects of the present disclosure generally relate to an image forming apparatus which records an image on a recording material.

Description of the Related Art

Generally, an image forming apparatus of the electrophotographic type forms an image by transferring, to a transfer material serving as a transfer medium, a toner image formed with toner serving as a developer on the surface of a photosensitive drum. Examples of known methods for supplying a developer to the image forming apparatus include a process cartridge method and a toner supply method. The process cartridge method is a method in which a photosensitive drum and a developing container are integrated as a process cartridge and, when a developer has run out, the process cartridge is replaced with the new one.

On the other hand, the toner supply method is a method in which, when toner has run out, new toner is supplied to the developing container. Japanese Patent Application Laid-Open No. 2020-086450 discusses, when performing supply, causing an agitation blade mounted in the developing container to operate, thus agitating a developer.

In an image forming apparatus of the electrophotographic type, there is known a configuration in which a supply container detachably attached to the image forming apparatus is used to supply a developer to the developing container. Japanese Patent Application Laid-Open No. 2020-154300 discusses a configuration in which a shutter member of the supply container is opened and closed by rotating the supply container attached to the image forming apparatus.

To attain downsizing and cost-cutting of an image forming apparatus, it is favorable to reduce the number of drive sources. In a case where a conveyance unit for conveying a recording material and an agitation member for agitating a developer are configured to be driven in common, when drive force is transmitted to the agitation member to perform an agitation operation for a developer, drive force is also transmitted to the conveyance unit for conveying a recording material.

In a case where a conveyance unit for conveying a recording material and an agitation member for agitating a developer are configured to be driven in common, sometimes it is favorable to, under a specific situation, restrict a supply agitation operation of the agitation member and, thus, restrict driving of the conveyance unit.

Moreover, there is a known shutter member that is a member which is able to be opened and closed at any given time by the supply container being rotated, so that it is impossible to restrict toner supply in a case where it is not favorable that toner supply by the supply container is performed.

SUMMARY

Aspects of the present disclosure are generally directed to providing an image forming apparatus capable of restricting a supply agitation operation of the agitation member under a specific situation in which it is desirable to stop driving of the conveyance unit. Moreover, aspects of the present disclosure are generally directed to providing an image forming apparatus capable of restricting movement of an operation member by an actuator.

According to an aspect of the present disclosure, an image forming apparatus includes an image bearing member configured to bear an electrostatic latent image on the image bearing member, a developer bearing member configured to develop the electrostatic latent image, a supply portion including a supply port to which a supply container in which a developer is stored is detachably attached and a developer opening through which the developer supplied from the supply container passes, a developing container configured to store the developer supplied from the supply container, a shutter configured to be movable between a closing position at which the shutter covers the supply port and a receding position at which the shutter recedes from the closing position, an operation portion configured to be movable between a first position to cause the shutter to be positioned at the closing position and a second position to cause the shutter to be positioned at the receding position, an operation detection portion configured to detect that the operation portion has been moved, a conveyance unit configured to convey a recording material along a conveyance path, a detection unit configured to detect the recording material being present on the conveyance path, a door openable and closable and, when the door is in an opened state, causing the conveyance unit to be exposed, a door detection portion configured to detect a state of the door, an agitation member configured to agitate the developer stored in the developing container, a drive portion configured to transmit drive force to the agitation member and the conveyance unit, and a control unit configured to control the drive portion, wherein the control unit controls the drive portion in such a manner that, in a case where the operation detection portion has detected movement of the operation portion, a supply agitation operation in which the agitation member agitates the developer stored in the developing container is performed, and wherein the control unit controls the drive portion in such a manner that, in a case where, in a state in which the supply agitation operation is being performed, the door detection portion has detected the opened state of the door or the detection unit has detected the recording material, the supply agitation operation is stopped.

Further features of the present disclosure will become apparent from the following description of exemplary embodiments with reference to the attached drawings.

DESCRIPTION OF THE EMBODIMENTS

A first exemplary embodiment of the present disclosure is described. An image forming apparatus 1 in the first exemplary embodiment is a monochrome laser beam printer using an electrophotographic process, and is configured to form an image using a developer such as toner on a sheet S, serving as a recording material, according to image information transmitted from an external apparatus such as a personal computer. Examples of the sheet S include recording paper, label paper, overhead projector (OHP) sheet, and cloth.

Moreover, in the following description, the height direction (a direction opposite to vertical direction) of the image forming apparatus 1 in a case where the image forming apparatus 1 is installed on a horizontal surface is assumed to be a Z-direction. A direction perpendicular to the Z-direction and parallel to a rotational axis direction (main scanning direction) of a photosensitive drum 11 described below is assumed to be an X-direction. A direction perpendicular to the X-direction and the Z-direction is assumed to be a Y-direction. It is favorable that the X-direction, the Y-direction, and the Z-direction perpendicularly intersect with each other. Moreover, for the sake of convenience, a plus side in the X-direction is referred to as a right side and a minus side in the X-direction is referred to as a left side, a plus side in the Y-direction is referred to as a front side or a front surface side and a minus side in the Y-direction is referred to as a rear side or a back surface side, and a plus side in the Z-direction is referred to as an upside and a minus side in the Z-direction is referred to as a downside.

Figure 1:
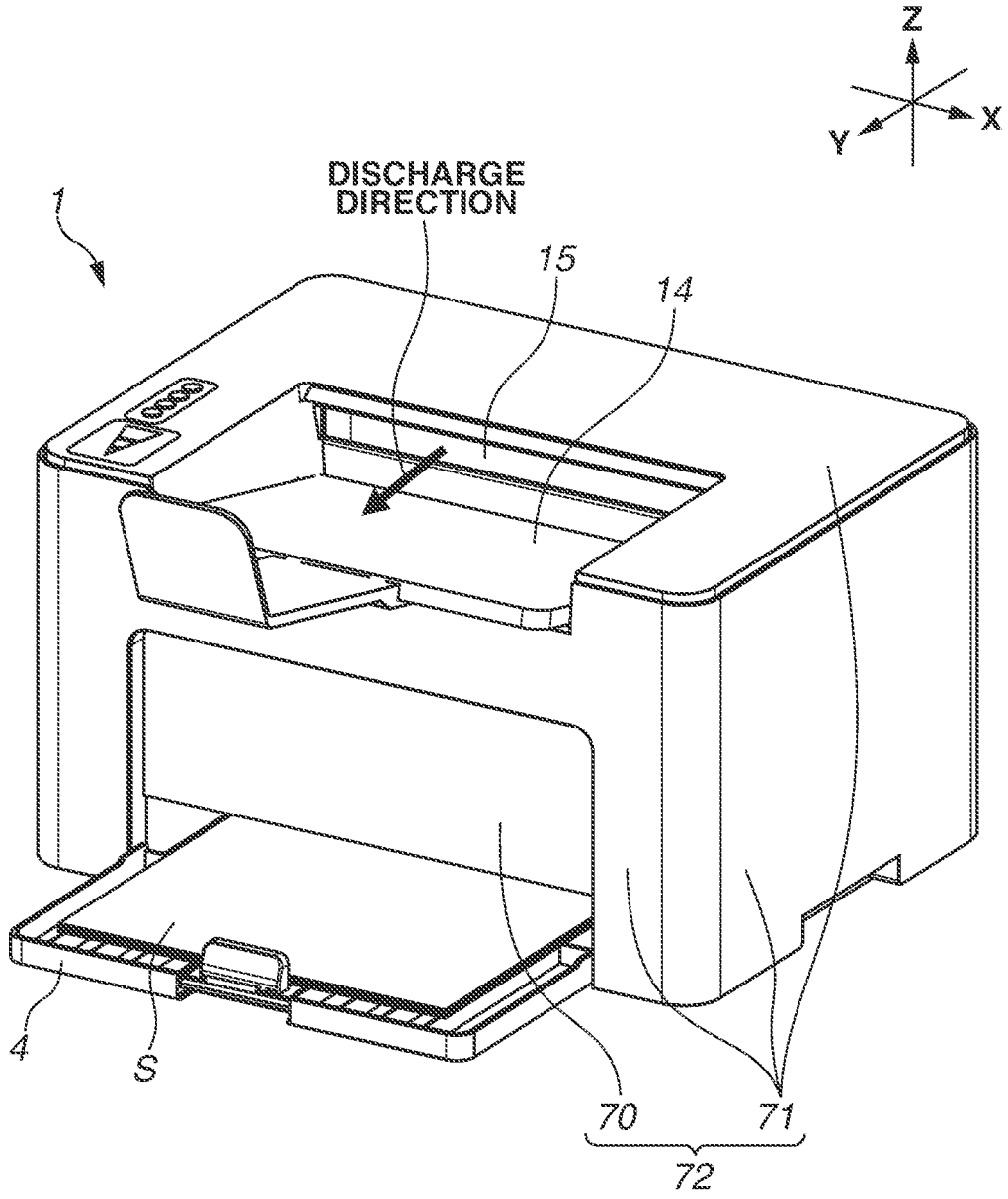
FIG. 1 is a perspective view of an image forming apparatus.
Figure 2:
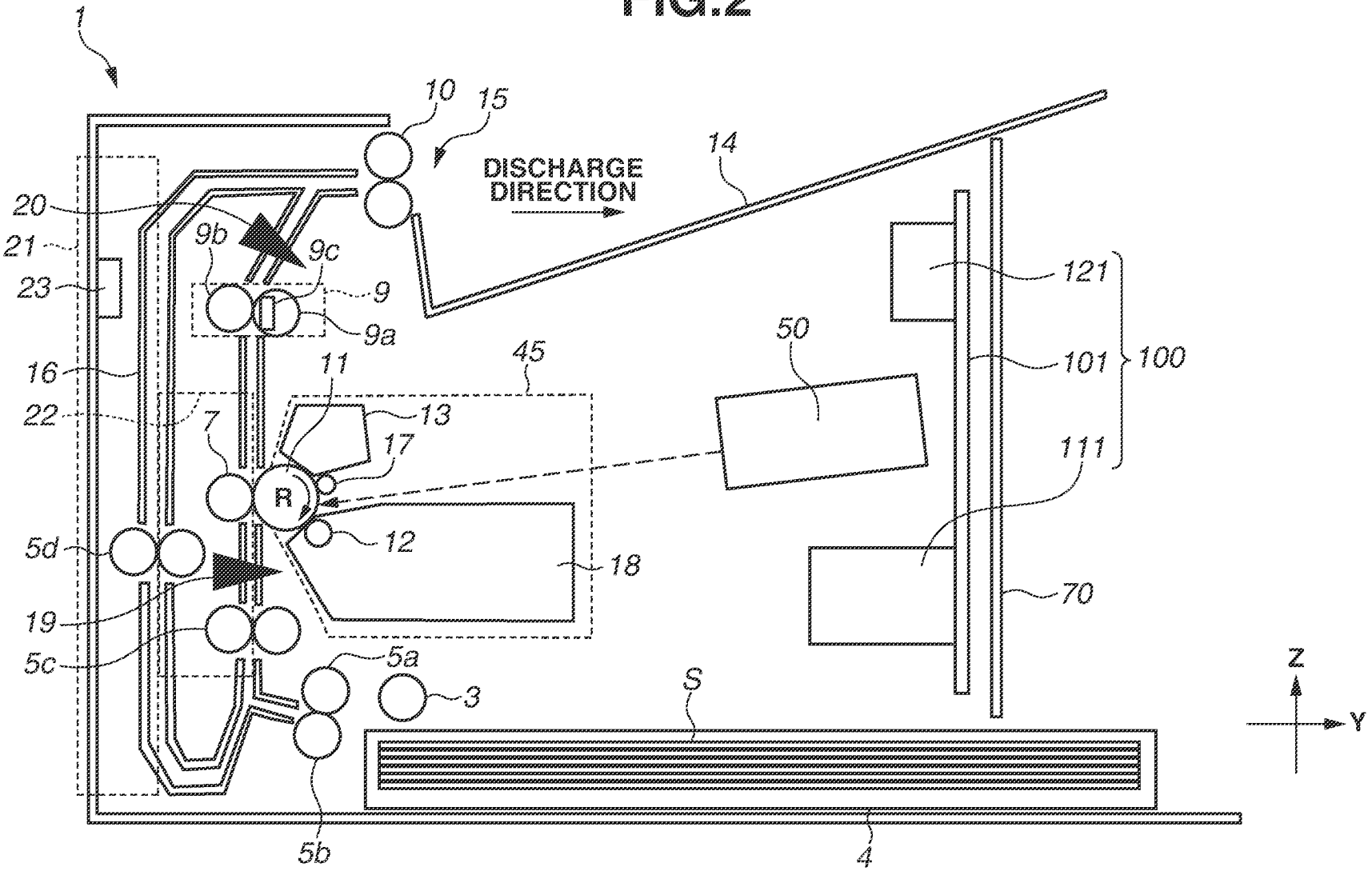
FIG. 2 is a diagram used to explain an internal configuration of the image forming apparatus.

FIG. 1 is a perspective view of the image forming apparatus 1, and FIG. 2 is a diagram used to explain an internal configuration of the image forming apparatus 1 as viewed in the X-direction (the rotational axis direction of the photosensitive drum 11). FIG. 2 illustrates only extracted portions related to an image forming process.

Referring to FIG. 1, the image forming apparatus 1 includes a sheet storing portion 4, in which sheets S are stored, and a discharge tray 14, on which the discharged sheets S are stacked. The sheet storing portion 4 is configured to be able to be pulled out in the Y-direction, and allows the user to supplement sheets S therein. A sheet S fed from the sheet storing portion 4 and then subjected to formation of an image is discharged from a discharge port 15 in a discharge direction (Y-direction) illustrated in FIG. 1 and is then stacked on the discharge tray 14.

A front cover 70, which is provided at a part of an end surface (a part of the front surface) of the image forming apparatus 1 on the downstream side in the discharge direction, covers a circuit board 100. An exterior cover 71 is provided at a part of the front surface other than the portion at which the front cover 70 is provided and a side surface and a top surface of the image forming apparatus 1. The front cover 70, the exterior cover 71, and the above-mentioned discharge tray 14 constitute a housing 72 of the image forming apparatus 1. Here, the housing 72 is a member which covers the entirety of the image forming apparatus 1, and is equipped therein with a process member such as a scanner unit 50 described below. The above-mentioned discharge port 15 is an opening formed at a part of the housing 72, and the sheet S is discharged to the outside of the image forming apparatus 1 via such an opening.

The flow of an image forming operation to be performed on a sheet S is described with reference to FIG. 2. When image information is transmitted to the image forming apparatus 1 and an instruction for starting printing is issued thereto, the photosensitive drum 11 (image bearing member), which is a rotating body, is driven to rotate at a predetermined circumferential velocity (process speed) in the direction of arrow R. The scanner unit 50 radiates laser light toward the photosensitive drum 11 based on the input image information. The scanner unit 50 is a unit including a laser oscillator, which outputs laser light, a polygon mirror and a lens, which are used to irradiate the photosensitive drum 11 with laser light, a scanner motor, which rotates the polygon mirror, and a frame, which integrally supports these members. The photosensitive drum 11 is electrically charged by a charging roller 17 in advance, and, according to the photosensitive drum 11 being irradiated with laser light, an electrostatic latent image is formed on the photosensitive drum 11. After that, in response to toner stored in a developing container 18 being conveyed to the photosensitive drum 11 (photosensitive member) by a developing roller 12 (developer bearing member), the electrostatic latent image is developed, so that a toner image is formed on the photosensitive drum 11.

In parallel with the above-mentioned image forming process, a sheet S is fed from the sheet storing portion 4. On a conveyance path in the image forming apparatus 1, there are provided a pick-up roller 3, a feeding roller 5*a*, a conveyance roller pair 5*c*, and a registration sensor 19. The pick-up roller 3 feeds a sheet S by coming into contact with an uppermost sheet S out of the sheets S stored in the sheet storing portion 4 and rotating itself. The feeding roller 5*a* and a separation roller 5*b*, which is in pressure contact with the feeding roller 5*a*, form a separation nip. In a case where a plurality of sheets S has been fed to the separation nip due to the influence of frictional force occurring between sheets S, the feeding roller 5*a* and the separation roller 5*b* separate the plurality of sheets S and feeds only an uppermost sheet S to the downstream side.

A sheet S fed from the sheet storing portion 4 is conveyed toward a transfer roller 7 by the conveyance roller pair 5*c* serving as a conveyance unit, is then detected by the registration sensor 19, which is a detection unit for detecting a sheet S present on the conveyance path, and arrives at the transfer roller 7. In response to a transfer bias being applied to the transfer roller 7, the toner image formed on the photosensitive drum 11 is transferred to the sheet S. The sheet S with the toner image transferred thereto by the transfer roller 7 is subjected to heating and pressure treatment by a fixing device 9, so that the toner image is fixed to the sheet S. The fixing device 9 is configured with a heating roller 9*a*, in which a fixing heater 9*c* is incorporated, and a pressure roller 9*b*, which is urged toward the heating roller 9*a*. Then, the sheet S with the toner image fixed thereto is detected by a sheet discharge sensor 20 provided on the downstream side of the fixing device 9 and is then discharged to the discharge tray 14 by a discharge roller pair 10.

In the case of forming images on both sides of a sheet S, the discharge roller pair 10 causes a sheet S with an image formed on the first surface thereof to move back at predetermined timing before the sheet S passes through the discharge roller pair 10 after passing through the sheet discharge sensor 20, thus guiding the sheet S to a two-sided conveyance path 16. The sheet S guided to the two-sided conveyance path 16 is conveyed again toward the transfer roller 7 by a two-sided conveyance roller pair 5*d*. After an image is formed on the second surface of the sheet S by the transfer roller 7, the sheet S is discharged to the outside of the image forming apparatus 1 by the discharge roller pair 10.

Moreover, toner remaining on the photosensitive drum 11 after the toner image is transferred to the sheet S is removed for cleaning by a cleaning unit 13.

Here, a case where a sheet S is not correctly conveyed during printing is described. The image forming apparatus 1 determines whether a sheet is being correctly conveyed, by the registration sensor 19 or the sheet discharge sensor 20 detecting the presence or absence of a sheet S. For example, if a period from timing at which the output of the registration sensor 19 has changed from the absence of a sheet S to the presence thereof to timing at which the output of the sheet discharge sensor 20 has changed from the absence of a sheet S to the presence thereof is too long, the image forming apparatus 1 determines that the sheet S has come into a state in which the conveyance of the sheet S is not being correctly performed anywhere between the registration sensor 19 and the sheet discharge sensor 20. In this case, the image forming apparatus 1 performs emergency stop and a need arises to remove a sheet S which has not been correctly conveyed.

Here, in the first exemplary embodiment, a configuration for removing a sheet S which has not been correctly conveyed includes a door 21 and a conveyance unit door 22. In FIG. 2, the door 21 has a configuration in which a portion surrounded by dashed line is openable toward the rear side of the main body of the image forming apparatus 1 and includes a part of the two-sided conveyance path 16 and a roller at the rear side of the image forming apparatus 1 included in the two-sided conveyance roller pair 5*d*. If the door 21 is opened, the user is allowed to access a space on the two-sided conveyance path 16 and is thus enabled to remove a sheet S which has stopped on the two-sided conveyance path 16.

Moreover, similarly, in FIG. 2, the conveyance unit door 22 includes a roller at the front side of the image forming apparatus 1 included in the two-sided conveyance roller pair 5*d*, which is not included in the door 21, the transfer roller 7, and a roller at the rear side of the image forming apparatus 1 included in the conveyance roller pair 5*c*. Then, in a state in which the door 21 has been opened, the conveyance unit door 22 is configured to be openable toward the rear side of the main body of the image forming apparatus 1. If the conveyance unit door 22 is opened, the user is allowed to access the conveyance path and is thus enabled to remove a sheet S which has stopped on the conveyance path. Moreover, the image forming apparatus 1 is provided with a door detection unit 303 which detects states of opening and closing of the door 22.

As illustrated in FIG. 2, the image forming apparatus 1 includes a circuit board 100. The circuit board 100 is configured with a wiring board 101 made from an insulator and electronic components 111 and 121 soldered to the wiring board 101. Since conductive wirings are provided on and inside a plate of the wiring board 101, the electronic components 111 and 121 are electrically interconnected. The circuit board 100 has the function of converting an alternating current supplied from the outside of the image forming apparatus 1 into a direct current and the function of converting an input voltage to obtain a predetermined voltage value required for an image forming process.

As illustrated in FIG. 2, the circuit board 100 is arranged in such an orientation that the surface of the wiring board 101 intersects with the discharge direction. Additionally, the wiring board 101 is provided between the front cover 70 and the scanner unit 50 with respect to the discharge direction. The electronic components 111 and 121 are provided on a surface on the side facing the scanner unit 50 on the wiring board 101.

<Arrangement and Configuration of Supply Portion>

Next, a supply portion 200 is described with reference to FIG. 3 to FIGS. 8A and 8B. The image forming apparatus 1 is provided with the supply portion 200, which enables the user or service engineer to externally supply toner, without detaching the developing container 18, serving as a toner storing portion, from the housing 72 in a case where the remaining amount of toner stored in the developing container 18 has become small. The supply portion 200 has a configuration to which a supply container 210 serving as a toner storing container described below is detachably attachable. Moreover, the supply container 210 is attachable to the image forming apparatus 1 with a part of the supply container 210 being exposed.

Figure 3:
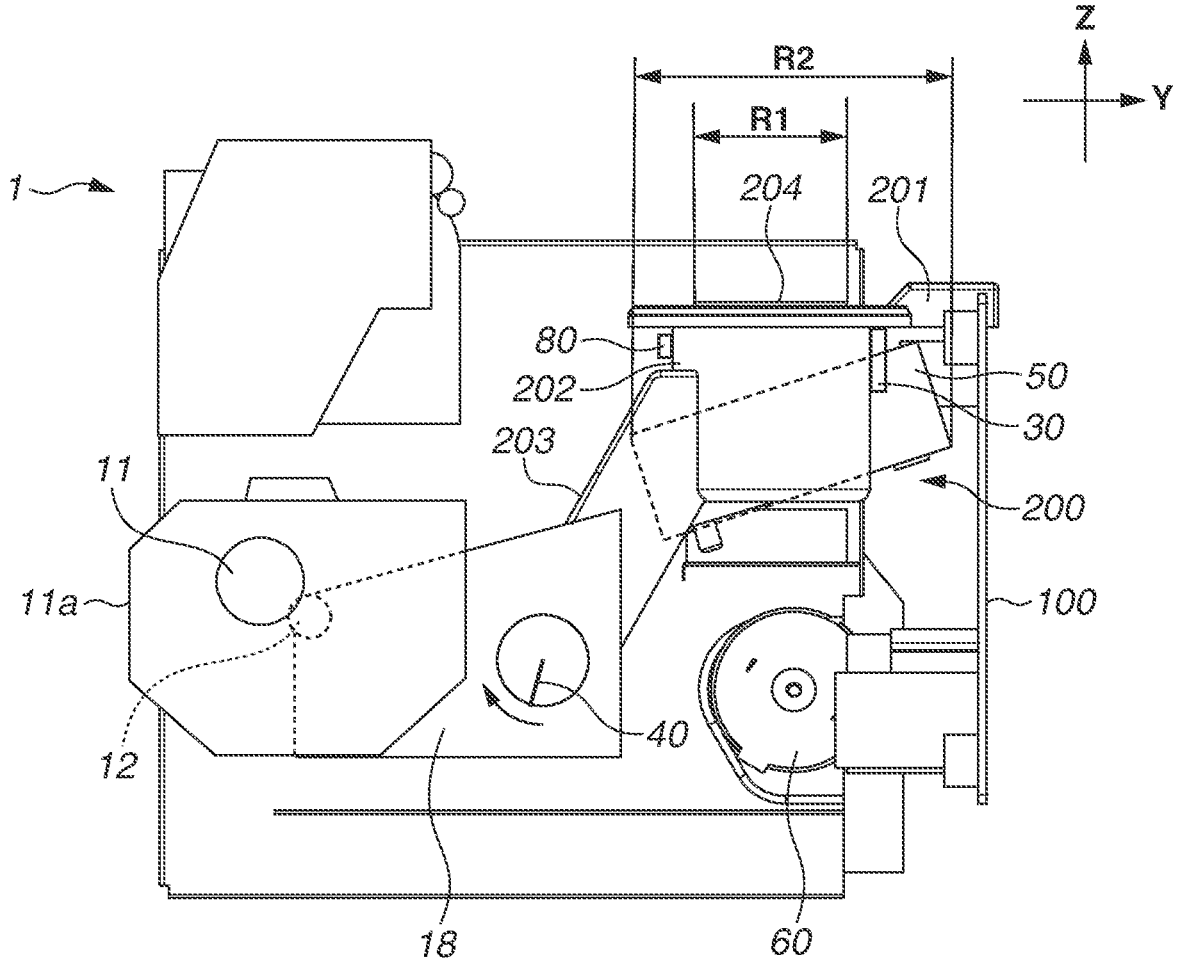
FIG. 3 is a side view used to explain the position of a supply portion.

FIG. 3 is a left side view of the image forming apparatus 1 as viewed from the rotational axis direction of the photosensitive drum 11.

In FIG. 3, the exterior cover 71 and a left side plate frame 73 are demounted. The supply portion 200 includes a supply port 204, to which the supply container 210 (not illustrated in FIG. 3) is attachable, a cylindrically shaped toner receiving portion 202, and a supply path portion 203, which interconnects the developing container 18 and the toner receiving portion 202. As described below, the supply portion 200 includes a side surface opening 205 serving as a toner opening (a developer opening or a reception opening), through which toner supplied from the supply container 210 passes. Toner passes through the supply port 204, then moves to the toner receiving portion 202 and the supply path portion 203 in this order, and is finally supplied to the developing container 18.

Figure 4:
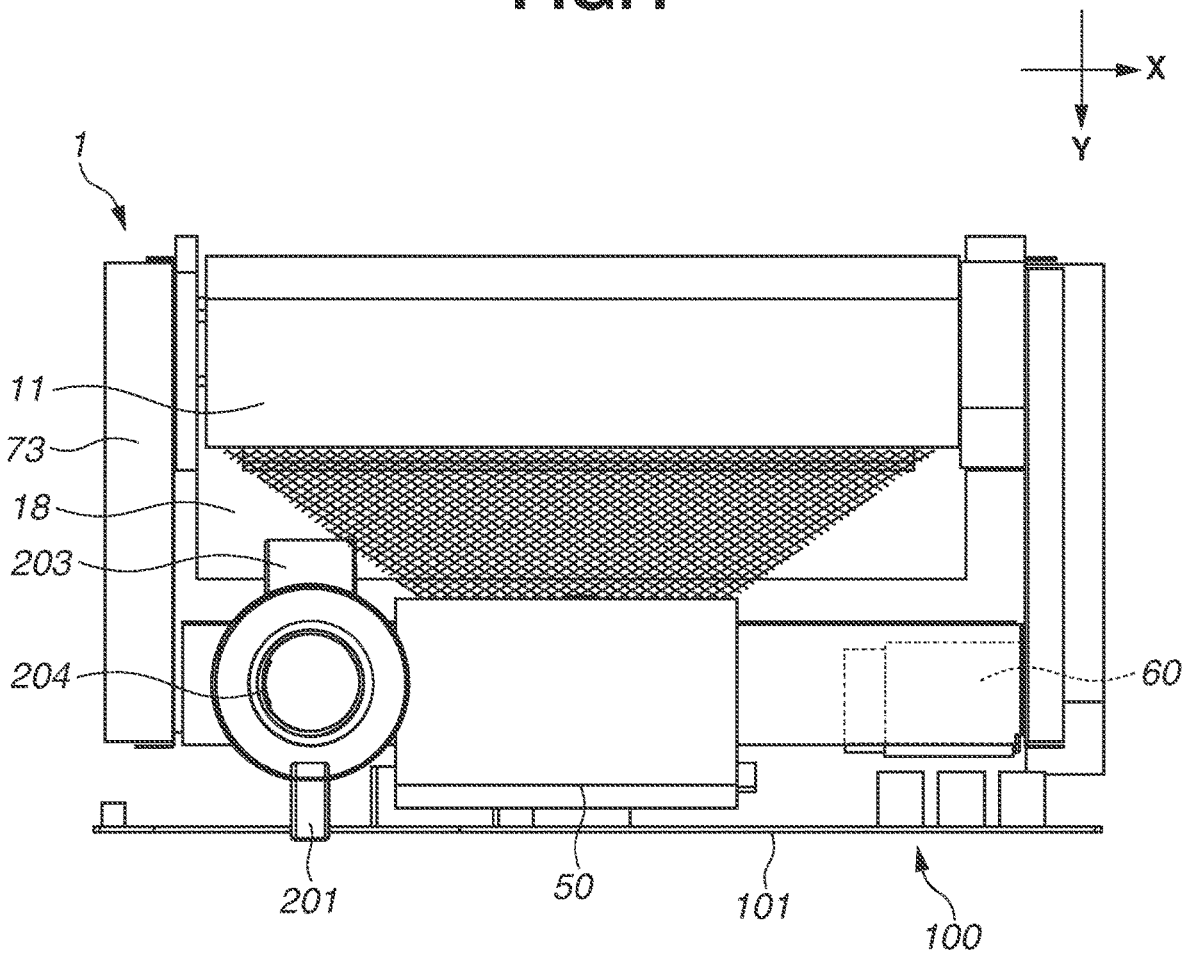
FIG. 4 is a top view used to explain the position of the supply portion.

FIG. 4 is a top view of the image forming apparatus 1 with the exterior cover 71 demounted. The supply port 204 includes, at an upper portion thereof, a lever portion 201 serving as an operation portion. The lever portion 201 is configured to be movable between a first position and a second position. As illustrated in FIG. 4, the width of the supply portion 200 in the X-direction is shorter than the width of the developing container 18 in the X-direction. Moreover, as illustrated in FIG. 3, the image forming apparatus 1 includes a lock portion 30, which is able to lock the lever portion 201. In other words, the lock portion 30 is able to restrict the movement of the operation portion.

Figure 5:
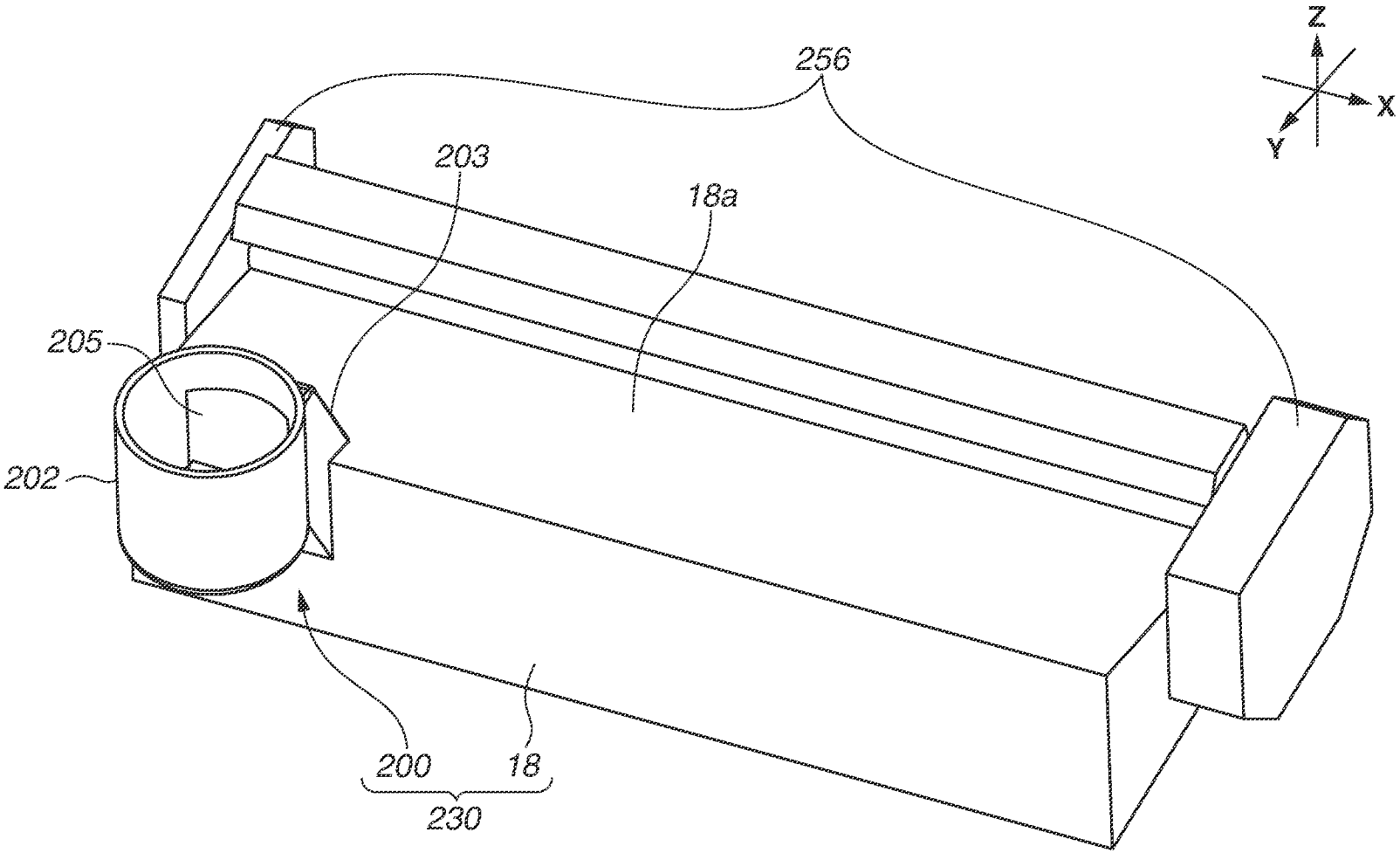
FIG. 5 is a perspective view of a developing container.

FIG. 5 is a perspective view of a developing unit 230, which is configured with the developing container 18 and the supply portion 200. Furthermore, in FIG. 5, some members are omitted from illustration. As illustrated in FIG. 5, the side surface opening 205, which is continuous with the supply path portion 203, is formed on the inner wall of the cylindrically shaped toner receiving portion 202. Toner supplied from the supply container 210 is guided from the toner receiving portion 202 to the supply path portion 203 through the side surface opening 205 and is then stored in the developing container 18 through the supply path portion 203.

Figure 6B:
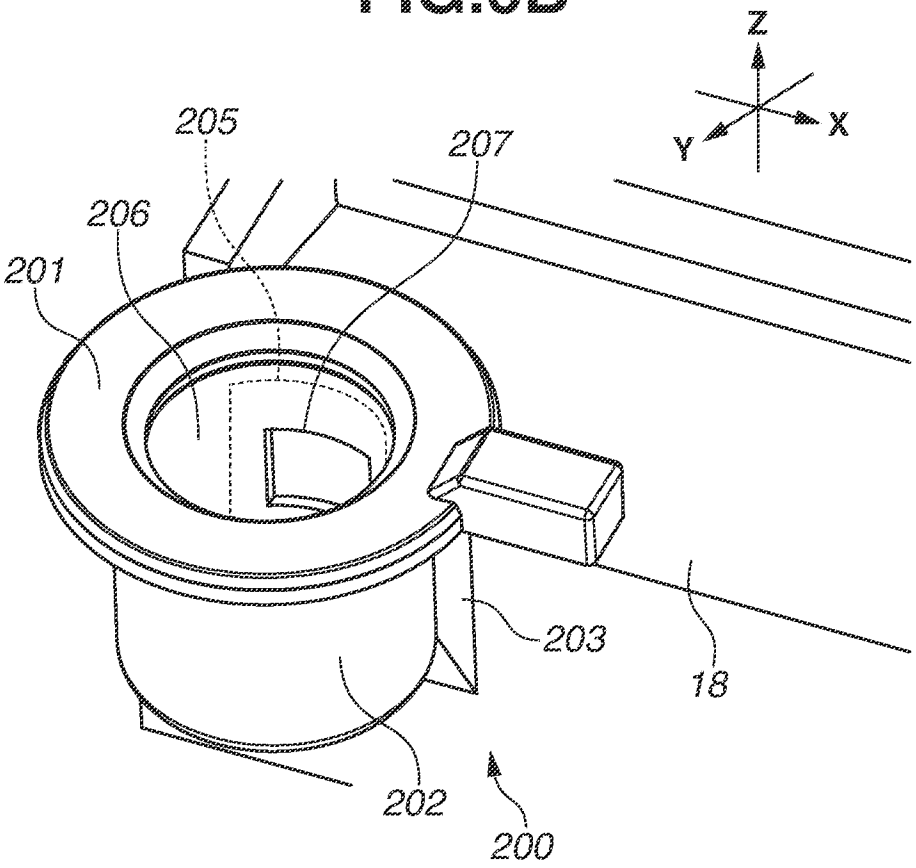
FIGS. 6A and 6B are enlarged perspective views of the supply portion.
Figure 6A:
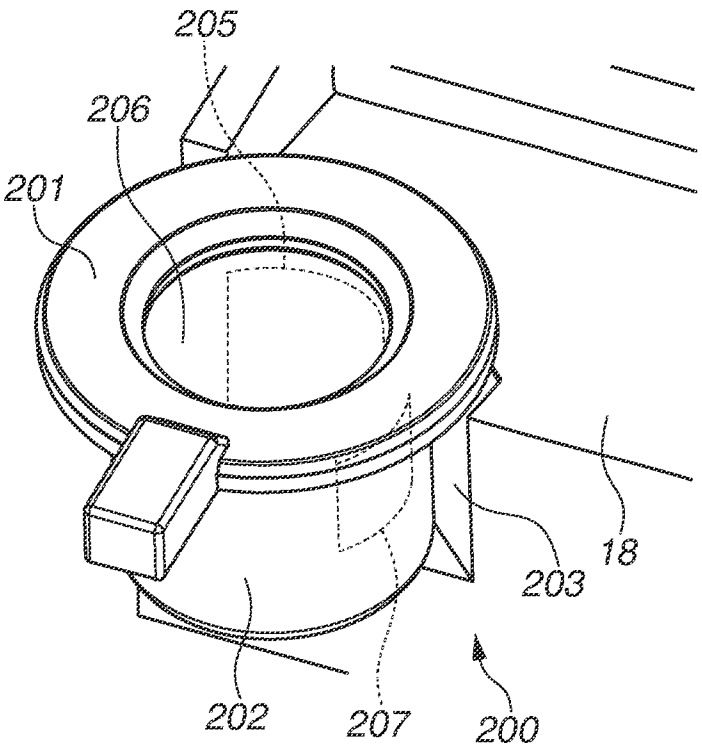

FIGS. 6A and 6B are enlarged perspective views of the supply portion 200. In FIG. 6A, the side surface opening 205 formed at the toner receiving portion 202 is blocked by a shutter 206, which is openable and closable, and is actually invisible and is, therefore, illustrated by dashed line. The shutter 206 is configured to be movable between a closing position (closed state) at which the shutter 206 covers the side surface opening 205 and a receding position (opened state) at which the shutter 206 has receded from the closing position. When the shutter 206 is in the opened state, the developing container 18 is able to receive toner from the supply container 210 and, when the shutter 206 is in the closed state, the developing container 18 is not able to receive toner from the supply container 210.

The shutter 206 is a cylindrically shaped member coaxial with the toner receiving portion 202 and is provided inside the toner receiving portion 202. An opening 207, through which toner passes, is also formed in the shutter 206 but is positioned at a position which is actually invisible and is, therefore, illustrated by dashed line. In FIG. 6A, since the side surface opening 205 and the opening 207 are positioned at mismatched positions, the shutter 206 covers the side surface opening 205, so that the side surface opening 205 is blocked.

Moreover, the lever portion 201 and the shutter 206 each engage with a supply container shutter 214 when the supply container 210 has been attached and, therefore, enter into a state of rotating together. In other words, when the supply container 210 is attached, the shutter 206 moves in conjunction with the movement of the lever portion 201. Therefore, in response to the user moving the lever portion 201, the shutter 206 moves between the closing position illustrated in FIG. 6A and the receding position illustrated in FIG. 6B. In other words, when the lever portion 201 is positioned at the first position, the shutter 206 is positioned at the closing position (FIG. 6A). When the lever portion 201 is positioned at the second position, the shutter 206 is positioned at the receding position (FIG. 6B).

Specifically, the user is able to rotate the shutter 206 inside the toner receiving portion 202 by grasping the lever portion 201 and rotating the lever portion 201 about 90° from the state illustrated in FIG. 6A to the state illustrated in FIG. 6B. In FIG. 6B, since the side surface opening 205 and the opening 207 are positioned at overlapping positions, the side surface opening 205 is opened, so that toner is allowed to be supplied through the side surface opening 205. In the first exemplary embodiment, a configuration in which, when the supply container 210 has been attached, the lever portion 201 and the shutter 206 are interconnected via the supply container shutter 214 and rotate together is employed. A configuration in which, even when the supply container 210 has not been attached, the lever portion 201 and the shutter 206 are interconnected and rotate together can also be employed.

At the time of performing image formation on a sheet S, it is necessary to block the side surface opening 205 so that, when toner is agitated inside the developing container 18 by an agitation member 40, toner does not leak from the side surface opening 205. Accordingly, at the time of image formation, the lever portion 201 is moved to the first position illustrated in FIG. 6A. This position can be called an initial position or operating position of the lever portion 201. On the other hand, at the time of supplying toner from the supply container 210 to the developing container 18, it is necessary to open the side surface opening 205. Accordingly, at the time of toner supply, the lever portion 201 is moved to the second position illustrated in FIG. 6B. This position can be called a supplying position of the lever portion 201.

Figure 7:
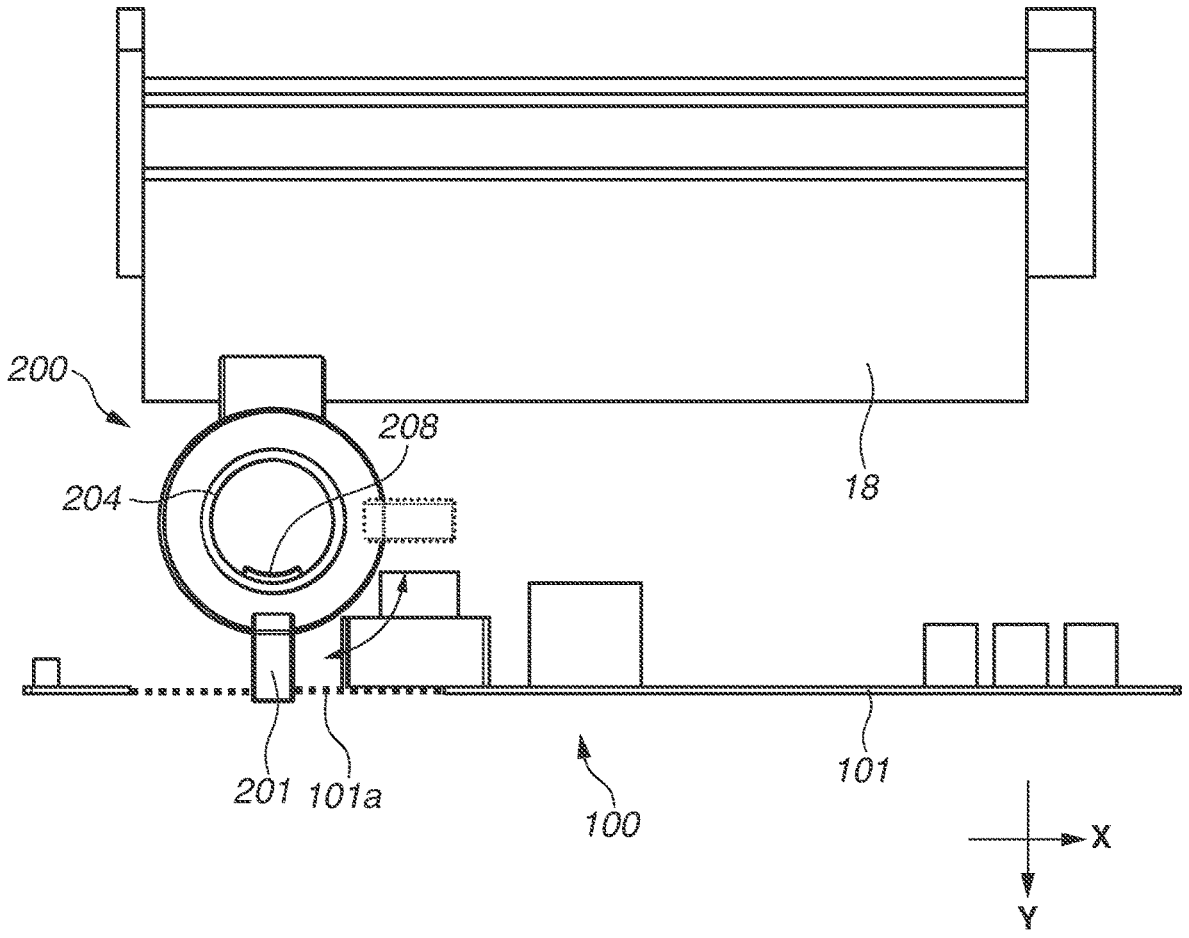
FIG. 7 is a top view used to explain a rotational locus of a lever portion.

Moreover, as illustrated in FIG. 7, a position adjustment rib 208 is provided inside the supply portion 200. Details of the function of the position adjustment rib 208 are described below.

<Configuration of Supply Container>

Next, a configuration of the supply container 210 (supply container) is described with reference to FIGS. 8A and 8B. The supply container 210 includes a pouch portion 211, in which toner to be supplied is contained, a cylindrically shaped base portion 212, which is to be inserted into the supply port 204, an opening 213, which is formed at the side surface of the base portion 212 and via which toner moves in and out, and a supply container shutter 214, which lids the opening 213 in such a manner that tone does not leak from the opening 213. Additionally, the supply container 210 includes a truncated cone-shaped pack bottom portion 215, and the pack bottom portion 215 is fixed to the base portion 212 in such a way as not to drop out and come off from the base portion 212. Moreover, the pouch portion 211 has a shape which becomes flattened as the shape proceeds to a side opposite to the base portion 212, and a pouch end portion 216 extending in a predetermined direction is formed at the flattened end of the pouch portion 211.

The supply container shutter 214 is a cylindrically shaped member coaxial with the base portion 212, and is provided outside the base portion 212. The supply container shutter 214 is configured to be rotatable with respect to the base portion 212. Moreover, although not illustrated, an opening is also formed in the supply container shutter 214, and, when the supply container shutter 214 is rotated in such a manner that the opening of the supply container shutter 214 and the opening 213 of the base portion 212 match each other, toner becomes able to be supplied from the supply container 210.

Figure 8A:
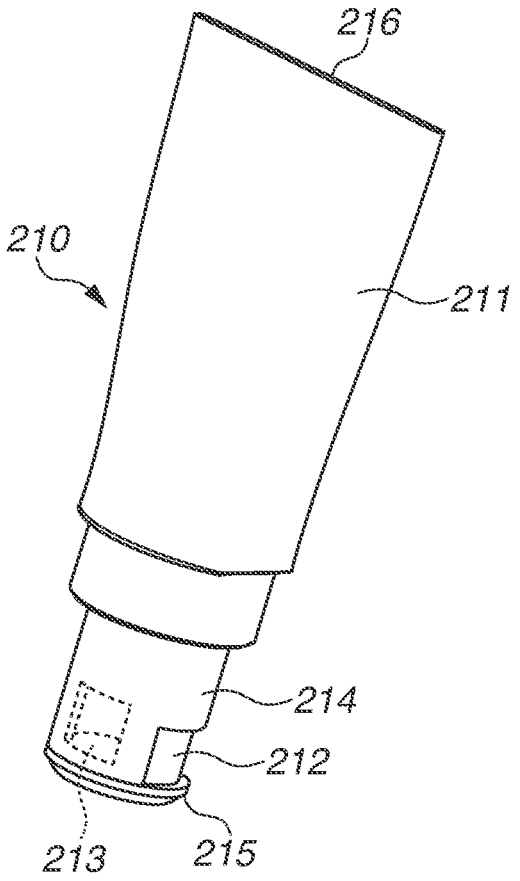
FIGS. 8A and 8B are diagrams used to explain a configuration of a supply container.
Figure 8B:
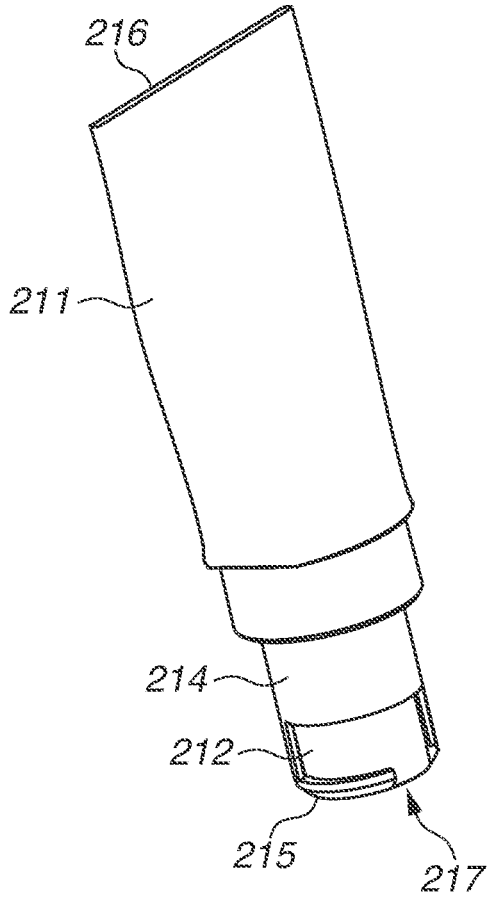

In FIG. 8A, the opening 213 formed in the base portion 212 is covered by the supply container shutter 214 and is actually invisible and is, therefore, illustrated by dashed line. FIG. 8B is a diagram of the supply container 210 as viewed from an angle different from that in FIG. 8A. A position adjustment cutout 217 is formed at a part of the pack bottom portion 215. Details of the function of the position adjustment cutout 217 are described below.

<Attaching Procedure for Supply Container>

Figure 9A:
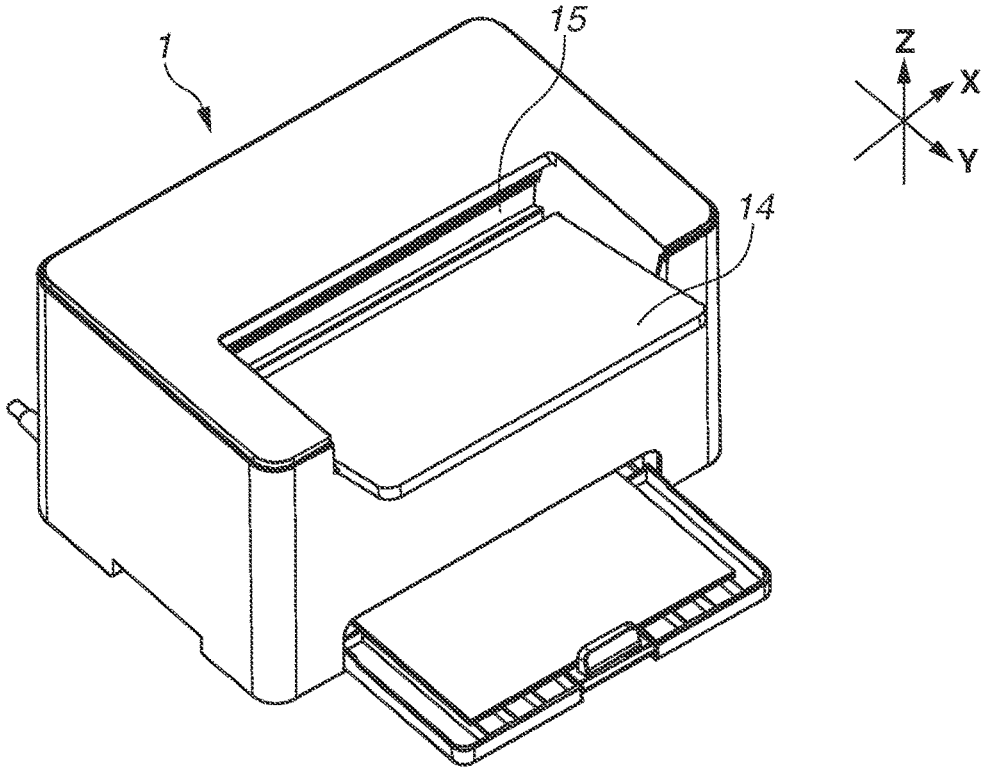
FIGS. 9A and 9B are perspective views illustrating states in which a discharge tray is opened and closed.
Figure 9B:
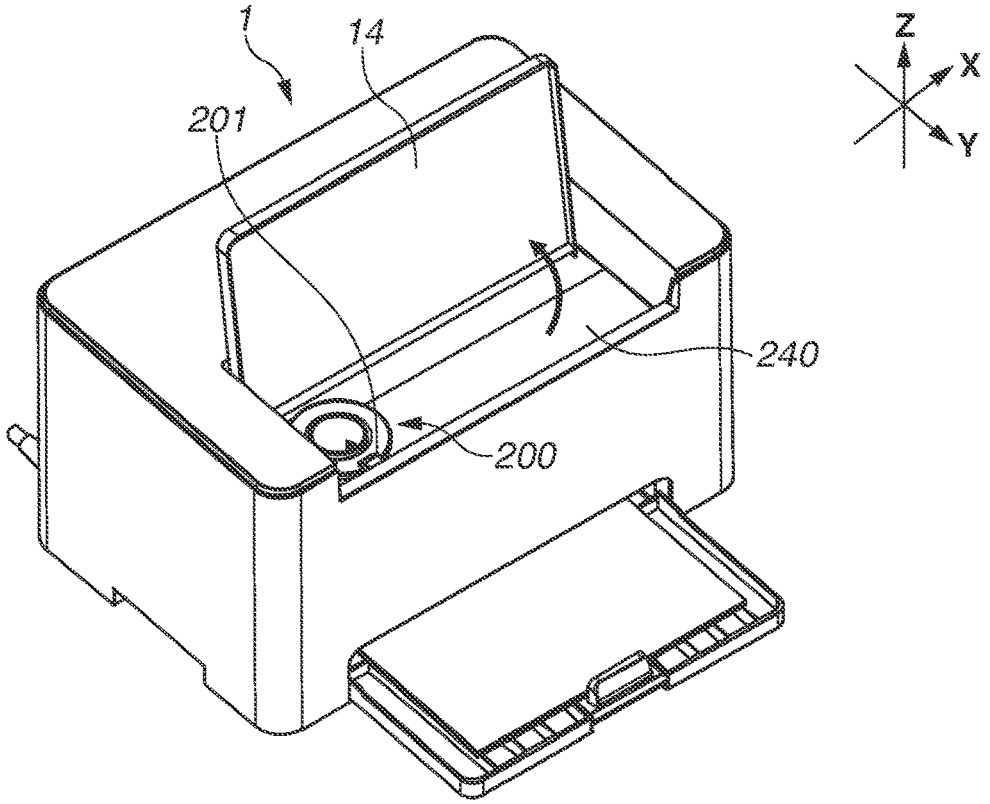

Next, a supplying procedure for toner using the supply container 210 is described with reference to FIGS. 9A and 9B to FIG. 11. FIGS. 9A and 9B are perspective views of the image forming apparatus 1. In the first exemplary embodiment, the discharge tray 14 covers the supply portion 200 and the lever portion 201, which serves as an operation portion. Moreover, the discharge tray 14 is configured to be movable between a position illustrated in FIG. 9A, in which the discharge tray 14 allows a sheet S discharged from the discharge port 15 to be stacked thereon, and a position illustrated in FIG. 9B, in which the discharge tray 14 causes the supply portion 200 to be exposed. Since the supply portion 200 is provided at an upper portion of the front surface of the main body of the image forming apparatus 1, the user can easily access the supply portion 200 even at the time of supply. At the time of image formation, the image forming apparatus 1 performs an image forming operation after the user detaches the supply container 210 from the image forming apparatus 1.

At the time of supplying toner, the user removes a sheet S stacked on the discharge tray 14, opens the discharge tray 14, and moves the discharge tray 14 to the position illustrated in FIG. 9B. When the discharge tray 14 is opened, the supply portion 200, a top surface portion 240 provided adjacent to the supply portion 200, and the supply port 204 located on the top surface portion 240 become exposed. Then, the user inserts the supply container 210 into the exposed supply portion 200.

At this time, the user inserts the supply container 210 in such a manner that the positions of the position adjustment rib 208 (FIG. 7) provided at the supply portion 200 and the position adjustment cutout 217 (FIG. 8B) provided at the supply container 210 match each other. A configuration in which, in a case where the positions of the position adjustment rib 208 and the position adjustment cutout 217 do not match each other, the pack bottom portion 215 interferes with the position adjustment rib 208 so that the user cannot insert the supply container 210 is employed.

Figure 10A:
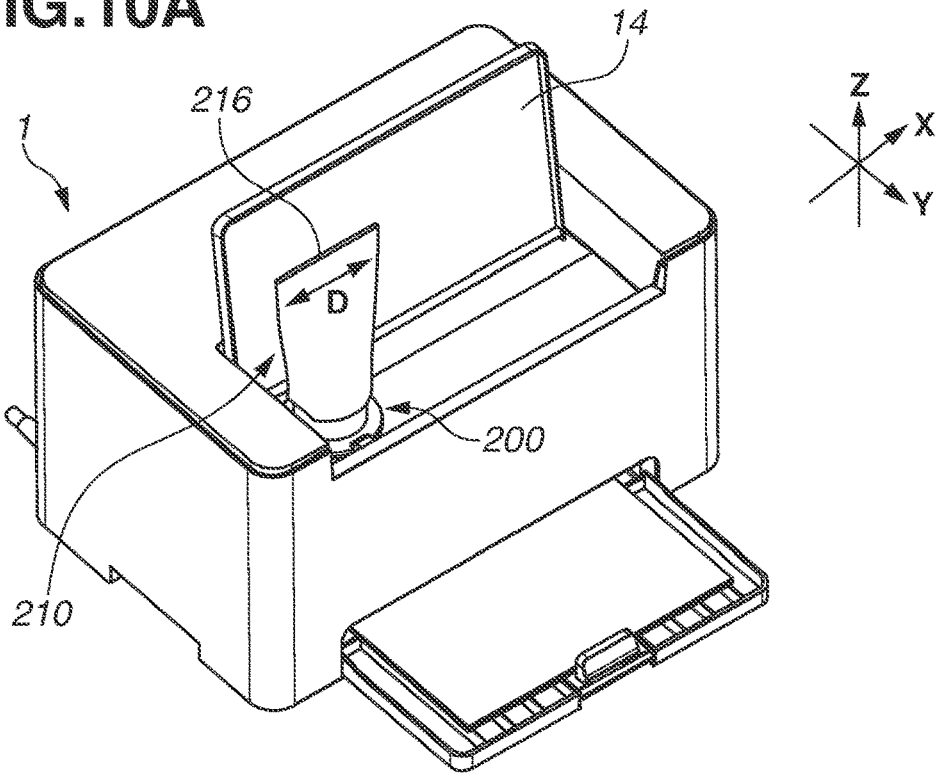
FIGS. 10A and 10B are perspective views illustrating states in which the supply container has been attached.

FIG. 10A illustrates a state in which the supply container 210 has been inserted into the supply portion 200. In the first exemplary embodiment, the user can insert the supply container 210 when the supply container 210 is oriented in such a manner that the direction D in which the pouch end portion 216 extends becomes parallel to the X-direction as illustrated in FIG. 10A. When the supply container 210 has been inserted all the way into the supply portion 200, an engagement mechanism (not illustrated) causes the shutter 206 (FIGS. 6A and 6B) of the supply portion 200 and the supply container shutter 214 (FIGS. 8A and 8B) of the supply container 210 to engage with each other.

Figure 10B:
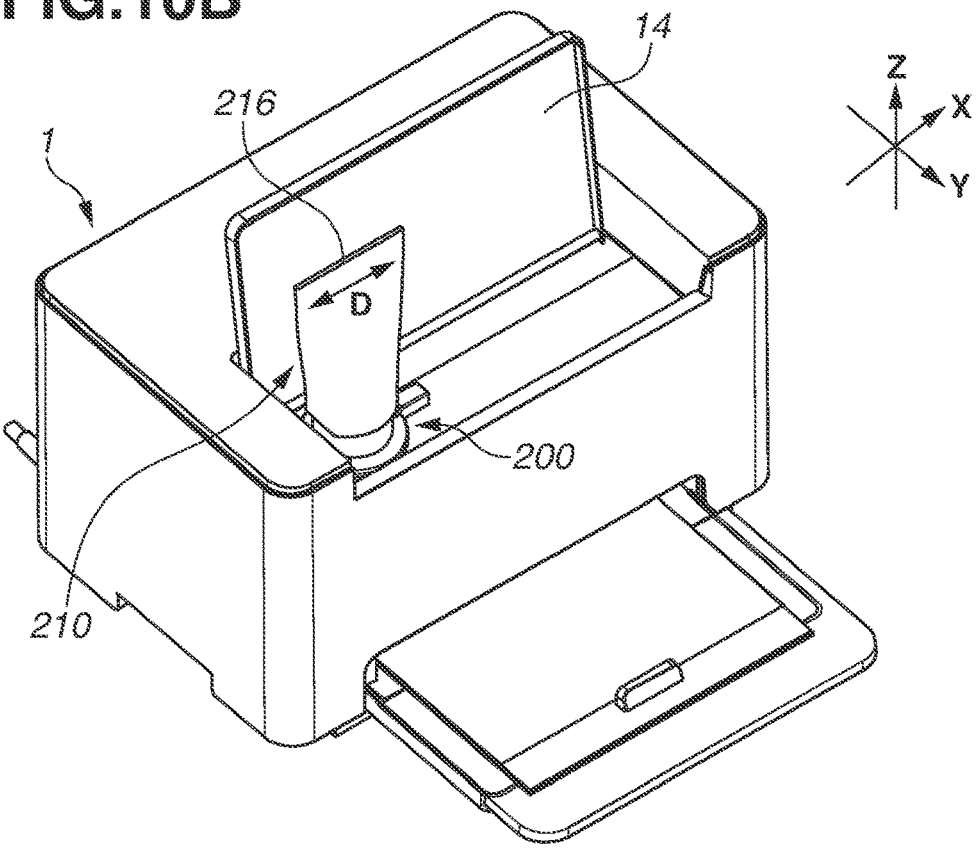

FIG. 10B illustrates a state in which the lever portion 201 has been moved from the initial position to the supplying position. At this time, a lock mechanism (not illustrated) causes the supply container 210 to be fixed in the Z-direction with respect to the supply portion 200. Then, as mentioned above, when the lever portion 201 is moved, the shutter 206 provided at the supply portion 200 rotates. Additionally, since the shutter 206 of the supply portion 200 and the supply container shutter 214 of the supply container 210 are engaging with each other, the supply container shutter 214 rotates together with the shutter 206. As a result, a configuration in which, when the lever portion 201 is moved to the supplying position, the side surface opening 205 (FIGS. 6A and 6B) formed at the toner receiving portion 202 is opened and the opening 213 (FIG. 8A) formed at the base portion 212 is also opened is employed.

The side surface opening 205 formed at the toner receiving portion 202 and the opening 213 formed at the base portion 212 are in such a positional relationship as to face each other at the time when the supply container 210 is inserted into the supply portion 200. Therefore, at the time when the lever portion 201 has been moved from the initial position to the supplying position, the supply container 210, the supply portion 200, and the developing container 18 become continuous with each other, so that it becomes possible to supply toner.

Here, a configuration of the lock portion 30 is described. The lock portion 30 is a mechanism including a solenoid (not illustrated), and, in a normal state in which a lock control unit 314 is not energizing the solenoid, the lock portion 30 and the shutter 206 are engaging with each other, so that the user cannot rotate the lever portion 201. During a period when the lock control unit 314 is energizing the solenoid, the lock portion 30 is disengaged from the shutter 206, so that the user can rotate the lever portion 201.

Figure 11:
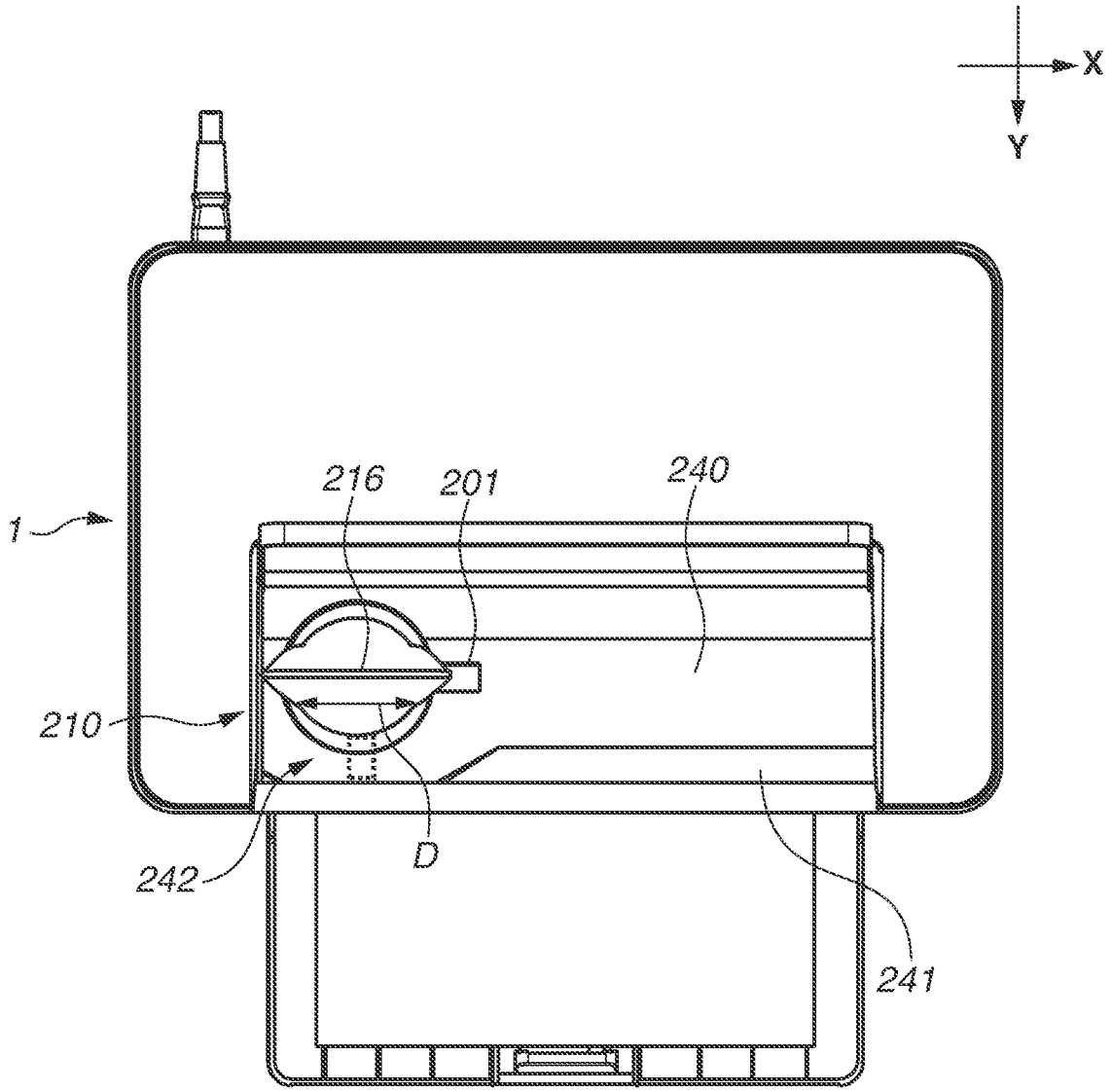
FIG. 11 is a top view illustrating a state in which the supply container has been attached.

FIG. 11 is a top view of the image forming apparatus 1 in the state illustrated in FIG. 10B as viewed from above. When the supply container 210 attached to the image forming apparatus 1 is viewed, as mentioned above, it can be understood that the direction D in which the pouch end portion 216 extends is parallel to the X-direction. Moreover, a raised portion 241, which is raised toward the plus side (upper side) in the Z-direction, is formed at the end of the plus side in the Y-direction of the top surface portion 240, which has been exposed by the discharge tray 14 being opened. A cutout 242 is formed at a part of the raised portion 241, and the position at which the cutout 242 is provided corresponds to a rotational locus of the lever portion 201. The lever portion 201, which is positioned at the initial position in FIG. 11, is illustrated by dashed line. Moreover, in the first exemplary embodiment, a control unit 302 of the image forming apparatus 1 restricts execution of an image forming operation when the image forming apparatus 1 is in a state in which the supply container 210 is attached thereto.

After the completion of toner supply, the user performs an operation of returning the lever portion 201 to the original initial position. At this time, along with an operation for the lever portion 201 to the initial position, first, the shutter 206 of the supply portion 200 and the supply container shutter 214 of the supply container 210 are rotated together, so that both the side surface opening 205 and the opening 213 are closed. Then, the supply portion 200 and the supply container 210 are unlocked from each other, so that it becomes possible to detach the supply container 210 from the supply portion 200. With this configuration, in a case where the supply container 210 is not inserted into the supply portion 200 of the image forming apparatus 1, the supply container shutter 214 is in the state of being closed, so that it becomes possible to prevent toner from leaking.

Figure 12:
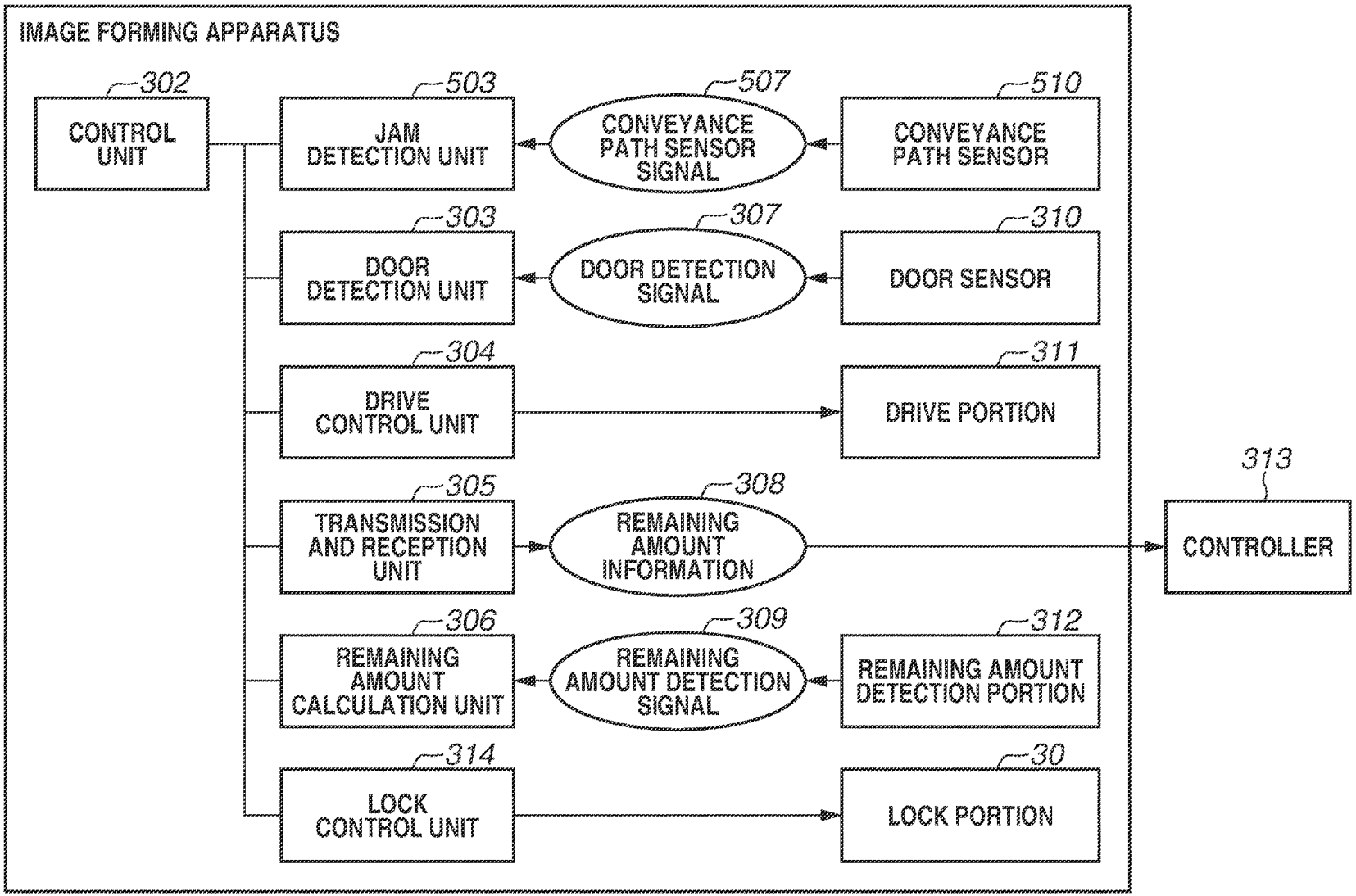
FIG. 12 is a control block diagram of the image forming apparatus in a first exemplary embodiment.

Next, a supply agitation operation in the first exemplary embodiment is described with reference to FIG. 12 to FIG. 15. FIG. 12 is a configuration block diagram related to control of the image forming apparatus 1 in the first exemplary embodiment.

The control unit 302, which is included in the image forming apparatus 1, controls each of a jam detection unit 503, the door detection unit 303, a drive control unit 304, a transmission and reception unit 305, a remaining amount calculation unit 306, and the lock control unit 314. Here, a central processing unit (CPU) serving as a control unit (control device) includes the control unit 302, the jam detection unit 503, the door detection unit 303, the drive control unit 304, the remaining amount calculation unit 306, and the lock control unit 314.

A malfunction in which a sheet S becomes stuck in the conveyance path is called a jam. A conveyance path sensor 510 serving as a detection unit outputs a conveyance path sensor signal 507 depending on the presence or absence of a sheet S in the conveyance path.

The jam detection unit 503 determines whether a jam is occurring based on the conveyance path sensor signal 507. Here, the conveyance path sensor 510 in the first exemplary embodiment refers to the registration sensor 19 and the sheet discharge sensor 20 illustrated in FIG. 2.

The door detection unit 303 detects the state of the door 21 based on a door detection signal 307 output from a door sensor 310, which detects the opened or closed state of the door 21. The drive control unit 304 performs drive control of a drive portion 311, thus controlling the drive portion 311 as needed for, for example, a printing operation and a preliminary preparation operation thereof.

The remaining amount calculation unit 306 calculates the amount of toner stored in the developing container 18 based on a remaining amount detection signal 309 output from a remaining amount detection portion 312, which is arranged near the developing container 18. The transmission and reception unit 305 performs transmission and reception of information with a controller 313, which receives image information from a host such as a personal computer (PC) (not illustrated). In the first exemplary embodiment, particularly, the transmission and reception unit 305 transmits, as remaining amount information 308, the above-mentioned amount of toner stored in the developing container 18.

Here, the transmission and reception unit 305 transmits, as the remaining amount of toner to the controller 313, for example, the percentage of the current amount of toner to the amount of toner storable in the developing container 18 being set to 100%. Moreover, depending on a configuration of the remaining amount detection portion 312, the remaining amount detection signal 309 can be, for example, an analog signal the voltage of which changes based on the remaining amount of developer or, for example, a pulse signal pulses of which are output with a constant period and the high or low pulse width of which changes according to the remaining amount of toner.

Moreover, the lock control unit 314 serving as a control unit controls the lock portion 30 to restrict movement of the lock portion 30.

In the first exemplary embodiment, as mentioned above, the supply of toner is performed with the supply container 210 attached to the supply portion 200. At this time, it is desirable that the remaining amount calculation unit 306 calculate whether toner has been correctly supplied to the developing container 18 and to what extent the remaining amount of toner has increased and notify the controller 313 of the remaining amount information 308, which is a result of such calculation. Then, it is desirable that, to enable the remaining amount detection portion 312 to correctly detect the amount of toner, an agitation operation have been sufficiently performed and toner inside the developing container 18 have become even.

In the first exemplary embodiment, a configuration of causing the drive portion 311 to operate during the supply of toner to rotate the agitation member 40 is employed. Rotating the agitation member 40 during the supply of toner prevents toner from converging on a part of the developing container 18 and becoming stuck. Moreover, starting to rotate the agitation member 40 during the supply of toner enables making toner inside the developing container 18 even while performing the supply of toner and enables reducing a time from when the user finishes the supply of toner to when the calculation of the remaining amount of toner is completed.

Figure 13:
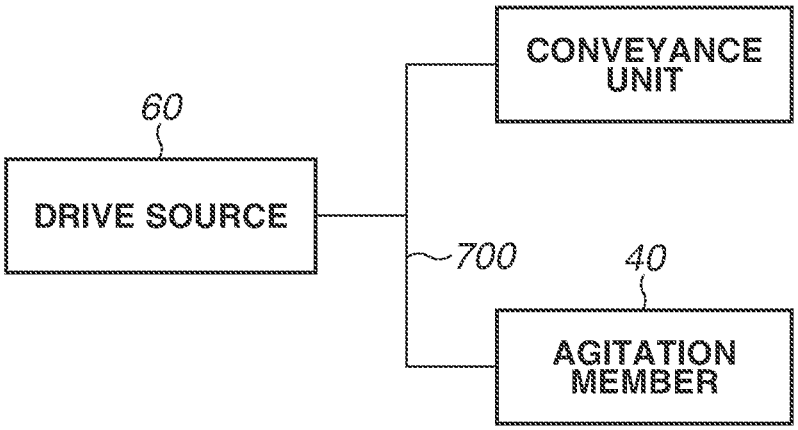
FIG. 13 is a diagram illustrating a part of drive force transmission of a drive source.

FIG. 13 is a diagram illustrating a part of drive transmission from a drive source. In the image forming apparatus 1 in the first exemplary embodiment, to perform miniaturization and cost reduction of the image forming apparatus 1 itself, a drive source 60, which serves as the drive portion 311 included in the image forming apparatus 1, transmits drive force to the agitation member 40 and a conveyance unit via a drive transmission path 700. Therefore, when the drive source 60 is caused to operate by the drive control unit 304, each of the agitation member 40 and the conveyance unit receives drive force. Specifically, the drive transmission path 700 is a gear train including at least one gear. Moreover, the drive transmission path 700 does not include any unit (for example, a clutch) for selectively driving only one of the agitation member 40 and the conveyance unit. Accordingly, the drive source 60 is allowed to drive both the agitation member 40 and the conveyance unit, but is not allowed to drive only one of the agitation member 40 and the conveyance unit.

Figure 14:
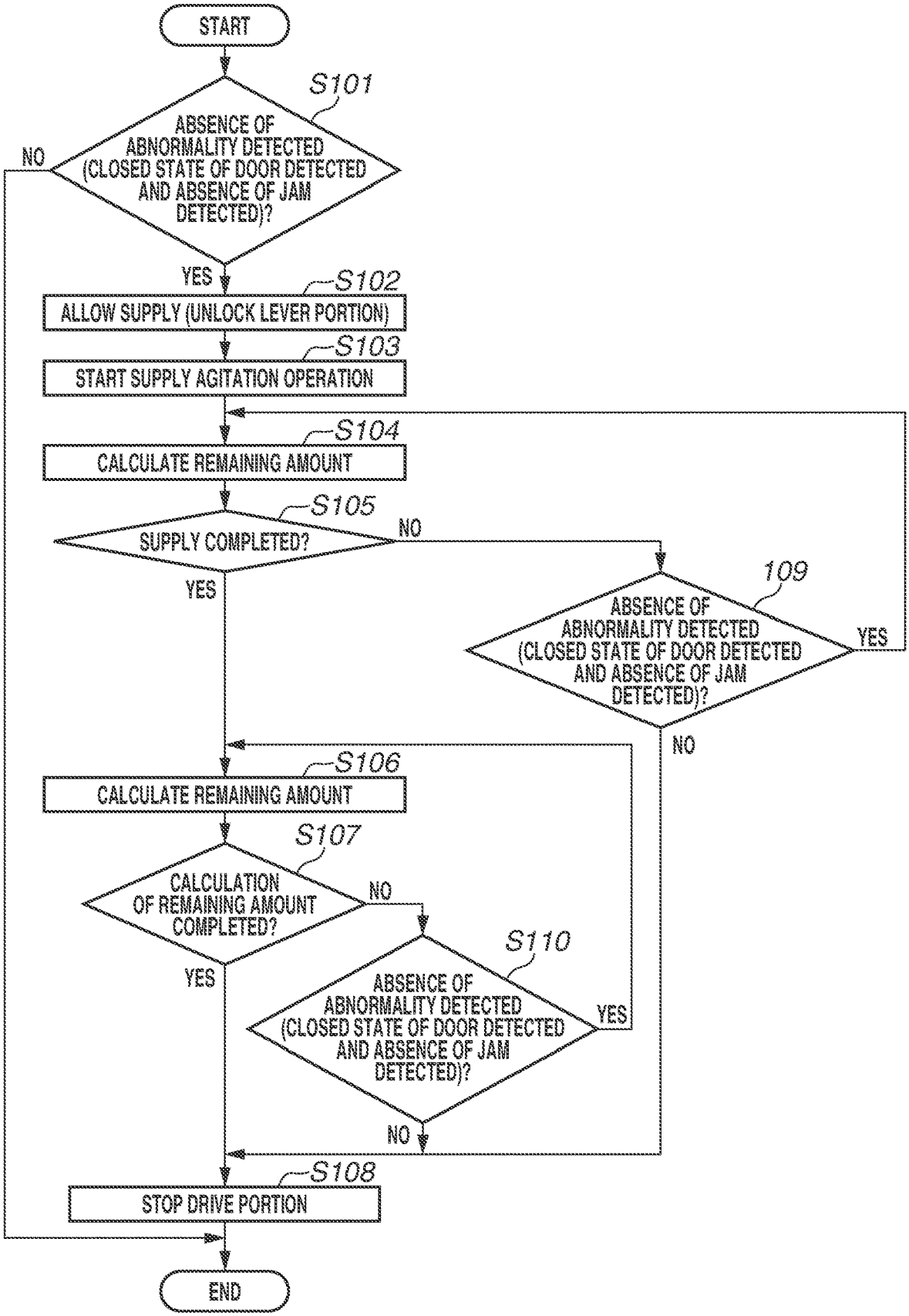
FIG. 14 is a flowchart of drive control in the first exemplary embodiment.

FIG. 14 is a flowchart of control which is performed in the first exemplary embodiment. Here, an operation of, at the time of supplying toner from the supply container 210 to the developing container 18, the agitation member 40 agitating a developer inside the developing container 18 is referred to as a "supply agitation operation". The supply agitation operation is performed in conjunction with an operation related to the supply of toner from the supply container 210 to the developing container 18. In other words, the control unit 302 controls the drive source 60 in such a manner that, when the operation related to the supply of toner from the supply container 210 to the developing container 18 is performed, the supply agitation operation is performed.

In the first exemplary embodiment, the supply agitation operation is started in conjunction with an operation on the lever portion 201 (an operation of opening the shutter 206 of the supply portion 200 and the supply container shutter 214 of the supply container 210). Specifically, when an operation on the lever portion 201 has been performed in such a way as to open the shutter 206 and the supply container shutter 214, the control unit 302 controls the drive control unit 304 to cause the drive source 60 to operate. Then, the agitation member 40 and the conveyance unit are driven.

In the first exemplary embodiment, the image forming apparatus 1 includes a lever detection portion 80 (FIG. 3), which serves as an operation detection portion for detecting that the lever portion 201 has been moved. The operation on the lever portion 201 is detected by the lever detection portion 80. When the lever portion 201 is moved in such a way as to open the shutter 206 and the supply container shutter 214 and the movement of the lever portion 201 has been detected by the lever detection portion 80, the control unit 302 causes the drive source 60 to operate.

When the supply of toner is started in response to the discharge tray 14 being opened, in step S101, the control unit 302 checks that the door detection unit 303 has detected the closed state of the door 21 and that the jam detection unit 503 is not in a state of having detected a jam. At this time, if the control unit 302 has checked that the opened state of the door 21 or the occurrence of a jam has been detected, the control unit 302 determines that there is an abnormality (NO in step S101), so that the control unit 302 causes the lever portion 201 to be locked by the lock portion 30 and, thus, the user cannot operate the lever portion 201 and cannot perform the supply of toner.

In other words, restricting movement of the lever portion 201 enables preventing the user from supplying toner in a state in which the drive portion 311 should not be caused to operate, thus preventing a supply agitation operation from being performed. In the first exemplary embodiment, the movement of the lever portion 201 is restricted by the lever portion 201 being locked by the lock portion 30. However, the discharge tray 14 can be configured to be locked in a case where the door detection unit 303 has detected the opened state of the door 21 or in a case where the jam detection unit 503 has detected a jam. In response to the discharge tray 14 being locked, the supply container 210 being attached to the supply portion 200 or the user accessing the lever portion 201 to move the lever portion 201 is restricted.

As a result, it is possible to prevent a supply agitation operation from being performed and prevent the conveyance unit from being driven in a case where the door detection unit 303 has detected the opened state of the door 21 or in a case where the jam detection unit 503 has detected a jam.

If it is determined that there is no abnormality (YES in step S101), then in step S102, the control unit 302 unlocks the lever portion 201. The condition for unlocking can additionally include conditions in which, for example, the remaining amount of toner is less than or equal to a predetermined amount or there is another malfunction.

The user attaches the supply container 210 to the supply portion 200 and then rotates the lever portion 201. When, in response to the lever portion 201 being rotated, the shutter 206 has entered into the opened state, then in step S103, the control unit 302 starts the supply agitation operation. In other words, the control unit 302 causes the drive control unit 304 to control the drive source 60 in such a manner that the supply agitation operation is started when an operation on the lever portion 201 has been detected. Moreover, the control unit 302 causes the supply agitation operation to be used to drive not only the agitation member 40 but also the conveyance unit.

Furthermore, while, in the first exemplary embodiment, the supply agitation operation is started in response to the lever portion 201 being rotated, a configuration in which the supply agitation operation is started in conjunction with another operation can be employed. For example, a configuration in which the supply agitation operation is started in conjunction with an operation of inserting the supply container 210 into the supply portion 200 can be employed.

After the supply agitation operation is started, then in step S104, the remaining amount calculation unit 306 sequentially performs a remaining amount calculation operation based on the remaining amount detection signal 309 output from the remaining amount detection portion 312. Then, in step S105, while the remaining amount calculation operation is being performed, the control unit 302 checks whether the supply of toner is completed. The completion of the supply of toner here is determined by whether the closed state of the lever portion 201 has been detected. During a period in which the lever portion 201 is opened (if the supply of toner is not yet completed) (NO in step S105), then in step S109, the control unit 302 checks the state of the door 21 or the absence of a jam. Then, if it is determined that the opened state of the door 21 or the presence of a jam has been detected (NO in step S109), then in step S108, the drive control unit 304 stops the drive portion 311 even if the supply agitation operation itself does not have an abnormality.

In other words, in a state in which the supply agitation operation is being performed, in a case where the door detection unit 303 has detected the opened state of the door 21 or in a case where the jam detection unit 503 has detected a jam, the control unit 302 causes the drive control unit 304 to control the drive source 60 in such a manner that the supply agitation operation is stopped. As a result, in a case where the door detection unit 303 has detected the opened state of the door 21 or in a case where the jam detection unit 503 has detected a jam, it is possible to stop the supply agitation operation and stop the conveyance unit.

If it is determined that there is no abnormality (YES in step S109), then in step S104 and step S105, the control unit 302 waits for completion of the supply of toner while continuing calculating the remaining amount of toner.

The abnormality of the supply agitation operation itself is, for example, a case where, regardless of the lever portion 201 having entered into the opened state, the remaining amount of toner calculated by the remaining amount calculation unit 306 based on the remaining amount detection signal 309 output from the remaining amount detection portion 312 does not increase. In this case, the control unit 302 can perform any error determination and provide a display to that effect. If the user finishes the supply of toner and closes the lever portion 201 (YES in step S105) then in step S106, the control unit 302 performs a remaining amount calculation operation. During a period in which the remaining amount calculation operation is being performed (NO in step S107), then in step S110, as with step S109, the control unit 302 checks whether the door 21 has not entered into the opened state or any jam has not been detected. If the opened state of the door 21 has been detected or a jam has been detected (NO in step S110), then in step S108, the control unit 302 stops driving. If there is no abnormality (YES in step S110), then in step S106, the control unit 302 continues calculating the remaining amount of toner. The condition for ending of the remaining amount calculation operation can be a case where a predetermined time has passed after the lever portion 201 is closed or a case where a result of remaining amount calculation has fallen below a predetermined tolerance range. Then, in step S108, the control unit 302 ends the supply agitation operation when the remaining amount calculation is completed.

Next, a second exemplary embodiment of the present disclosure is described. The second exemplary embodiment is directed to an image forming apparatus having a configuration similar to that in the first exemplary embodiment. Therefore, with respect to names of an image forming apparatus and its constituent members in the second exemplary embodiment, the same names as those in the first exemplary embodiment are used.

In the first exemplary embodiment, execution of the supply agitation operation is restricted by restricting movement of the lever portion 201 in a case where the door detection unit 303 has detected the opened state of the door 21 or in a case where the jam detection unit 503 has detected a jam. In the second exemplary embodiment, even when the lever portion 201 has moved in a case where the door detection unit 303 has detected the opened state of the door 21 or in a case where the jam detection unit 503 has detected a jam, the control unit 302 does not perform the supply agitation operation.

Figure 15:
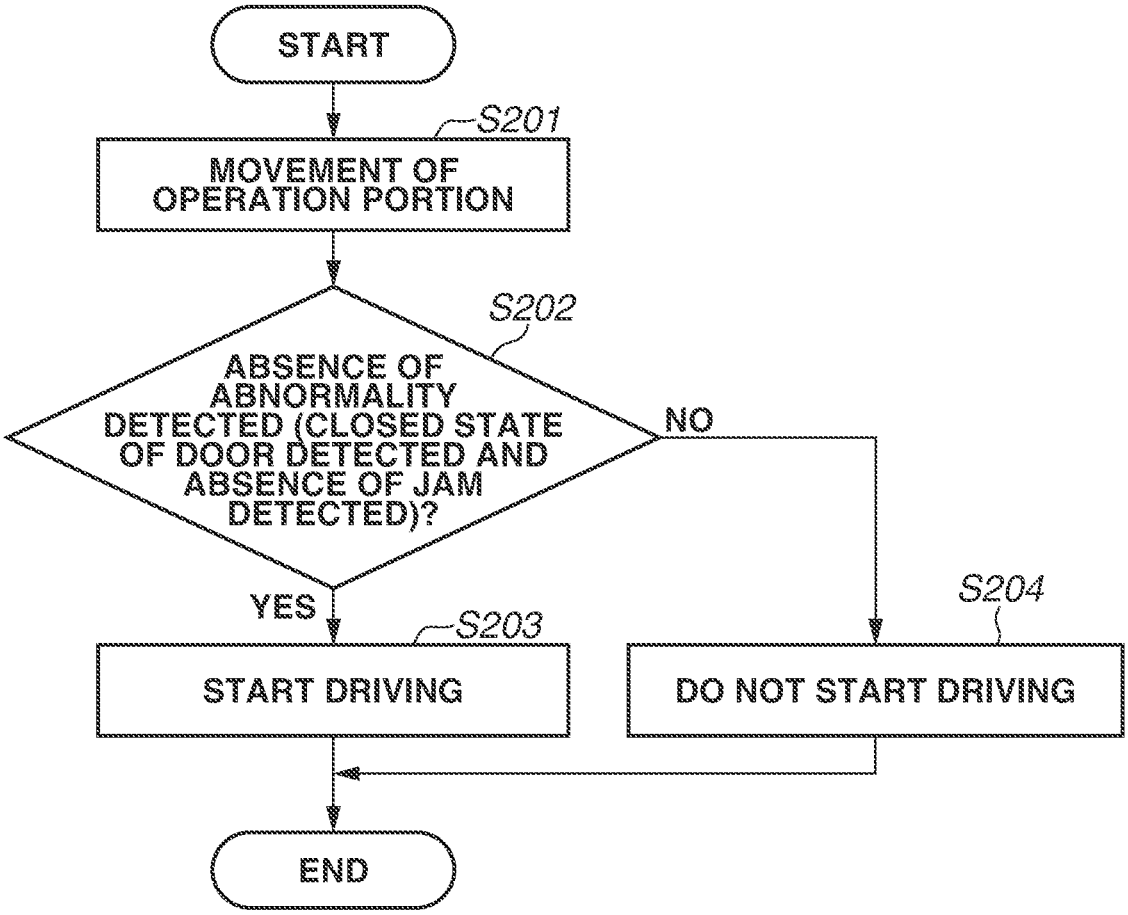
FIG. 15 is a flowchart of drive control in a second exemplary embodiment.

FIG. 15 is a flowchart of control which is performed in the second exemplary embodiment. In step S201, when the lever portion 201 moves, the movement of the lever portion 201 is detected by the lever detection portion 80. After that, in step S202, the control unit 302 checks whether the door detection unit 303 has not detected the opened state of the door 21 or the jam detection unit 503 has not detected any jam. Then, if it is determined that there is no abnormality (YES in step S202), then in step S203, the control unit 302 starts a supply agitation operation. If it is determined that there is an abnormality (NO in step S202), then in step S204, the control unit 302 does not start driving. Moreover, in a case where the control unit 302 has started the supply agitation operation in step S203, since control operations similar to those in step S103 to step S110 in the first exemplary embodiment are performed, the description thereof is omitted.

According to the second exemplary embodiment, even when the lever portion 201 is moved with the door 21 being opened or with a jam occurring, the control unit 302 does not perform the supply agitation operation. As a result, when the door 21 is in the state of being opened or when a jam is occurring, the conveyance unit is not driven.

A third exemplary embodiment of the present disclosure is described as follows with reference to the drawings.

However, for example, the dimensions, materials, shapes, and relative locations of constituent components described in the third exemplary embodiment can be changed or altered as appropriate according to a configuration of the apparatus to which the present disclosure is applied and various conditions.

Thus, the scope of the present disclosure should not be construed to be limited to the following exemplary embodiment.

Figure 16:
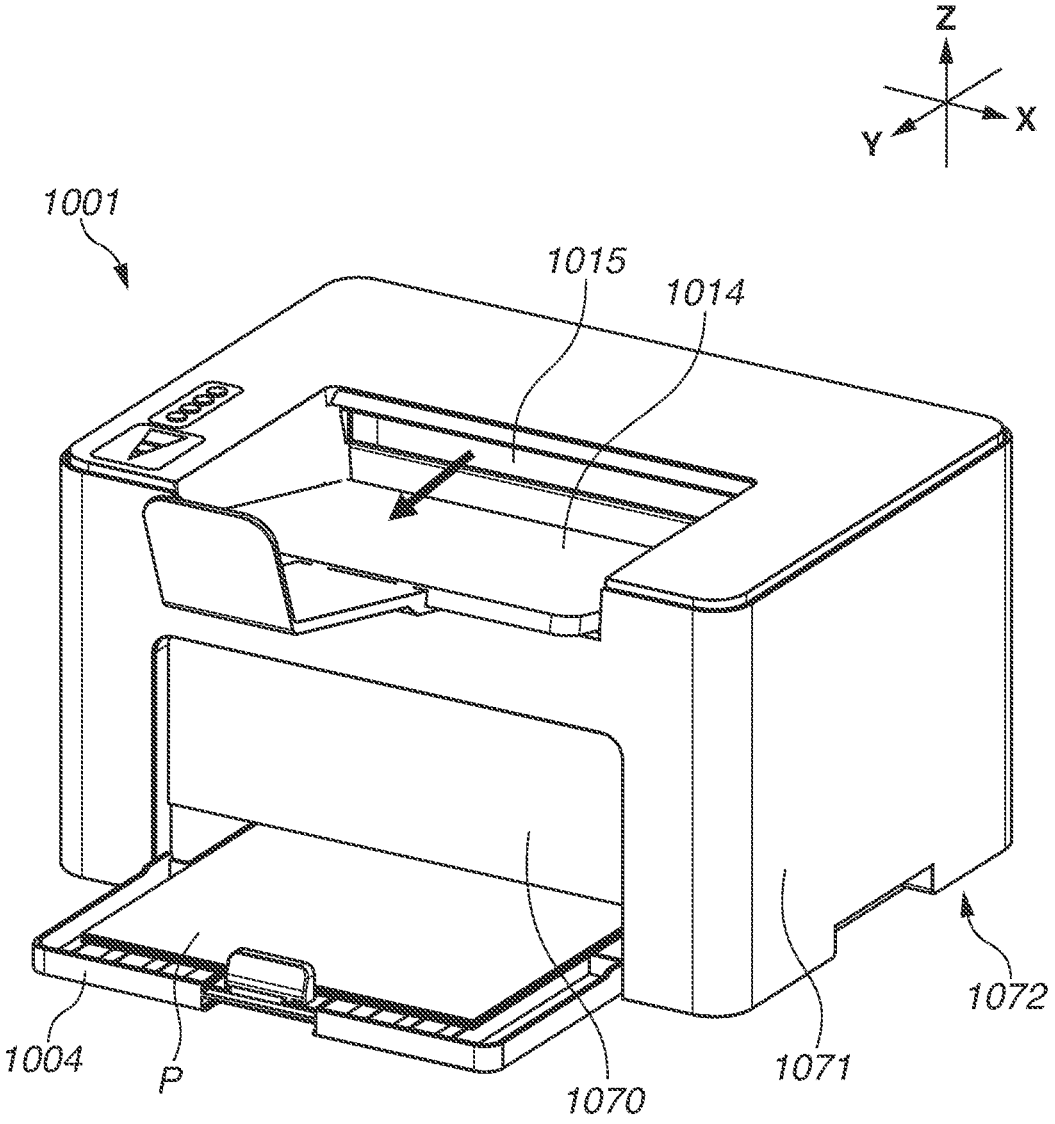
FIG. 16 is a perspective view illustrating an image forming apparatus according to a third exemplary embodiment.
Figure 17:
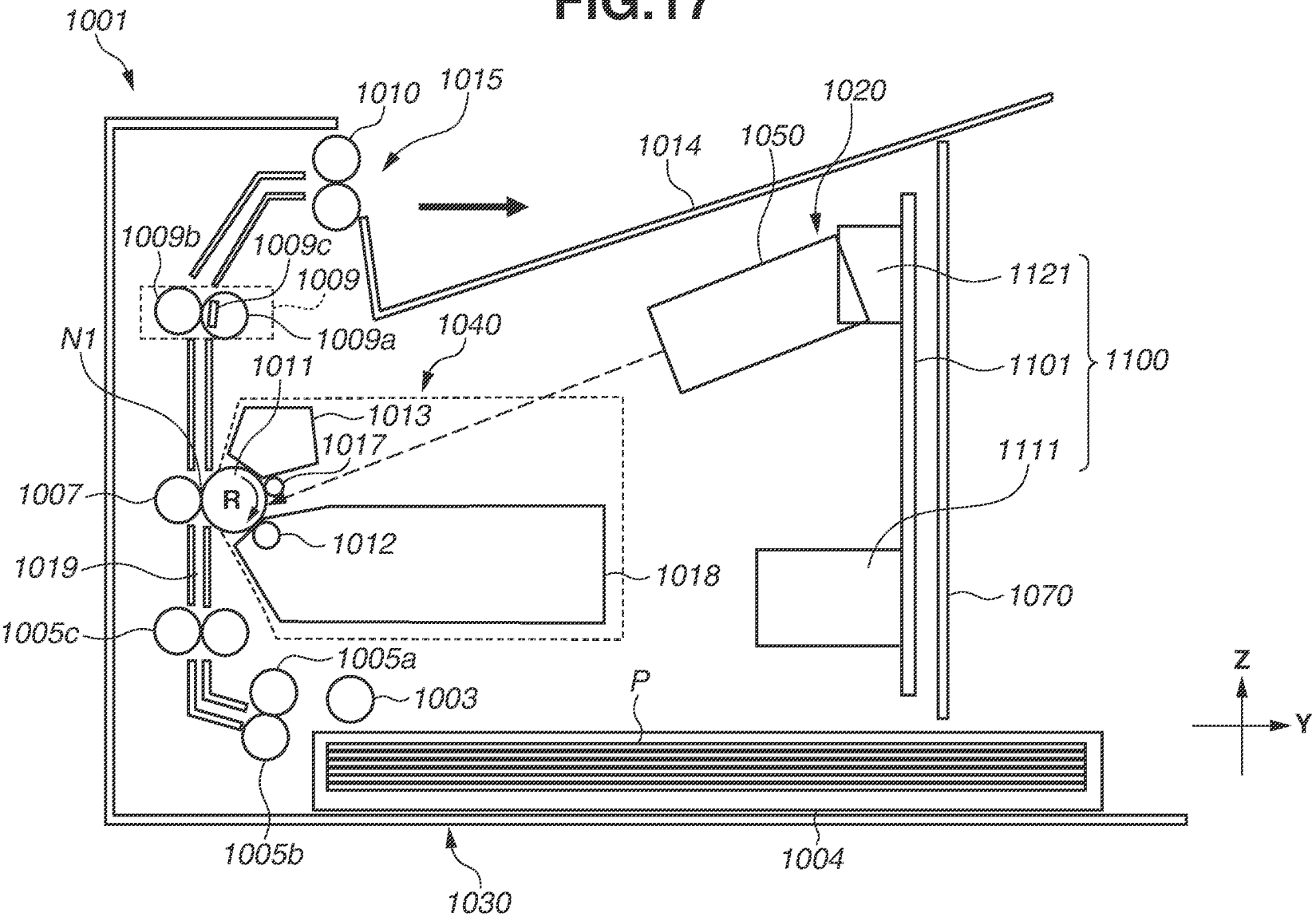
FIG. 17 is an overall schematic view illustrating the image forming apparatus.

FIG. 16 is a perspective view illustrating an image forming apparatus 1001 according to the third exemplary embodiment. FIG. 17 is a schematic view illustrating a configuration of the image forming apparatus 1001. The image forming apparatus 1001 is a monochrome printer which forms an image on a recording material based on image information input from an external apparatus. Examples of the recording material include various sheet materials different in material quality, for example, paper such as plain paper and heavy paper, a plastic film such as an overhead projector sheet, a specially shaped sheet such as an envelope and an index sheet, and cloth.

Moreover, in the following description, the height direction (a direction opposite to vertical direction) of the image forming apparatus 1001 in a case where the image forming apparatus 1001 is installed on a horizontal surface is assumed to be a Z-direction. A direction perpendicular to the Z-direction and parallel to a rotational axis direction (main scanning direction) of a photosensitive drum 1011 described below is assumed to be an X-direction. A direction perpendicular to the X-direction and the Z-direction is assumed to be a Y-direction. It is favorable that the X-direction, the Y-direction, and the Z-direction perpendicularly intersect with each other. Moreover, for the sake of convenience, a plus side in the X-direction is referred to as a right side and a minus side in the X-direction is referred to as a left side, a plus side in the Y-direction is referred to as a front side or a front surface side and a minus side in the Y-direction is referred to as a rear side or a back surface side, and a plus side in the Z-direction is referred to as an upside and a minus side in the Z-direction is referred to as a downside.

<Overall Configuration>

The image forming apparatus 1001 includes, as illustrated in FIG. 16 and FIG. 17, an image forming portion 1020, which forms a toner image on a recording material, a feeding portion 1030, which feeds a recording material P, a fixing portion 1009, which fixes a toner image formed by the image forming portion 1020 to a recording material, and a discharge roller pair 1010.

The image forming portion 1020 includes a scanner unit 1050, a process unit 1040 of the electrophotographic type, and a transfer roller 1007, which transfers a toner image formed on the photosensitive drum 1011 of the process unit 1040 to a recording material P. The process unit 1040 includes the photosensitive drum 1011, a cleaning unit 1013, which is arranged near the photosensitive drum 1011, a charging roller 1017, a developing roller 1012, and a storing portion 1018, which stores toner. Furthermore, the process unit 1040 can be screwed and fastened to a housing 1072 of the image forming apparatus 1001 or can include the one detachable by a service engineer.

The photosensitive drum 1011, which serves as an image bearing member, is a photosensitive member formed in a cylindrical shape. The photosensitive drum 1011 in the third exemplary embodiment includes a photosensitive layer formed from a negatively charged organic photoconductor on a drum-shaped base substance formed from aluminum. Moreover, the photosensitive drum 1011, which serves as an image bearing member, is driven by a motor to rotate at a predetermined process speed in a predetermined direction (the direction of arrow R in FIG. 17).

The charging roller 1017 is in contact with the photosensitive drum 1011 at a predetermined pressure contact force to form a charging portion. Moreover, by receiving a desired charging voltage applied by a charging high-voltage power source, the charging roller 1017 uniformly charges the surface of the photosensitive drum 1011 to a predetermined potential. In the third exemplary embodiment, the photosensitive drum 1011 is charged to a negative polarity by the charging roller 1017.

The scanner unit 1050 exposes the surface of the photosensitive drum 1011 in a scanning manner by radiating laser light corresponding to image information input from an external apparatus to the photosensitive drum 1011 via a polygon mirror. This exposure causes an electrostatic latent image corresponding to the image information to be formed on the surface of the photosensitive drum 1011. Furthermore, the scanner unit 1050 is not limited to a laser scanner device, but, for example, an light-emitting diode (LED) exposure device including an LED array with a plurality of LEDs arrayed along the longitudinal direction of the photosensitive drum 1011 can be employed.

The developing roller 1012 is rotatably supported by the storing portion 1018, which serves as a toner storing portion. Moreover, the developing roller 1012 is arranged at the opening portion of a developing container 1230 (see FIG. 19) including the storing portion 1018 in such a way as to face the photosensitive drum 1011. Furthermore, the storing portion 1018 can be provided with a supply roller for applying toner serving as a developer stored in the storing portion 1018 to the surface of the developing roller 1012.

The process unit 1040 in the third exemplary embodiment uses a contact developing method as a developing method.

Specifically, a toner layer borne by the developing roller 1012 comes into contact with the photosensitive drum 1011 at a developing portion (developing region) in which the photosensitive drum 1011 and the developing roller 1012 face each other. A developing voltage is applied to the developing roller 1012 by a developing high-voltage power source. Under the developing voltage, toner borne by the developing roller 1012 transfers from the developing roller 1012 to the surface of the photosensitive drum 1011 according to an electric potential distribution on the surface of the photosensitive drum 1011, so that an electrostatic latent image is developed into a toner image.

Moreover, toner in the third exemplary embodiment does not contain a magnetic component and is what is called a non-magnetic one-component developer in which toner is borne on the developing roller 1012 mainly by intermolecular force or electrostatic force (image force). However, a one-component developer containing a magnetic component can be used. Moreover, some one-component developers contain, in addition to toner particles, additives for adjusting the fluidity or charging performance of toner (for example, wax or silica microparticles). Moreover, a two-component developer configured with non-magnetic toner and carrier having magnetic property can be used as a developer. In the case of using a developer having magnetic property, for example, a cylindrical developing sleeve with a magnet arranged therein can be used as a developer bearing member.

The fixing portion 1009 is of the heat fixing type, which performs fixing processing of an image by heating and melting toner on a recording material. The fixing portion 1009 includes a heating roller 1009*a*, in which a fixing heater 1009*c* is incorporated, and a pressure roller 1009*b*, which is in pressure contact with the heating roller 1009*a*.

The feeding portion 1030 includes a cassette 1004, in which recording materials P are stacked, a pickup roller 1003, which serves as a conveyance portion, a feeding roller 1005*a*, and a separation roller 1005*b*. A front cover 1070 is provided at a part of the end surface on the front surface side of the image forming apparatus 1001, and the front cover 1070 covers a circuit board 1100. The housing 1072 includes the front cover 1070, a discharge tray 1014, a back surface cover 1073 (see FIG. 18A), the front cover 1070, and an exterior cover 1071, which constitutes an exterior of the image forming apparatus 1001 other than the discharge tray 1014 and the back surface cover 1073. A discharge port 1015, through which a sheet to be discharged to the discharge tray 1014 passes, is formed in the housing 1072.

As illustrated in FIG. 17, the image forming apparatus 1001 includes the circuit board 1100. The circuit board 1100 is configured with a wiring board 1101 made from an insulator and electronic components 1111 and 1121 soldered to the wiring board 1101. Since conductive wirings are provided on and inside a plate of the wiring board 1101, the electronic components 1111 and 1121 are electrically interconnected. The circuit board 1100 has the function of converting an alternating current supplied from the outside of the image forming apparatus 1001 into a direct current and the function of converting an input voltage to obtain a predetermined voltage value required for an image forming process.

The circuit board 1100 is arranged in such an orientation that a surface of the wiring board 1101 on which the electronic components 1111 and 1121 are mounted intersects with the discharge direction. Additionally, the wiring board 1101 is provided between the front cover 1070 and the scanner unit 1050 with respect to the discharge direction. The electronic components 1111 and 1121 are provided on a surface on the side facing the scanner unit 1050 on the wiring board 1101.

Next, an image forming operation of the image forming apparatus 1001 is described. When an instruction for image formation is input to the image forming apparatus 1001, an image forming process to be performed by the image forming portion 1020 is started based on image information input from an external computer connected to the image forming apparatus 1001. The scanner unit 1050 radiates laser light toward the photosensitive drum 1011 based on the input image information. At this time, the photosensitive drum 1011 is electrically charged by the charging roller 1017 in advance, and, according to the photosensitive drum 1011 being irradiated with laser light, an electrostatic latent image is formed on the photosensitive drum 1011. After that, the electrostatic latent image is developed by the developing roller 1012, so that a toner image is formed on the photosensitive drum 1011.

In parallel with the above-mentioned image forming process, the pickup roller 1003 of the feeding portion 1030 sends out a recording material P supported in the cassette 1004. The recording material P is separated one by one by the feeding roller 1005*a* and the separation roller 1005*b* and is then conveyed to the conveyance roller pair 1005*c*. Then, the recording material P is conveyed by the conveyance roller pair 1005*c* serving as a conveyance portion toward a transfer nip N1 serving as an image forming portion formed by the transfer roller 1007 and the photosensitive drum 1011.

A transfer voltage is applied from a transfer high-voltage power source to the transfer roller 1007, so that a toner image borne on the photosensitive drum 1011 is transferred to the recording material P conveyed by the conveyance roller pair 1005*c*. The recording material P with the toner image transferred thereto is conveyed to the fixing portion 1009, and the toner image is heated and pressed when the recording material P passes through a nip portion between the heating roller 1009*a* and the pressure roller 1009*b* of the fixing portion 1009. This causes toner particles to be melted and then fixed, so that the toner image is fixed to the recording material P. The recording material P having passed through the fixing portion 1009 is discharged to the outside (exterior) of the image forming apparatus 1001 by the discharge roller pair 1010 via the discharge port 1015 and is then stacked on the discharge tray 1014. Toner remaining on the photosensitive drum 1011 after the toner image is transferred to the recording material P is removed for cleaning by the cleaning unit 1013.

Furthermore, while the image forming apparatus 1001 in the third exemplary embodiment is configured to form an image on only one side of a recording material P, the third exemplary embodiment is not limited to this. For example, a two-sided conveyance path for reversing a recording material P with an image formed on the first surface thereof can be provided in the image forming apparatus 1001, so that the image forming apparatus 1001 can be configured to be capable of forming images on both sides of a recording material P.

Figure 18A:
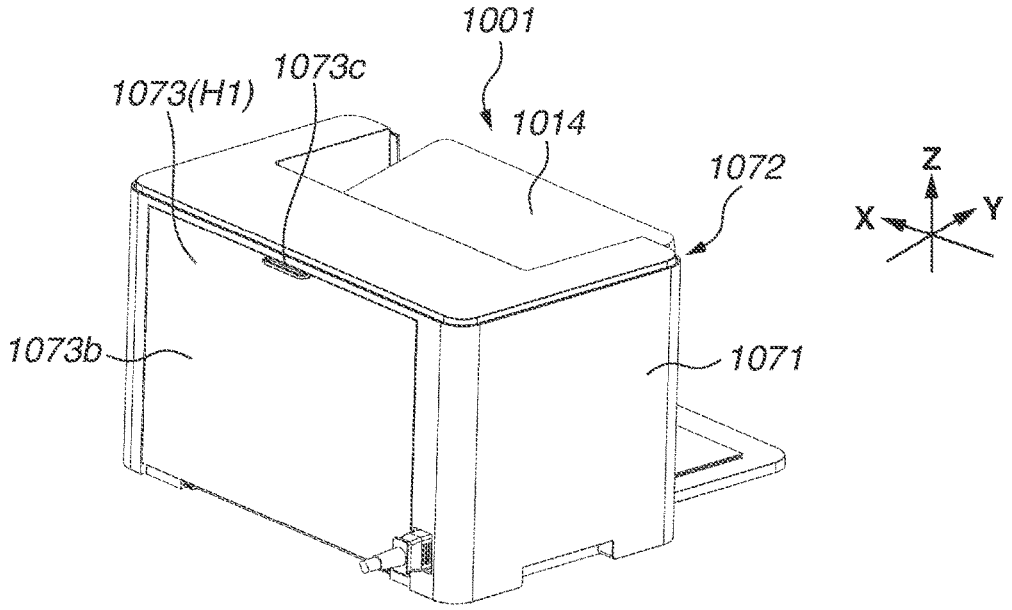
FIG. 18A is a perspective view illustrating the image forming apparatus in a state in which a back side cover has been closed.
Figure 18B:
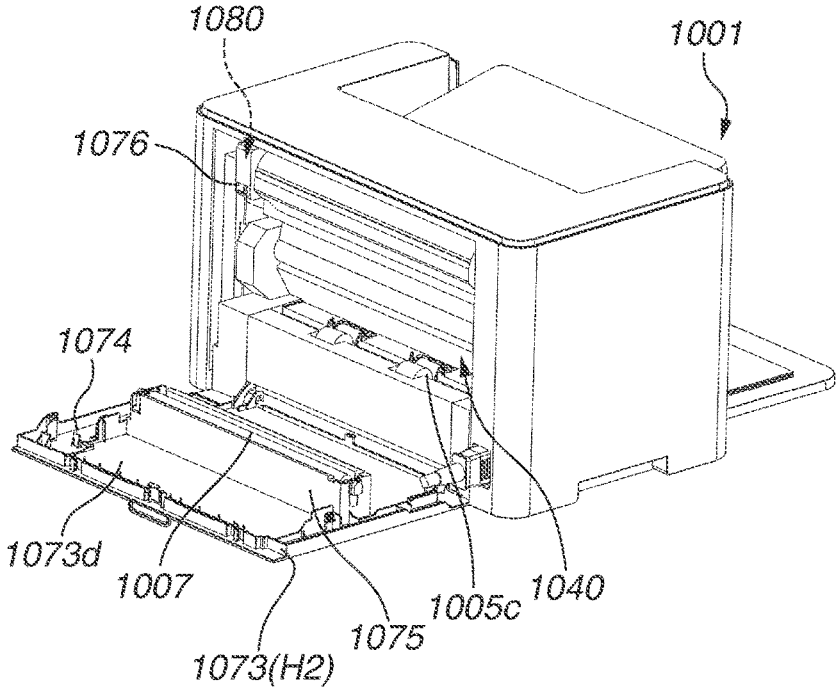
FIG. 18B is a perspective view illustrating the image forming apparatus in a state in which the back side cover has been opened.

As illustrated in FIGS. 18A and 18B, the back surface cover 1073, which is supported in such a way as to be openable and closable, is provided at the back surface of the image forming apparatus 1001. The back surface cover 1073, which serves as an opening and closing member, covers the process unit 1040 when in a closed state, and, when in an opened state, causes the process unit 1040 to be exposed.

Moreover, in response to the back surface cover 1073 being opened, a conveyance path 1019 (see FIG. 17), through which a recording material P conveyed by the conveyance roller pair 1005*c* passes, is opened. Thus, the back surface cover 1073 is movable between a closed position H1, at which the back surface cover 1073 covers the conveyance path 1019, and an opened position H2, at which the back surface cover 1073 causes the conveyance path 1019 to be exposed on the outside. This enables removing a jam which has occurred in the conveyance path 1019.

A grip portion 1073*c*, which is able to be gripped by the user when the user opens or closes the back surface cover 1073, is provided on an outer side surface 1073*b* of the back surface cover 1073, i.e., a surface constituting an exterior surface of the housing 1072. A rib 1074 and a supporting portion 1075, which supports the transfer roller 1007 in a rotatable manner, are provided on an inner side surface 1073*d* opposite to the outer side surface 1073*b* of the back surface cover 1073. The rib 1074 extends from the outer side surface 1073*b* in a direction in which the back surface cover 1073 is closed.

An opening portion 1076, which is arranged at a position corresponding to the rib 1074 in a state in which the back surface cover 1073 is closed, is provided in the image forming apparatus 1001, and a back surface cover opening and closing detection sensor 1080 is provided inside the opening portion 1076. Furthermore, the opening portion 1076 can be provided in the process unit 1040 or can be provided in a component of the image forming apparatus 1001 other than the process unit 1040.

Figure 18C:
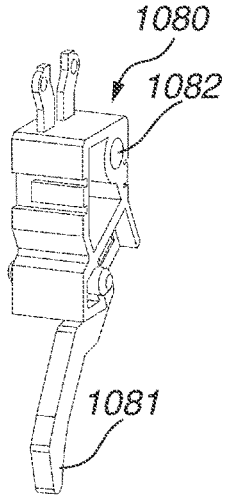
FIG. 18C is a perspective view illustrating an opening and closing detection sensor.

The back surface cover opening and closing detection sensor 1080 includes, as illustrated in FIG. 18C, a flag portion 1081 and a sensor portion 1082, and the sensor portion 1082 transitions, for example, from an off-state to an on-state in response to the flag portion 1081 being pushed by the rib 1074 of the back surface cover 1073. Moreover, in response to the back surface cover 1073 being opened, the rib 1074 of the back surface cover 1073 moves away from the flag portion 1081, and, for example, the sensor portion 1082 transitions from an on-state to an off-state. In this way, the back surface cover opening and closing detection sensor 1080 is able to detect opening and closing of the back surface cover 1073.

<Developing Container>

Figure 19:
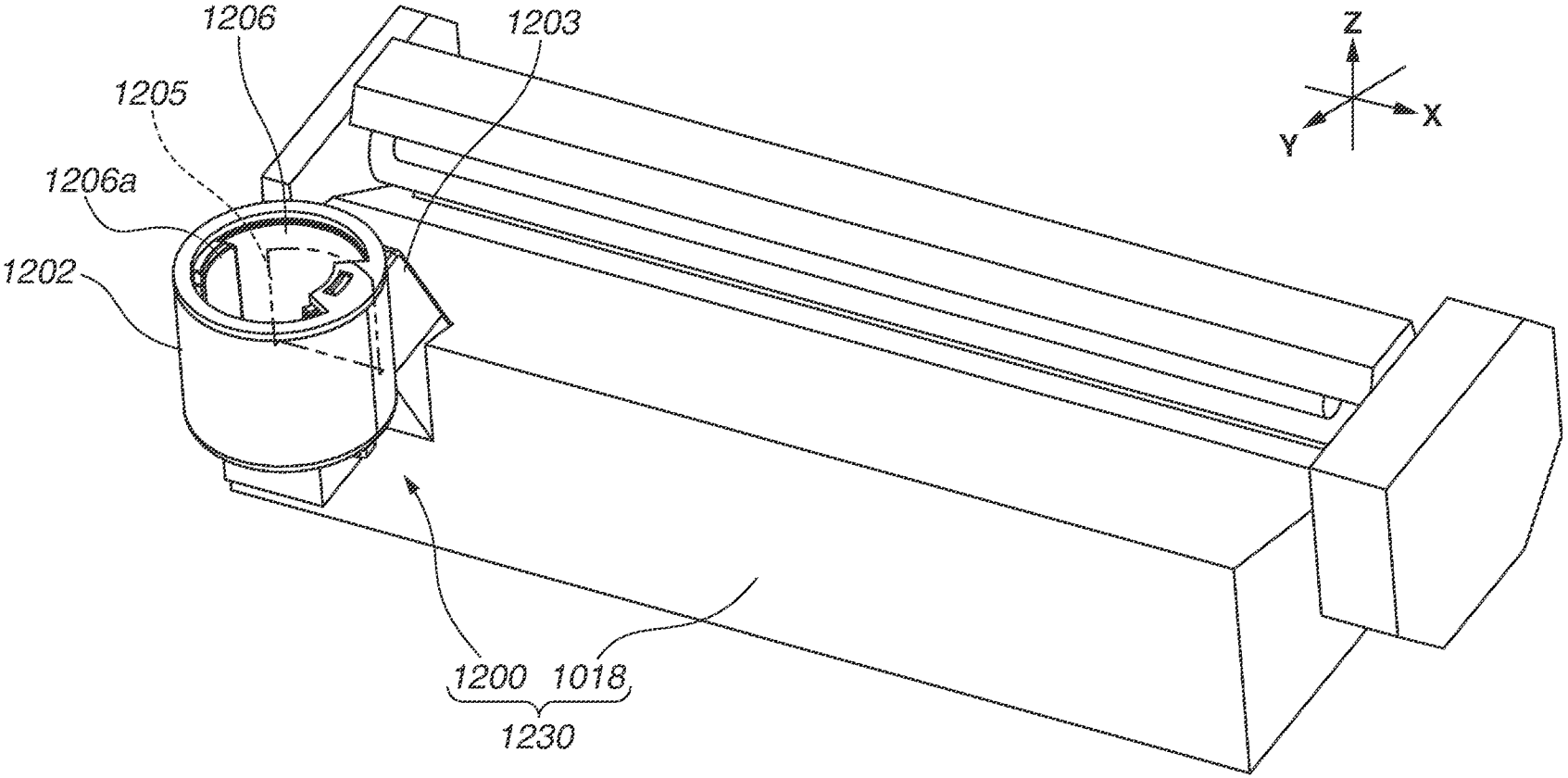
FIG. 19 is a perspective view illustrating a developing container.

Next, the developing container 1230 and its peripheral components are described with reference to FIG. 19 and FIG. 20. As illustrated in FIG. 19, the developing container 1230 is configured with the storing portion 1018 and a supply portion 1200, which serves as an attachment portion and a reception portion. The supply portion 1200 includes an operation portion 1201, a cylindrically shaped toner receiving portion 1202, a supply path portion 1203, which interconnects the toner receiving portion 1202 and the storing portion 1018, and a main body shutter portion 1206, which serves as a main body shutter. A side surface opening 1205, which is continuous with the supply path portion 1203, is formed in an inner wall of the toner receiving portion 1202.

Figure 20:
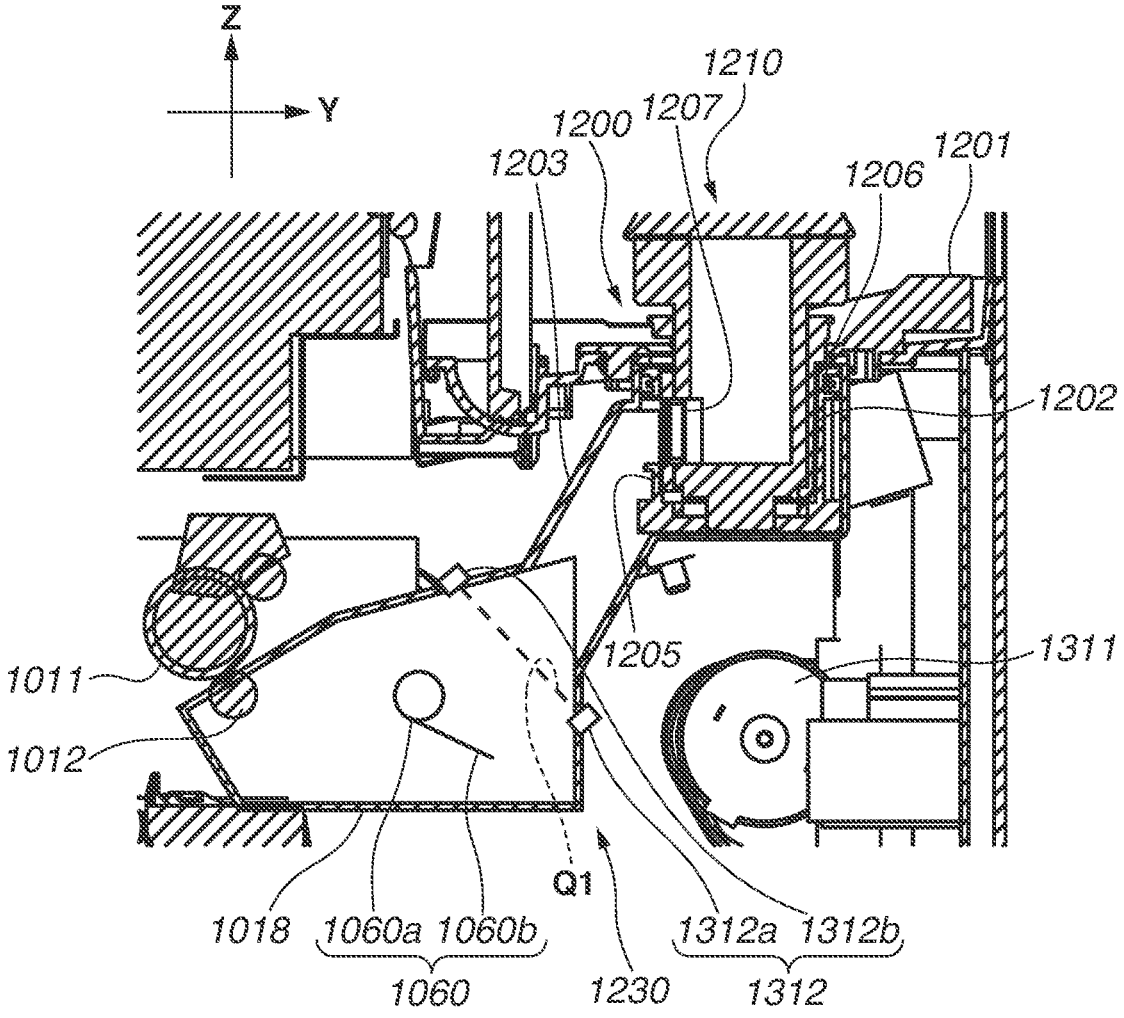
FIG. 20 is a sectional view illustrating a supply portion and the developing container.

As illustrated in FIG. 20, a supply pack 1210 described below is attached to the supply portion 1200, and toner discharged from the supply pack 1210 is supplied to the storing portion 1018 via an opening 1207 of the main body shutter portion 1206, the side surface opening 1205 of the toner receiving portion 1202, and the supply path portion 1203.

As illustrated in FIG. 19, the supply path portion 1203 is connected to one end side of the storing portion 1018 in the longitudinal direction of the developing container 1230, i.e., in the X-direction. As illustrated in FIG. 20, an agitation member 1060, which rotates around a rotational shaft 1060*a* extending in the X-direction, is provided inside the storing portion 1018. The agitation member 1060 includes a blade portion 1060*b* fixed to the rotational shaft 1060*a*, and is configured to be driven to rotate by a drive motor 1311 serving as a drive source, thus agitating toner inside the storing portion 1018 and also conveying toner toward the developing roller 1012. Furthermore, while, in the third exemplary embodiment, the agitation member 1060 is configured with the rotational shaft 1060*a* and the blade portion 1060*b*, a helicoidally shaped agitation member can be used as a configuration capable of covering the entire length of the storing portion 1018 with toner.

Moreover, the agitation member 1060 has the role of circulating, inside the storing portion 1018, toner torn off from the developing roller 1012 without being used for developing, thus making toner inside the storing portion 1018 even. Furthermore, the agitation member 1060 is not limited to a rotary configuration. For example, an agitation member having a vibratory configuration can be employed. Moreover, in addition to the agitation member 1060, a different agitation member can be further provided.

Moreover, the storing portion 1018 is provided with a remaining amount detection portion 1312 serving as a sensor for detecting the amount of toner stored in the storing portion 1018, and the remaining amount detection portion 1312 includes a light emitting portion 1312*a* and a light receiving portion 1312*b*. Light emitted from the light emitting portion 1312*a* passes through the inside of the storing portion 1018 and is then received by the light receiving portion 1312*b*. Thus, the light emitting portion 1312*a* and the light receiving portion 1312*b* form an optical path Q1 inside the storing portion 1018. Furthermore, with regard to the light emitting portion 1312*a* and the light receiving portion 1312*b*, each of a light emitting element and a light receiving element can be arranged inside the storing portion 1018, or each of a light emitting element and a light receiving element can be arranged outside the storing portion 1018 and light can be guided to the inside and outside of the storing portion 1018 by a light guide portion.

Additionally, the light emitting portion 1312*a* and the light receiving portion 1312*b* are provided at a middle portion of the storing portion 1018 in the X-direction. Providing the light emitting portion 1312*a* and the light receiving portion 1312*b* at a middle portion of the storing portion 1018 enables adequately detecting the remaining amount of toner stored in the storing portion 1018. Thus, while, at an end portion in the X-direction of the storing portion 1018, a developer (toner) may be unevenly distributed, since such uneven distribution is small in a middle portion of the storing portion 1018, it is possible to detect a practical remaining amount of toner.

Furthermore, while, in the third exemplary embodiment, an LED is used as the light emitting portion 1312*a* and a phototransistor, which is turned on by light received from the LED, is used as the light receiving portion 1312*b*, the third exemplary embodiment is not limited to this. For example, a halogen lamp or a fluorescent lamp can be used as the light emitting portion 1312*a* and a photodiode or an avalanche photodiode can be used as the light receiving portion 1312*b*.

The light receiving portion 1312*b*, which is a phototransistor, receives light emitted from the light emitting portion 1312*a* and outputs a signal (current) corresponding to the amount of received light. In other words, the light receiving portion 1312*b* of the remaining amount detection portion 1312 outputs a signal with an intensity corresponding to the remaining amount of toner stored in the storing portion 1018.

Figure 37:
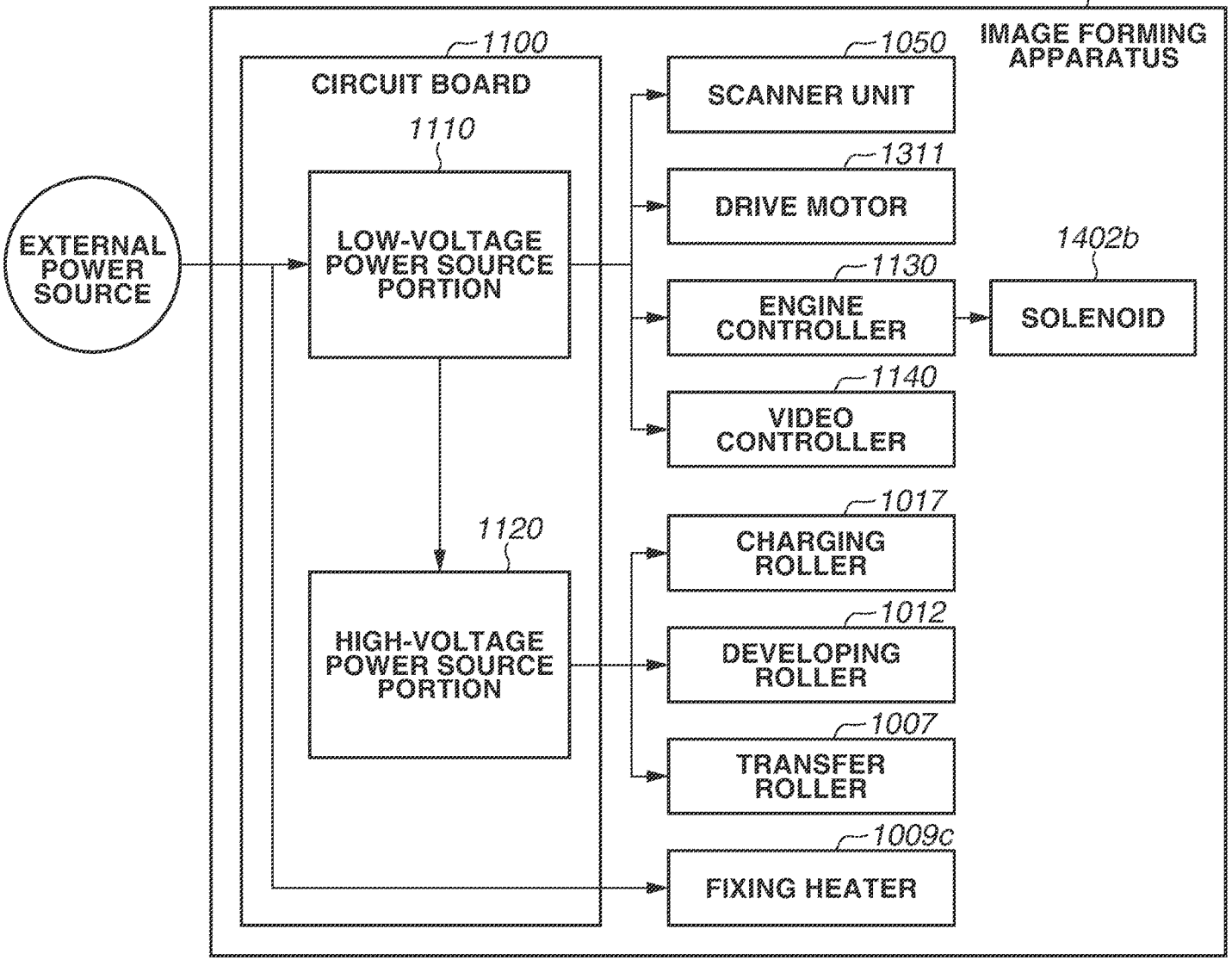
FIG. 37 is a block diagram used to explain functions of a power source circuit board.

This output signal is converted into a voltage, which is input to an engine controller 1130 (see FIG. 37). Thus, the light receiving portion 1312*b* changes its output value based on the amount of toner (developer) stored in the storing portion 1018.

The engine controller 1130 determines whether the light receiving portion 1312*b* has received light from the light emitting portion 1312*a*, based on the input voltage level. The engine controller 1130 calculates the amount of toner (amount of developer) stored in the storing portion 1018, based on a length of time in which the light receiving portion 1312*b* has detected light after toner stored in the storing portion 1018 is agitated by the agitation member 1060 for a predetermined time. Specifically, a read-only memory (ROM) of the engine controller 1130 previously stores a table capable of outputting the remaining amount of toner based on the light receiving time obtained after toner is agitated by the agitation member 1060, and the engine controller 1130 estimates or calculates the remaining amount of toner based on the stored table.

When the remaining amount of toner is large, since the optical path Q1 is likely to be blocked by toner, the time in which the light receiving portion 1312*b* is receiving light becomes short. On the other hand, when the remaining amount of toner is small, conversely, the time in which the light receiving portion 1312*b* is receiving light becomes long. Accordingly, the engine controller 1130 is able to determine the level of the remaining amount of toner stored in the storing portion 1018, based on the light receiving time of the light receiving portion 1312*b* obtained in this way.

Furthermore, the method of detecting or estimating the remaining amount of toner is not limited to the above-mentioned method, and various known methods of detecting or estimating the remaining amount of toner can be employed. For example, two or more metallic plates or conductive resin sheets extending in the longitudinal direction of the developing roller can be arranged at an inner wall of the storing portion 1018 and the remaining amount of toner can be detected or estimated by measuring an electrostatic capacitance between the two metallic plates or conductive resin sheets. Alternatively, a load cell can be used in the form of supporting the developing container 1230 from below and the remaining amount of toner can be calculated based on a weight measured by the load cell.

<Supply Portion>

Figure 21A:
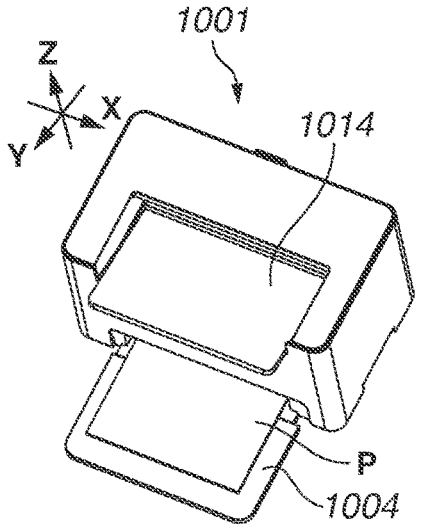
FIG. 21A is a perspective view illustrating the image forming apparatus in a state in which a discharge tray has been closed.
Figure 21B:
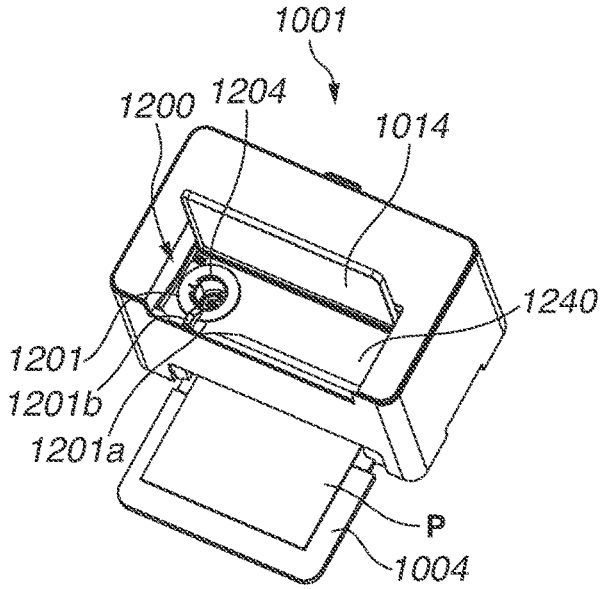
FIG. 21B is a perspective view illustrating the image forming apparatus in a state in which the discharge tray has been opened.
Figure 21C:
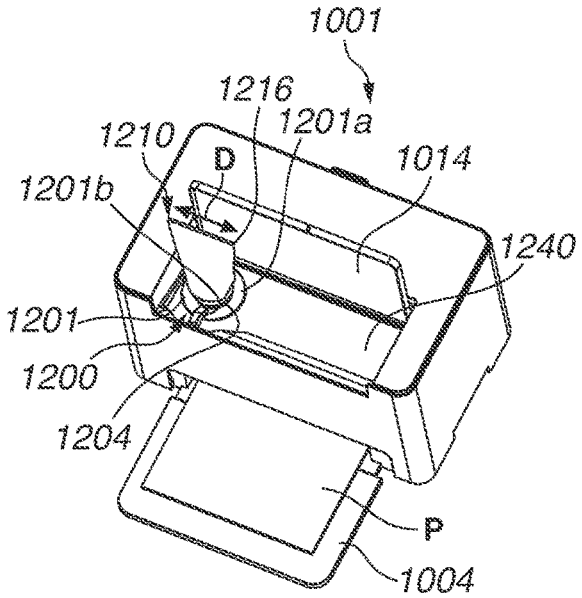
FIG. 21C is a perspective view illustrating the image forming apparatus in a state in which a supply pack has been attached to the supply portion.

Next, the supply portion 1200 is described. The discharge tray 1014, which serves as a lid portion, is supported to be openable and closable between a closed position at which the discharge tray 1014 allows a recording material P to be stacked thereon as illustrated in FIG. 21A and an opened position at which the discharge tray 1014 is opened with respect to the apparatus main body of the image forming apparatus 1001 as illustrated in FIG. 21B. The discharge tray 1014 when in the closed position covers the supply portion 1200. In other words, the discharge tray 1014 when in the closed position covers the operation portion 1201 described below. When the discharge tray 1014 is opened to the opened position, a top surface portion 1240 and the supply portion 1200, which is arranged on the top surface portion 1240, become exposed. The supply portion 1200 is configured to allow the supply pack 1210 to be detachably attached thereto as illustrated in FIG. 21C, and is thus configured to allow the user or service engineer to supply toner from the outside without removing the developing container 1230 from the housing 1072. The developing container 1230 serves as a receiving unit (supporting unit or reception unit) which receives the supply pack 1210. The receiving unit includes the toner receiving portion 1202.

Figure 22A:
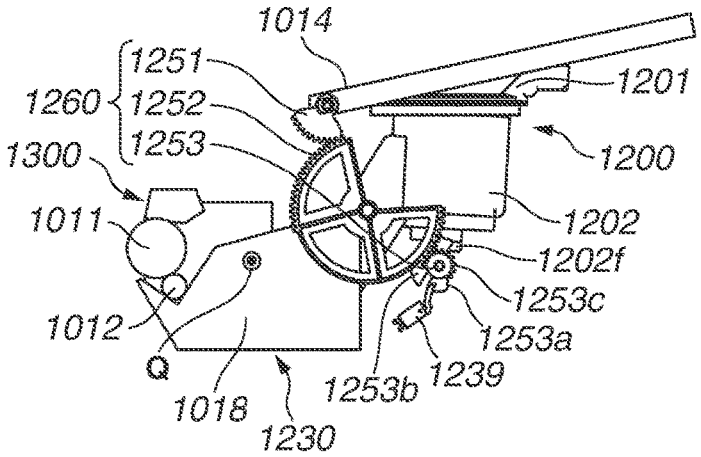
FIG. 22A is a partial schematic view illustrating the supply portion in a state in which the discharge tray has been closed.
Figure 22B:
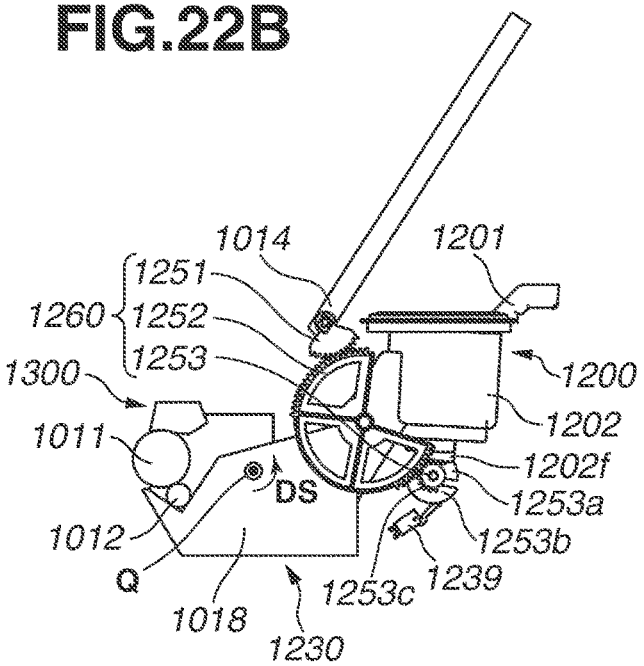
FIG. 22B is a partial schematic view illustrating the supply portion in a state in which the discharge tray has been partially opened.
Figure 22C:
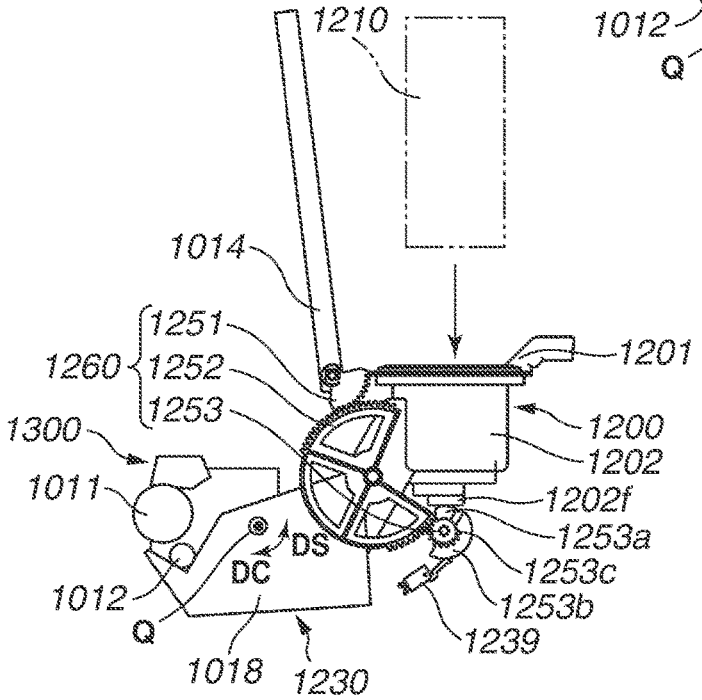
FIG. 22C is a partial schematic view illustrating the supply portion in a state in which the discharge tray has been opened.

A supporting unit 1260 and a discharge tray opening and closing detection sensor 1239, which operate in conjunction with opening and closing of the discharge tray 1014, are described with reference to FIGS. 22A, 22B, and 22C. FIG. 22A is a side view illustrating the supporting unit 1260 when the discharge tray 1014 is positioned at the closed position. FIG. 22B is a side view illustrating the manner in which a first cam portion 1253*a* of a supporting member 1253 has come into contact with the developing container 1230. FIG. 22C is a side view illustrating the supporting unit 1260 when the discharge tray 1014 is positioned at the opened position. Each of FIGS. 22A, 22B, and 22C is a side view as viewed along the direction of a rotational axis of the photosensitive drum 1011.

As illustrated in FIGS. 22A to 22C, the supporting unit 1260 includes a tray gear 1251, an idler gear 1252, and a supporting member 1253. The tray gear 1251 and the idler gear 1252 serve as an interlock portion which interlocks the discharge tray 1014 and the supporting member 1253 in such a manner that the discharge tray 1014 and the supporting member 1253 operate in conjunction with each other.

The supply pack 1210 is attached to the toner receiving portion 1202 from above in the vertical direction. The supporting member 1253 supports the toner receiving portion 1202 from below in the vertical direction. The supporting member 1253 is located below the toner receiving portion 1202 in the vertical direction. The supporting member 1253 includes a first cam portion 1253*a*, which serves as a supporting portion for supporting the developing container 1230, and a gear portion 1253*c*, which is meshed with the idler gear 1252.

The tray gear 1251 is fixed to the discharge tray 1014 and turns in conjunction with opening and closing of the discharge tray 1014. The tray gear 1251 is engaged with a shaft provided at the turning center of the discharge tray 1014. The supporting member 1253 is interlocked with the tray gear 1251 via the idler gear 1252.

The supporting member 1253 is configured to be movable between a supporting position, in which the supporting member 1253 supports the developing container 1230 with the first cam portion 1253*a* coming into contact with the developing container 1230, and a receding position, in which the supporting member 1253 has receded from the supporting position. The supporting member 1253 moves between the supporting position and the receding position in conjunction with the movement of the discharge tray 1014. A state in which the supporting member 1253 is positioned at the supporting position is referred to a "supporting state of the supporting member 1253 and the supporting unit 1260". A state in which the supporting member 1253 is positioned at the receding position is referred to as a "receding state of the supporting member 1253 and the supporting unit 1260".

When the discharge tray 1014 is positioned at the opened position, the supporting member 1253 and the supporting unit 1260 are in the supporting state and the supporting member 1253 is positioned at the supporting position. When the discharge tray 1014 is positioned at the closed position, the supporting member 1253 and the supporting unit 1260 are in the receding state and the supporting member 1253 is positioned at the receding position.

When the supporting member 1253 is positioned at the supporting position, the supporting member 1253 is able to support the developing container 1230. In this state, the developing roller 1012 is away from the photosensitive drum 1011.

When the supporting member 1253 is positioned at the receding position, the first cam portion 1253*a* of the supporting member 1253 is away from the developing container 1230. Moreover, the developing roller 1012 is positioned at a position where the developing roller 1012 is able to develop an electrostatic latent image formed on the photosensitive drum 1011 (in the third exemplary embodiment, a position in which the developing roller 1012 is in abutting contact with the photosensitive drum 1011). Furthermore, in a case where an electrostatic latent image is able to be developed by the developing roller 1012, in a state in which the supporting member 1253 is positioned at the receding position, the supporting member 1253 and the developing container 1230 can be in abutting contact with each other.

The engine controller 1130 (see FIG. 37) of the image forming apparatus 1001 allows an image forming operation to be performed in a state in which the supporting member 1253 is positioned at the receding position. The engine controller 1130 restricts an image forming operation from being performed in a state in which the supporting member 1253 is positioned at the supporting position.

In other words, the engine controller 1130 allows an image forming operation to be performed in a state in which the discharge tray 1014 is positioned at the closed position. Moreover, the engine controller 1130 restricts an image forming operation from being performed in a state in which the discharge tray 1014 is positioned at the opened position.

The image forming apparatus 1001 includes the discharge tray opening and closing detection sensor 1239, which outputs a signal corresponding to the position of the supporting member 1253 or the discharge tray 1014. The engine controller 1130 is configured to allow or restrict execution of an image forming operation based on an output (signal) of the discharge tray opening and closing detection sensor 1239. Furthermore, while, in the third exemplary embodiment, the discharge tray opening and closing detection sensor 1239 outputs a signal corresponding to the position of the supporting member 1253, the third exemplary embodiment is not limited to this. Since the discharge tray 1014 and the supporting member 1253 operate in conjunction with each other, the discharge tray opening and closing detection sensor 1239 only needs to be configured to output a signal corresponding to the position of at least any one of the supporting member 1253 and the discharge tray 1014. Thus, the discharge tray opening and closing detection sensor 1239, which serves as a detection portion, is able to, by detecting the position of any one of the discharge tray 1014 and the supporting member 1253, detect the position of the other of the discharge tray 1014 and the supporting member 1253.

As described below, a portion (detection target) to be detected by the discharge tray opening and closing detection sensor 1239 is included in the supporting member 1253. However the position of the portion to be detected by the discharge tray opening and closing detection sensor 1239 is not limited to this. For example, the portion to be detected can be arranged in a part of the supporting unit 1260 or in the discharge tray 1014.

The discharge tray opening and closing detection sensor 1239 is a sensor configured to enter into an on-state when the discharge tray 1014 is opened and enter into an off-state when the discharge tray 1014 is closed. The discharge tray opening and closing detection sensor 1239, which is a microswitch-type contact sensor, enters into an on-state by coming into contact with a second cam portion 1253*b* provided at the supporting member 1253 and enters into an off-state by moving away from the second cam portion 1253*b*.

Furthermore, besides a sensor of the type which comes into contact with a detection target, the discharge tray opening and closing detection sensor 1239 can be a sensor of the type which does not come into contact with a detection target, such as a photoelectric sensor.

The toner receiving portion 1202 includes a portion to be supported 1202*f*. As mentioned above, when the discharge tray 1014 is in the closed state, the first cam portion 1253*a* of the supporting member 1253 is in the state of being away from the portion to be supported 1202*f* of the developing container 1230 (see FIG. 22A). A this time, the developing container 1230 is positioned at a unit abutting contact position in which the developing roller 1012 is in abutting contact with the photosensitive drum 1011. Since the first cam portion 1253*a* is away from the portion to be supported 1202*f*, the photosensitive drum 1011 and the developing roller 1012 have come into abutting contact with each other in a stable manner, so that the developing roller 1012 has entered into a state of being able to develop an electrostatic latent image.

As illustrated in FIG. 22A, when the discharge tray 1014 is positioned at the closed position and the supporting member 1253 is positioned at the receding position, the discharge tray opening and closing detection sensor 1239 and the second cam portion 1253*b* are away from each other. At this time, the state of a signal output from the discharge tray opening and closing detection sensor 1239 is an off-state. At this time, the engine controller 1130 allows an image forming operation to be performed.

As illustrated in FIG. 22C, when the discharge tray 1014 is positioned at the opened position and the supporting member 1253 is positioned at the supporting position, the discharge tray opening and closing detection sensor 1239 is in contact with the second cam portion 1253*b*. At this time, the state of a signal output from the discharge tray opening and closing detection sensor 1239 is an on-state different from the off-state. At this time, the engine controller 1130 restricts an image forming operation from being performed. Thus, the engine controller 1130 is able to control the image forming apparatus 1001 in such a way as to prevent the image forming apparatus 1001 from starting an image forming operation in a state in which the discharge tray opening and closing detection sensor 1239 is in an on-state.

An angle between the discharge tray 1014 opened from the closed state and the discharge tray 1014 positioned at the closed position is referred to as an "opening angle of the discharge tray 1014". In the third exemplary embodiment, for example, when the discharge tray 1014 is positioned at the closed position as illustrated in FIG. 22A, the opening angle of the discharge tray 1014 is defined as 0 degrees.

Then, as the discharge tray 1014 is progressively opened from the closed position to the opened position, the opening angle gradually increases. As illustrated in FIG. 22B, when the opening angle of the discharge tray 1014 has become a predetermined angle (in the third exemplary embodiment, 45°), the first cam portion 1253*a* of the supporting member 1253 comes into contact with the developing container 1230. Thus, supporting of the developing container 1230 by the supporting member 1253 is started, so that the developing container 1230 begins to move with respect to a photosensitive unit 1300.

The developing container 1230 is coupled to the photosensitive unit 1300 via a turning shaft Q, and the developing container 1230 is turnable around the turning shaft Q. The developing container 1230 is pushed and moved by the first cam portion 1253*a* in a direction DS in which the developing roller 1012 moves away from the photosensitive drum 1011.

Furthermore, in a case where the opening angle of the discharge tray 1014 is less than 45°, the supporting member 1253 does not support the developing container 1230, so that the photosensitive drum 1011 and the developing roller 1012 can maintain an abutting contact state. Therefore, even if the discharge tray 1014 is opened by, for example, an operation of the user removing a recording material P or a vibration, as long as the opening angle of the discharge tray 1014 is less than 45°, the photosensitive drum 1011 and the developing roller 1012 are able to maintain an abutting contact state.

On the other hand, a position of the discharge tray 1014 obtained when the state of a signal output from the discharge tray opening and closing detection sensor 1239 switches between an off-state and an on-state is referred to as an "intermediate position of the discharge tray 1014". Thus, when the discharge tray 1014 is positioned at an intermediate position between the closed position and the opened position, the state of a signal output from the discharge tray opening and closing detection sensor 1239 switches from an off-state to an on-state.

The second cam portion 1253*b* is configured to come into contact with the discharge tray opening and closing detection sensor 1239 in a state in which the opening angle of the discharge tray 1014 is less than 45°, so that the discharge tray opening and closing detection sensor 1239 switches from an off-state to an on-state. Thus, when the discharge tray 1014 is positioned at the intermediate position, the opening angle of the discharge tray 1014 is less than 45° and the developing roller 1012 is in the state of being in abutting contact with the photosensitive drum 1011. When the discharge tray 1014 moves from the closed position to the opened position, after the state of a signal output from the discharge tray opening and closing detection sensor 1239 switches from an off-state to an on-state, the developing roller 1012 moves away from the photosensitive drum 1011.

As a result, the engine controller 1130 is able to detect movement of the discharge tray 1014 and the supporting member 1253, before the developing roller 1012 moves away from the photosensitive drum 1011, based on the state of a signal output from the discharge tray opening and closing detection sensor 1239. Since the engine controller 1130 restricts an image forming operation from being performed when the discharge tray opening and closing detection sensor 1239 is in an on-state, an image forming operation in a state in which the supporting member 1253 is supporting the developing container 1230 is restricted until the opening angle of the discharge tray 1014 becomes 45° from when the discharge tray 1014 is positioned at the intermediate position. Moreover, when the opening angle of the discharge tray 1014 is larger than or equal to 45°, an image forming operation in a state in which the photosensitive drum 1011 and the developing roller 1012 are away from each other is restricted.

Furthermore, an opening angle at which supporting of the developing container 1230 by the supporting member 1253 is started (supporting start angle) is not limited to 45°, and the supporting start angle can be larger than 45° or can be smaller than 45°. To continue an image forming operation even when the discharge tray 1014 moves to some degree, it is favorable that the supporting start angle is larger than 10° and it is more favorable that the supporting start angle is larger than 30°.

Moreover, when the discharge tray 1014 is positioned at the intermediate position, which is a switching point of the state of the discharge tray opening and closing detection sensor 1239, due to being blocked by the discharge tray 1014, it is impossible for the user to attach the supply pack 1210. Thus, in a state in which the supply pack 1210 is able to be attached, a signal output from the discharge tray opening and closing detection sensor 1239 necessarily enters into an on-state.

As illustrated in FIG. 22C, when the opening angle of the discharge tray 1014 becomes a predetermined angle (in the third exemplary embodiment, 75°), the supply portion 1200 becomes exposed, and the first cam portion 1253*a* included in the supporting member 1253 enters into a state of supporting the developing container 1230.

Furthermore, the opening angle of the discharge tray 1014 obtained when the discharge tray 1014 is positioned at the opened position is not limited to 75°, but can be larger than 75° or can be smaller than 75°. It is favorable that an opening angle according to which, when the discharge tray 1014 is positioned at the opened position, the discharge tray 1014 is kept at the opened position in a state in which no external force is acting is employed.

When the discharge tray 1014 is opened (when the discharge tray 1014 is positioned at the opened position), the supporting member 1253 is positioned at the supporting position and the developing container 1230 is positioned at the unit receding position, which recedes from the unit abutting contact position. At this time, the developing roller 1012 is away from the photosensitive drum 1011. Moreover, at this time, the toner receiving portion 1202 engages with the operation portion 1201, so that the user can attach the supply pack 1210 to the supply portion 1200 to supply toner.

When the user attaches the supply pack 1210 to the toner receiving portion 1202, the developing container 1230 receives force in a direction in which the developing roller 1012 comes close to the photosensitive drum 1011. At this time, supporting the developing container 1230 by the supporting member 1253 enables stabilizing the orientation of the developing container 1230 and attaching the supply pack 1210 in a stable manner. Moreover, this enables preventing or reducing the developing roller 1012 from being forced against the photosensitive drum 1011 when the user attaches the supply pack 1210.

Figure 21D:
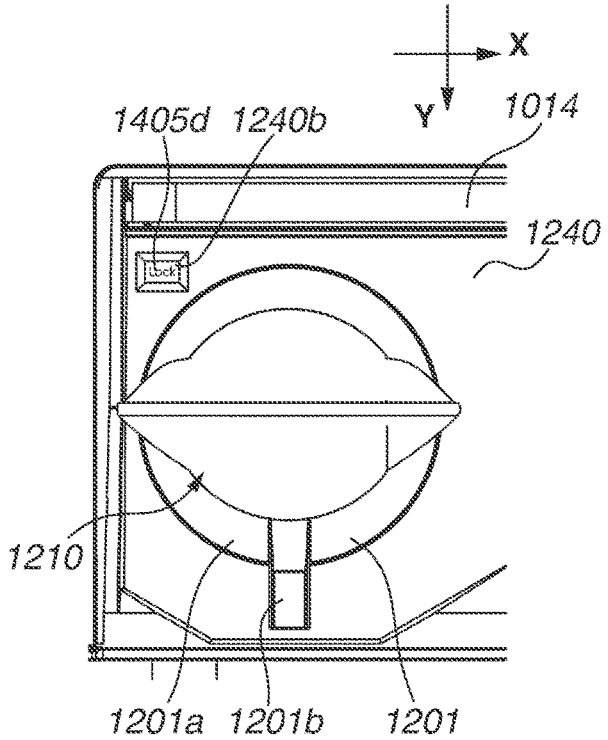
FIG. 21D is a plan view illustrating a state in which the supply pack has been attached to the supply portion.

As illustrated in FIGS. 21B to 21D, the operation portion 1201, which serves as an operation member, is arranged on the top surface portion 1240, and there is formed a supply port 1204, which is a reception port for supplying toner.

With regard to the X-direction, the width of the supply port 1204 is smaller than the width of the storing portion 1018. Moreover, the operation portion 1201 is provided in such a way as to surround the supply port 1204, and includes a ring portion 1201*a*, which is rotatably supported by the top surface portion 1240 or the toner receiving portion 1202, and a lever portion 1201*b*, which is provided integrally with the ring portion 1201*a*. The operation portion 1201 is a member for externally operating opening and closing of the main body shutter portion 1206 and a pack shutter portion 1214.

Figure 23A:
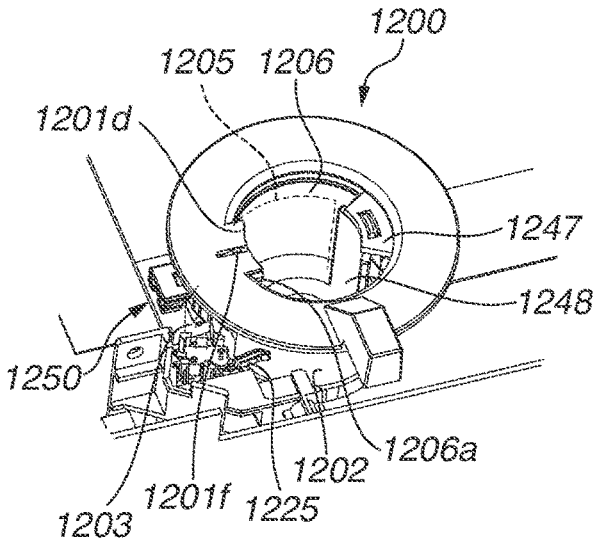
FIG. 23A is a perspective view illustrating the supply portion.
Figure 23B:
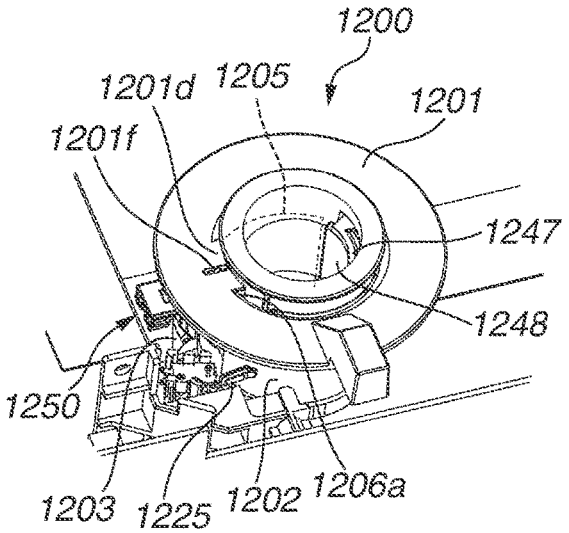
FIG. 23B is a perspective view illustrating parts of the supply portion and the supply pack.

As illustrated in FIG. 23A, the toner receiving portion 1202 is provided with guide portions 1247 and 1248, which are arranged on the inner side of the main body shutter portion 1206 and are integrated with the toner receiving portion 1202. The main body shutter portion 1206 is a cylindrically shaped member coaxial with the toner receiving portion 1202, and is provided in a rotatable manner on the inner side of the toner receiving portion 1202. The main body shutter portion 1206 includes an opening 1207 (see FIG. 23C), and, in the closed position illustrated in FIG. 23A, the opening 1207 and the side surface opening 1205 of the toner receiving portion 1202 are out of alignment with each other. A seal member 1243 is fixed to the main body shutter portion 1206 in such a way as to surround the peripheral border portion of the opening 1207.

Furthermore, the side surface opening 1205 is covered by the main body shutter portion 1206 positioned at the closed position, and is, therefore, illustrated by dashed line in FIG. 23A. Therefore, the side surface opening 1205 is shielded by the main body shutter portion 1206, so that toner is not discharged to the supply path portion 1203. When the supply pack 1210 is not attached, the operation portion 1201 is restricted from moving in a rotational direction by a first lock mechanism 1250 described below. The first lock mechanism 1250 enables preventing the supply pack 1210 from becoming unable to be attached due to an operation portion drive transmission projection 1201*d* and a main body shutter portion drive transmission projection 1206*a* becoming out of phase before the supply pack 1210 is attached.

Figure 23C:
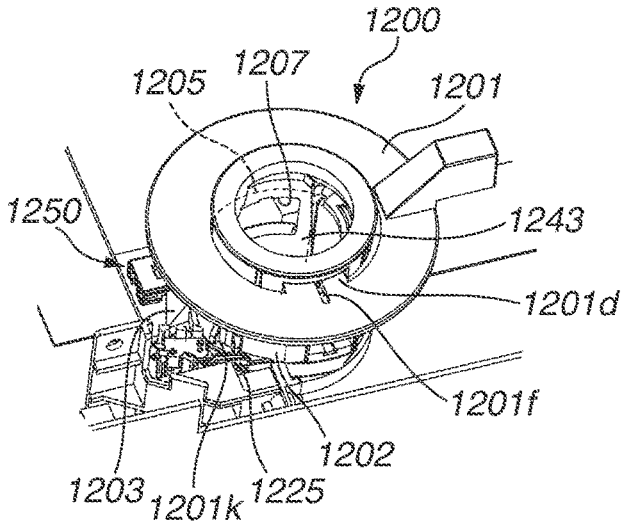
FIG. 23C is a perspective view illustrating the supply portion when an operation portion is positioned at a supplying position.
Figure 23C:
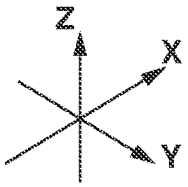

Moreover, when the main body shutter portion 1206 is positioned at the opened position illustrated in FIG. 23C, the opening 1207 overlaps the side surface opening 1205 of the toner receiving portion 1202. Therefore, toner supplied from the supply pack 1210 (see FIG. 21C) attached to the supply portion 1200 becomes able to be discharged to the supply path portion 1203 through the side surface opening 1205 and the opening 1207.

The main body shutter portion 1206 is provided with the main body shutter portion drive transmission projection 1206*a*, and, although details are described below, the main body shutter portion drive transmission projection 1206*a* is used to receive drive force from the supply pack 1210 and turn the main body shutter portion 1206. In response to the operation portion 1201 being operated to rotate in a state in which the supply pack 1210 is attached to the supply portion 1200, the main body shutter portion 1206 moves between the closed position and the opened position.

The operation portion 1201 is provided with the operation portion drive transmission projection 1201*d*, which projects to the inner side in the radial direction than the inner circumferential surface of the toner receiving portion 1202. The operation portion drive transmission projection 1201*d* is engaged with the main body shutter portion drive transmission projection 1206*a* via a pair of drive transmission surfaces 1214*b* (see FIG. 25B) of the pack shutter portion 1214 of the supply pack 1210. The main body shutter portion drive transmission projection 1206*a* is provided with an unlocking recessed portion 1201*f* described below. The main body shutter portion 1206 moves from the closed position illustrated in FIG. 23A to the opened position illustrated in FIG. 23C in response to the lever portion 1201*b* of the operation portion 1201 being rotated 90 degrees counter-clockwise by the user.

In performing image formation on a recording material P, toner is agitated inside the storing portion 1018 by the agitation member 1060 (see FIG. 20) and, thus, the side surface opening 1205 needs to be blocked by the main body shutter portion 1206 so as to prevent toner from leaking from the side surface opening 1205. Accordingly, during image formation, the operation portion 1201 is positioned at the operating position illustrated in FIG. 23A in such a manner that the main body shutter portion 1206 is positioned at the closed position. On the other hand, in supplying toner from the supply pack 1210 described below to the storing portion 1018, the side surface opening 1205 needs to be opened. Accordingly, during toner supply, the operation portion 1201 is positioned at the supplying position illustrated in FIG. 23C in such a manner that the main body shutter portion 1206 is positioned at the opened position.

Figure 24A:
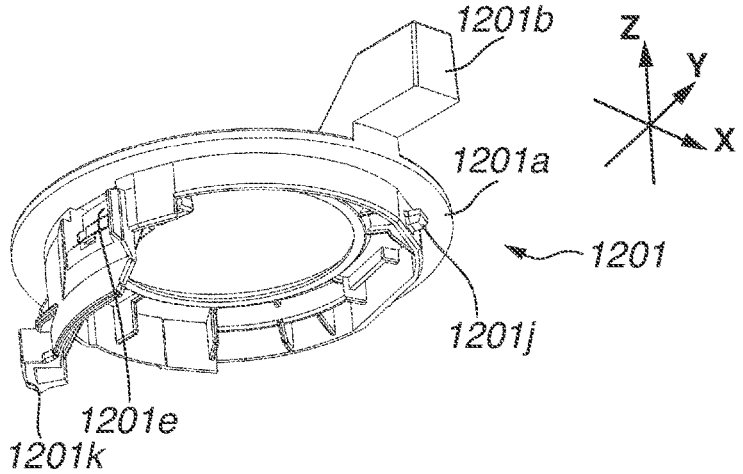
FIG. 24A is a perspective view illustrating the operation portion.

Moreover, as illustrated in FIG. 24A, the operation portion 1201 is provided with a detection target rib portion 1201*k* serving as a portion to be detected. In the vicinity of the operation portion 1201, there is provided an operation portion opening and closing detection sensor 1225 (see FIG. 23A) serving as a first detection unit which detects that the operation portion 1201 has turned to the supplying position when the user has gripped the lever portion 1201*b* and has rotated the operation portion 1201 to the supplying position. The operation portion opening and closing detection sensor 1225 is a contact-type sensor which, when coming into contact with the detection target rib portion 1201*k*, transmits an ON signal as a detection signal to the engine controller 1130.

The operation portion opening and closing detection sensor 1225 enters into an off-state when the operation portion 1201 is positioned at the operating position as illustrated in FIG. 23A, and enters into an on-state when the operation portion 1201 is positioned at the supplying position as illustrated in FIG. 23C. Furthermore, the operation portion opening and closing detection sensor 1225 can be a non-contact-type sensor such as a photoelectric sensor.

Figure 24B:
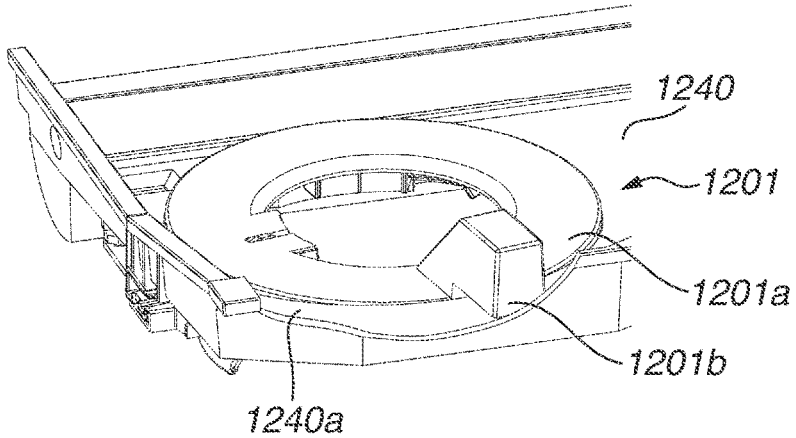
FIG. 24B is a perspective view illustrating the operation portion and a top surface portion.

As illustrated in FIG. 24B, the operation portion 1201 is supported in a rotatable manner by a supporting portion 1240*a* of the top surface portion 1240. As illustrated in FIG. 24A, the operation portion 1201 includes a retainer 1201*j*, the above-mentioned detection target rib portion 1201*k*, and an opening portion 1201*e*. With regard to the rotational direction of the operation portion 1201, the retainer 1201*j* is arranged at roughly the same position as the lever portion 1201*b* and the detection target rib portion 1201*k* is arranged at a position different from that of the retainer 1201*j*. The opening portion 1201*e* is configured to allow a lever lock pressing portion 1227*a* of a lever lock member 1227 described below to be inserted thereinto. In response to the lever lock pressing portion 1227*a* being inserted into the opening portion 1201*e*, the operation portion 1201 is fixed at the operating position and is restricted from rotation.

Figure 24C:
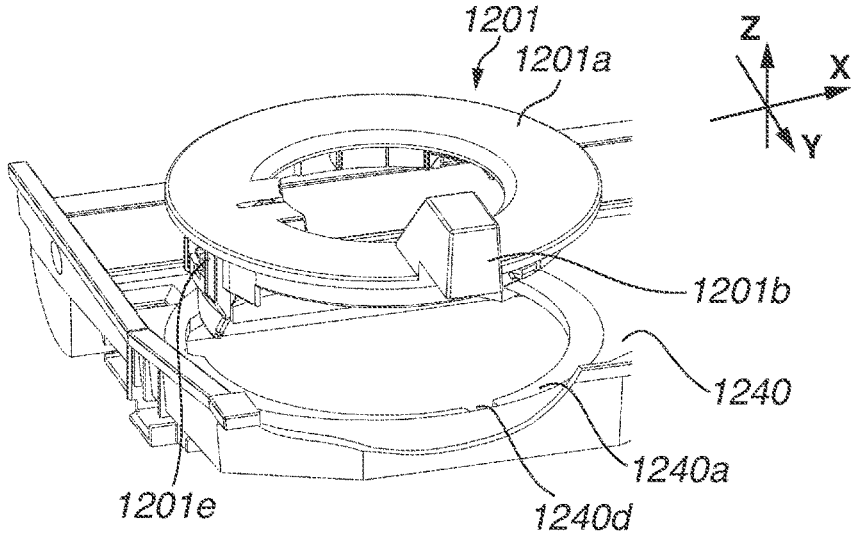
FIG. 24C is a perspective view illustrating the manner of attaching the operation portion to the top surface portion.

As illustrated in FIG. 24C, the operation portion 1201 is attached to the supporting portion 1240*a* with the retainer 1201*j* adjusted in position to a groove portion 1240*d* provided at the supporting portion 1240*a*. Furthermore, when the operation portion 1201 is positioned at the operating position or the supplying position, the retainer 1201*j* and the groove portion 1240*d* are positioned at positions which do not overlap each other as viewed in the rotational axis direction of the operation portion 1201. Additionally, in a range in which the operation portion 1201 turns between the operating position and the supplying position, the retainer 1201*j* and the groove portion 1240*d* do not overlap each other as viewed in the rotational axis direction of the operation portion 1201. Thus, when the operation portion 1201 is operated between the operating position and the supplying position, the operation portion 1201 is retained with respect to the supporting portion 1240*a* of the top surface portion 1240.

<Supply Pack>

Figure 25A:
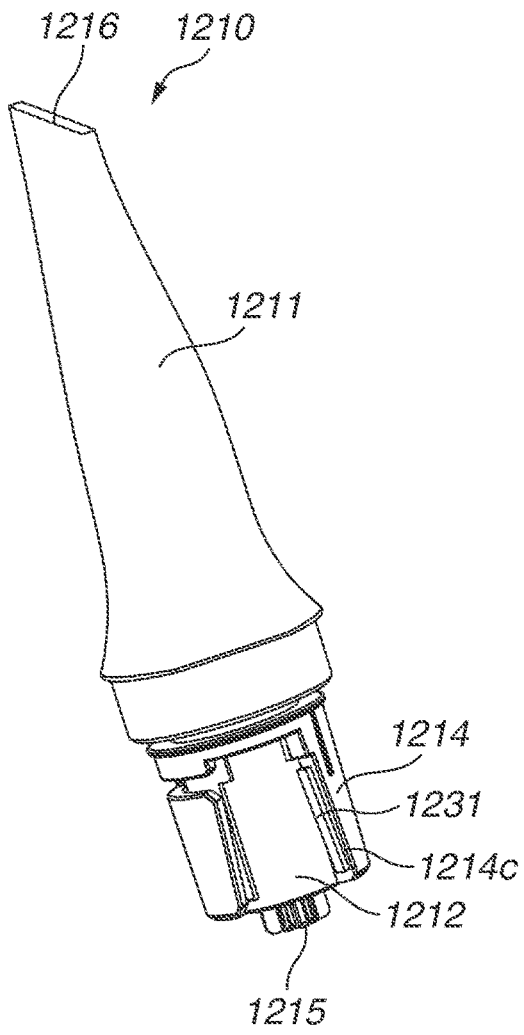
FIG. 25A is a perspective view illustrating the supply pack when a pack shutter portion is positioned at a closed position.
Figure 25B:
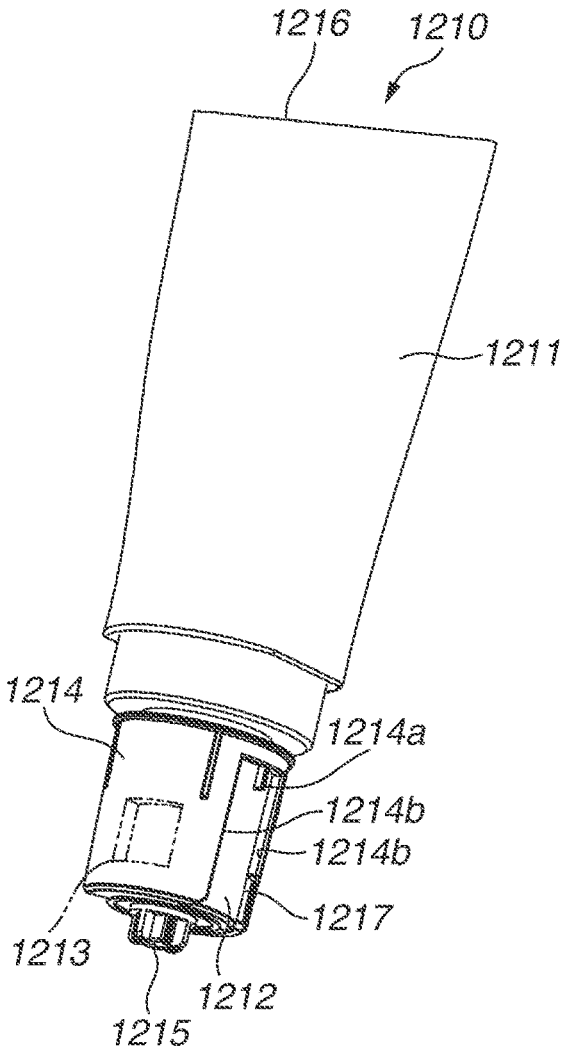
FIG. 25B is another perspective view illustrating the supply pack when the pack shutter portion is positioned at the closed position.
Figure 26A:
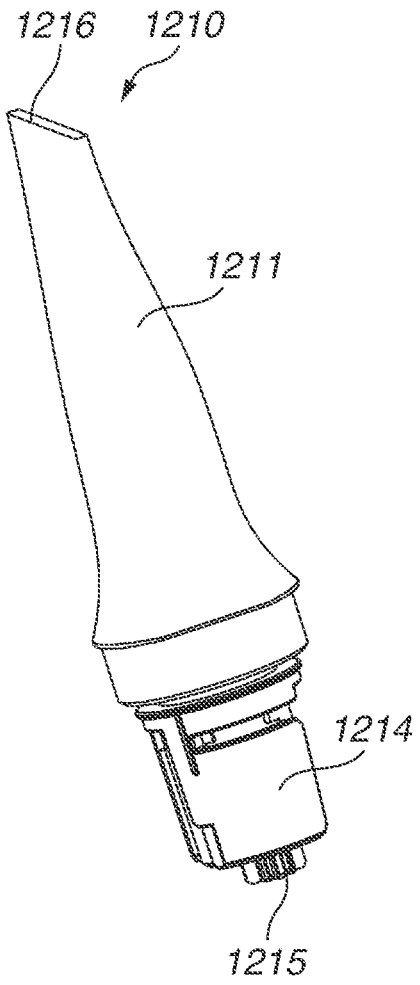
FIG. 26A is a perspective view illustrating the supply pack when the pack shutter portion is positioned at an opened position.
Figure 26B:
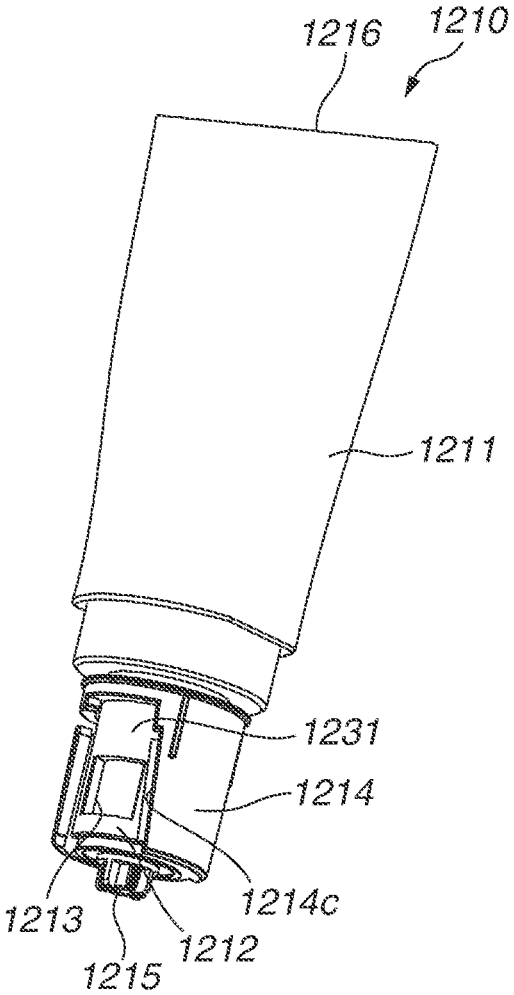
FIG. 26B is another perspective view illustrating the supply pack when the pack shutter portion is positioned at the opened position.
Figure 27A:
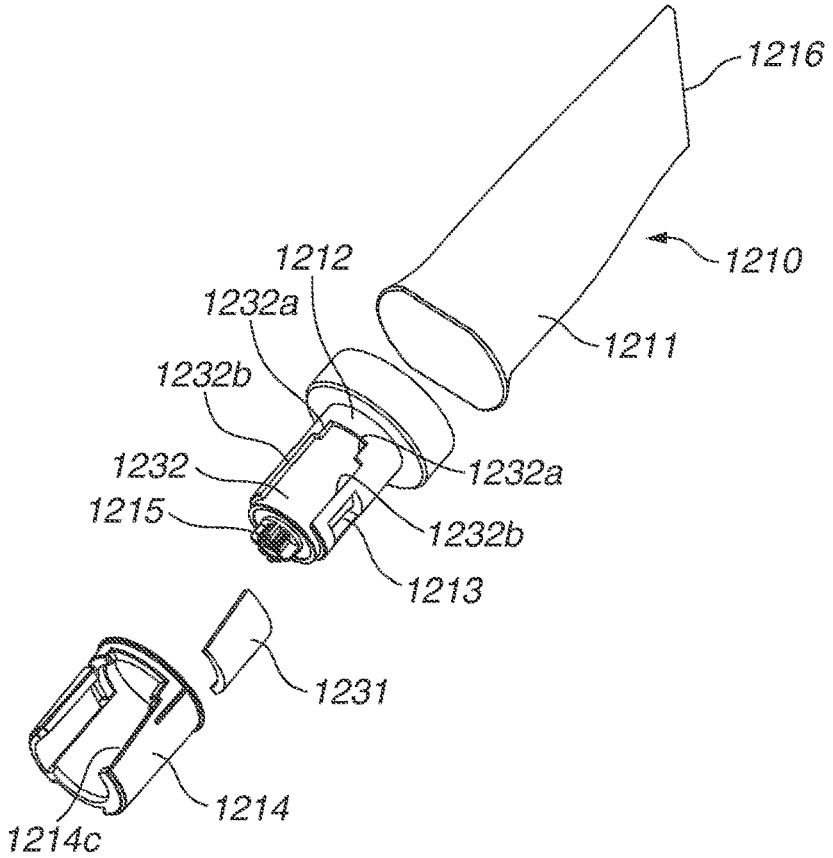
FIG. 27A is an exploded perspective view illustrating the supply pack.
Figure 27B:
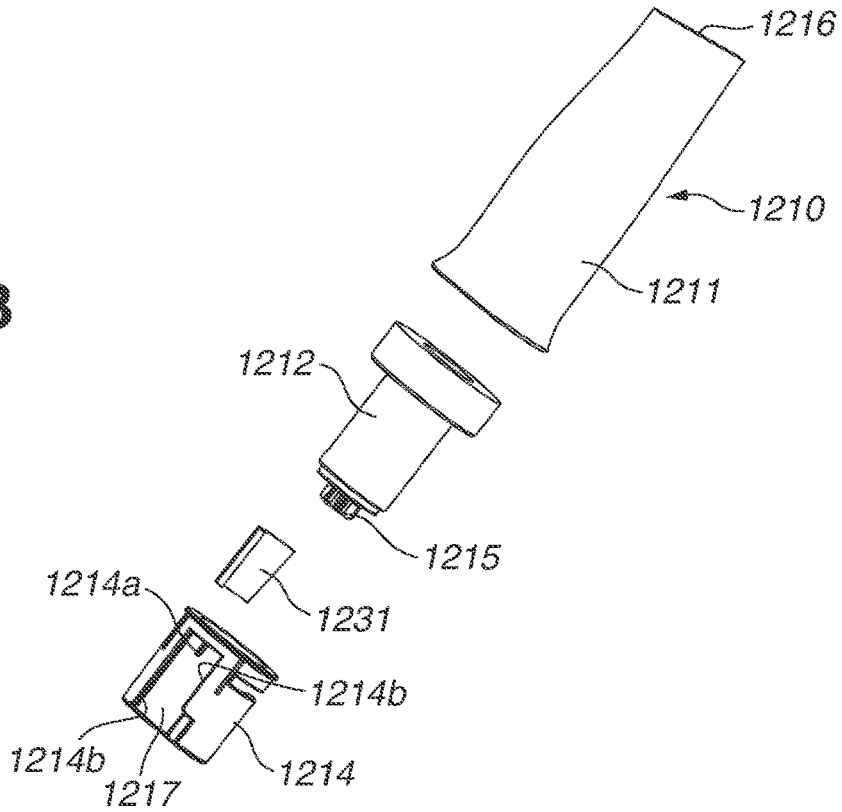
FIG. 27B is another exploded perspective view illustrating the supply pack.

Next, a configuration of the supply pack 1210 is described with reference to FIGS. 25A and 25B to FIGS. 27A and 27B. FIGS. 25A and 25B are perspective views illustrating a supply pack when the pack shutter portion 1214 is positioned at the closed position. FIGS. 26A and 26B are perspective views illustrating the supply pack when the pack shutter portion 1214 is positioned at the opened position. FIGS. 27A and 27B are exploded perspective views illustrating the supply pack.

The supply pack 1210, which serves as a toner container, includes a pouch portion 1211, which serves as a pouch in which toner to be supplied is contained, a cylindrically shaped insertion portion 1212, which is to be inserted into the supply port 1204, and a pack shutter portion 1214, which serves as a container shutter. The insertion portion 1212, which serves as a nozzle portion, communicates with the pouch portion 1211. The insertion portion 1212 has, formed therein, an opening 1213, which serves as an opening portion through which toner contained in the pouch portion 1211 is discharged to the outside. Furthermore, the pouch portion 1211 is configured with a pouch body made from easily deformable plastic, but is not limited to this. For example, the pouch portion 1211 can be configured with a bottle container made from resin or can be configured with a container made from paper or vinyl.

Moreover, the fore-end portion of the insertion portion 1212 is provided with a holding portion 1215, and the pouch portion 1211 has a pouch end portion 1216 formed at an end portion thereof opposite to the insertion portion 1212. The pouch portion 1211 has a shape which becomes flattened as the shape proceeds to the pouch end portion 1216, and the pouch end portion 1216 extends in a radial direction perpendicular to the rotational axis direction of the pack shutter portion 1214.

The pack shutter portion 1214 is a cylindrically shaped member coaxial with the insertion portion 1212 and is provided on the outer side in the radial direction of the insertion portion 1212. The pack shutter portion 1214 has an opening 1214*c*, and is able to, by rotating with respect to the insertion portion 1212, transition to a closed position for shielding the opening 1213 of the insertion portion 1212 or an opened position for opening the opening 1213. When the opening 1214*c* of the pack shutter portion 1214 and the opening 1213 of the insertion portion 1212 overlap each other, it is possible to supply toner from the supply pack 1210 to the supply portion 1200.

Moreover, a seal member 1231, which is able to frictionally slide on the outer circumferential surface of the insertion portion 1212, is fixed to the inner circumferential surface of the pack shutter portion 1214, and, when the pack shutter portion 1214 is positioned at the closed position, the seal member 1231 shields the opening 1213 of the insertion portion 1212.

As illustrated in FIG. 27A, the insertion portion 1212 has, formed therein, a guide target portion 1232 recessed from the outer circumferential surface of the insertion portion 1212, and the guide target portion 1232 includes a pair of first guide target portions 1232*a* and a pair of second guide target portions 1232*b*. When the supply pack 1210 is attached to the supply portion 1200, the guide portions 1247 and 1248, which are integrated with the toner receiving portion 1202, penetrate into the guide target portion 1232. This restricts a relative movement between the insertion portion 1212 and the toner receiving portion 1202 in the circumferential direction around the rotational axis direction of the pack shutter portion 1214.

Moreover, as illustrated in FIG. 27B, on the outer circumferential surface of the pack shutter portion 1214, there are provided a position adjustment portion 1217, which engages with the operation portion 1201, and drive transmission surfaces 1214*b*, which are opposite to each other across the position adjustment portion 1217 in the circumferential direction of the outer circumference of the pack shutter portion 1214. Thus, on the outer circumferential surface of the pack shutter portion 1214, there is formed a groove portion (a recess portion recessed inward in the radial direction of the pack shutter portion 1214) shape with the position adjustment portion 1217 set as a groove bottom surface (recess portion bottom surface) and the drive transmission surfaces 1214*b* set as groove side surfaces. Such a groove portion is opened at the fore-end portion of the outer circumferential surface of the pack shutter portion 1214 in the insertion direction of the insertion portion 1212. In response to the drive transmission surfaces 1214*b* receiving a force in the circumferential direction from the operation portion drive transmission projection 1201*d* of the operation portion 1201, the pack shutter portion 1214 rotates with respect to the insertion portion 1212. Between the drive transmission surfaces 1214*b*, there is provided a lever unlocking rib 1214*a*, which unlocks the first lock mechanism 1250 of the operation portion 1201 described below. Providing the lever unlocking rib 1214*a* between the drive transmission surfaces 1214*b* enables accurately unlocking the first lock mechanism 1250 of the operation portion 1201 at the time of attaching the supply pack 1210.

When the pack shutter portion 1214 is positioned at the closed position, the insertion portion 1212 enters into a state in which the opening 1214*c* provided in the pack shutter portion 1214 and the guide target portion 1232 provided in such a way as to be recessed from the outer circumferential surface of the insertion portion 1212 overlap each other. In this state, the guide portions 1247 and 1248 of the supply portion 1200 are inserted into the guide target portion 1232 of the supply pack 1210, so that the opening 1214*c* fits to the circumferential edge of the seal member 1243 provided on the inner circumferential surface of the main body shutter portion 1206. In a state in which the supply pack 1210 is attached to the supply portion 1200, the first guide target portions 1232*a*, which are included in the guide target portion 1232 and on the upstream side in the insertion direction, engages with the guide portion 1247, and the second guide target portions 1232*b*, which are on the downstream side, faces the guide portion 1248.

A surface extending in the circumferential direction which is a stepped portion between the first guide target portion 1232*a* and the second guide target portion 1232*b* engages with, in the insertion direction, a surface extending in the circumferential direction which is a stepped portion between the guide portion 1247 and the guide portion 1248, so that the position in the insertion direction between the insertion portion 1212 and the operation portion 1201 is determined. The opening 1214*c* has a shape which broadens toward the fore-end side of the insertion portion 1212 and is opened in a cutout form. A pair of opposite portions which form the opening 1214*c* and are opposite to each other in the circumferential direction nips the seal member 1243 in the circumferential direction.

The drive transmission surfaces 1214*b* of the pack shutter portion 1214 engage with the operation portion drive transmission projection 1201*d* of the operation portion 1201 and also engages with main body shutter portion drive transmission projection 1206*a* of the main body shutter portion 1206. The pack shutter portion 1214 moves (rotates) by an operation (movement) force on the operation portion 1201 and also transmits the operation force to the main body shutter portion 1206, thus also moving the main body shutter portion 1206. Thus, the drive transmission surface 1214*b* has, as a force receiving region, a region which engages with and comes into abutting contact with the operation portion drive transmission projection 1201*d*. The operation portion drive transmission projection 1201*d* has a raised shape extending inward in the radial direction from the inner circumferential surface of the operation portion 1201, and the drive transmission surface 1214*b* has, as a force applying region, a region which engages with and comes into abutting contact with the main body shutter portion drive transmission projection 1206*a*.

<Description of First Lock Mechanism>

The first lock mechanism 1250 is described with reference to FIGS. 23A to 23C, FIGS. 28A and 28B, and FIGS. 29A and 29B. As illustrated in FIGS. 23A to 23C and FIGS. 28A and 28B, the first lock mechanism 1250 includes a lever lock member 1227, a lever unlocking link 1229, and a pressure spring 1228. The lever unlocking link 1229 includes an abutting contact surface 1229*b*, which is in abutting contact with the lever lock member 1227, and the lever lock member 1227, which serves as a second restriction member, is pressed against the abutting contact surface 1229*b* by the pressure spring 1228. When the supply pack 1210 is not attached, the operation portion 1201 is restricted by the first lock mechanism 1250 with respect to a rotational direction thereof and is positioned at the operating position serving as an initial position.

Figure 28A:
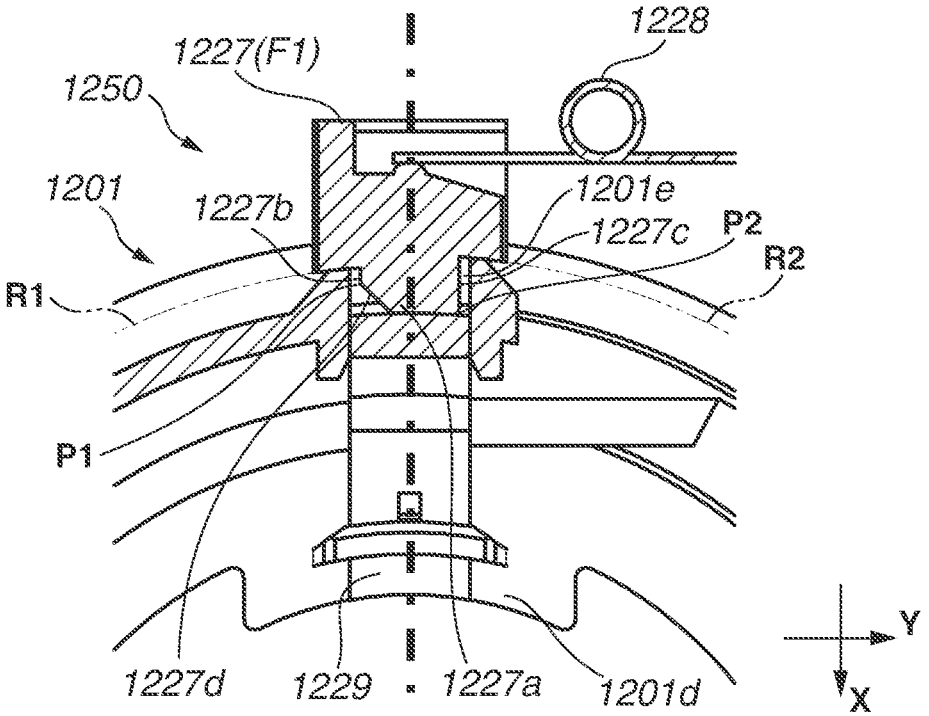
FIG. 28A is a bottom view illustrating a first lock mechanism being in a locked state.
Figure 28B:
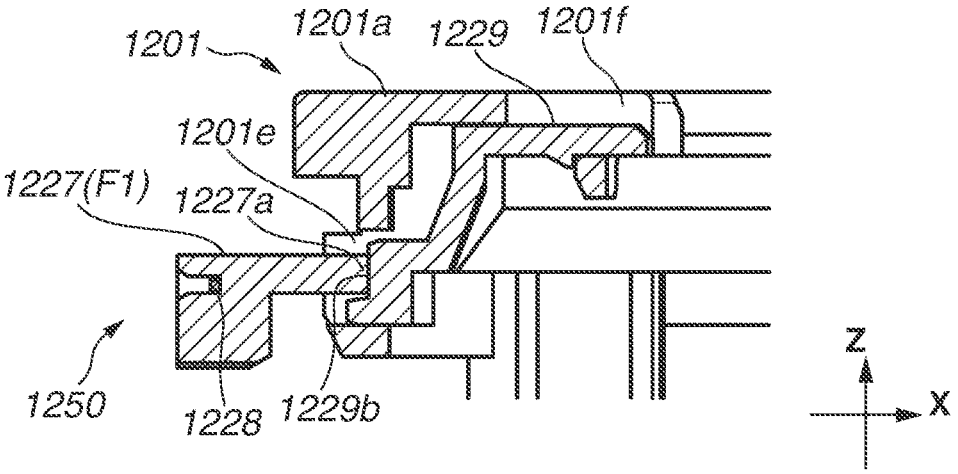
FIG. 28B is a sectional view illustrating the first lock mechanism being in the locked state.
Figure 29A:
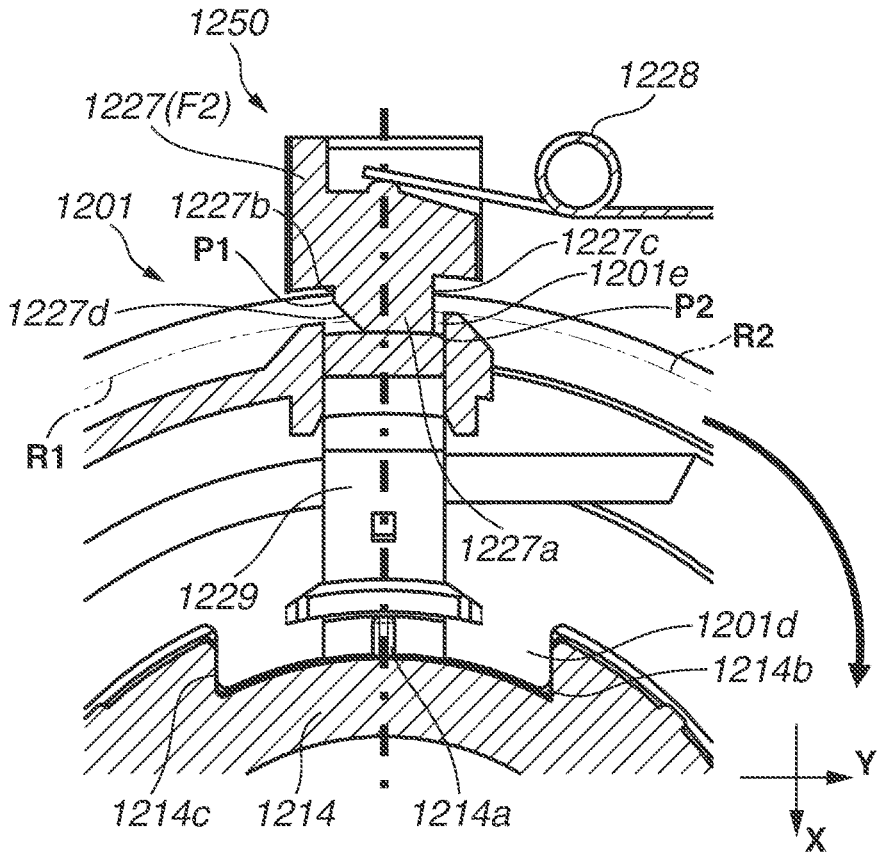
FIG. 29A is a bottom view illustrating the first lock mechanism being in an unlocked state.
Figure 29B:
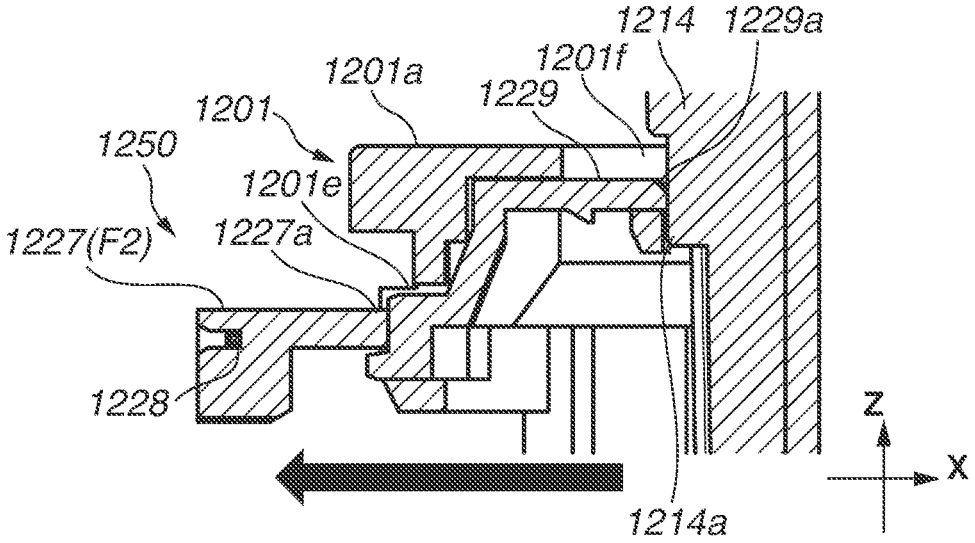
FIG. 29B is a sectional view illustrating the first lock mechanism being in the unlocked state.

FIGS. 28A and 28B are a bottom view and a sectional view, respectively, of the operation portion 1201 and the first lock mechanism 1250 at the time of locking in which the lever lock member 1227 is positioned at a restriction position F1 serving as a second restriction position. FIGS. 29A and 29B are a bottom view and a sectional view, respectively, of the operation portion 1201 and the first lock mechanism 1250 at the time of unlocking in which the lever lock member 1227 is positioned at a cancel position F2 serving as a second restriction cancel position.

As illustrated in FIGS. 28A and 28B, when the first lock mechanism 1250 is in the locking state, the lever lock member 1227 is pressed against the operation portion 1201 by the pressure spring 1228 and is positioned at the restriction position F1. Then, the lever lock pressing portion 1227*a* of the lever lock member 1227 is inserted into the opening portion 1201*e* of the operation portion 1201. When the operation portion 1201 is caused to turn in that state, as illustrated in FIG. 28A, the inner wall of the opening portion 1201*e* turns along turning loci R1 and R2. A portion P1 represents a switching portion between a rotation restriction surface 1227*b* and a slope surface 1227*d*, and a portion P2 represents a switching portion of a rotation restriction surface 1227*c*. In a case where the first lock mechanism 1250 in the locking state, the portions P1 and P2 are positioned on the inner side of the turning loci R1 and R2.

Therefore, the inner wall of the opening portion 1201*e* comes into contact with the rotation restriction surfaces

1227*b* and 1227*c*, which are surfaces perpendicular to the rotational direction and is thus latched, so that turning of the operation portion 1201 is restricted. Thus, the lever lock member 1227 restricts movement of the operation portion 1201 at the restriction position F1.

As illustrated in FIGS. 29A and 29B, when the supply pack 1210 is attached to the supply portion 1200, the lever unlocking rib 1214*a* passes through the unlocking recessed portion 1201*f* and comes into contact with the lever unlocking link 1229. The lever unlocking link 1229 has a slope shape 1229*a*, which is in contact with the lever unlocking rib 1214*a*. The lever unlocking link 1229 receives a force for moving the lever lock member 1227 from the restriction position F1 to the cancel position F2 from the pack shutter portion 1214 via contact between the slope shape 1229*a* and the lever unlocking rib 1214*a*. The slope shape 1229*a* is a shape inclined with respect to the insertion direction of the supply pack 1210 into the operation portion 1201. Thus, the slope shape 1229*a* is configured to be inclined in such a manner that a component force acting in a direction to move the lever unlocking link 1229 to the pressing position is included in a force received from the lever unlocking rib 1214*a*.

As illustrated in FIG. 29B, the lever unlocking link 1229 is pressed in the direction of an illustrated arrow by a force which the slope shape 1229*a* receives from the lever unlocking rib 1214*a*, so that an end portion in which the slope shape 1229*a* is provided runs on the side surface of the lever unlocking rib 1214*a*. This causes the lever unlocking link 1229 to move to a pressing position for the abutting contact surface 1229*b* to move the lever lock member 1227 to the cancel position F2. With this movement, the lever lock member 1227, which is in abutting contact with the lever unlocking link 1229, moves in the direction of the illustrated arrow to the cancel position F2 against the urging force of the pressure spring 1228.

As illustrated in FIG. 29A, when the lever lock member 1227 is positioned a t the cancel position F2, the portion P1 moves to the outer side of the turning locus R1 and the portion P2 is kept on the inner side of the turning locus R2. Therefore, when the lever portion 1201*b* is caused to turn in the direction of an illustrated arrow, the slope surface 1227*d* collides with the inner wall of the opening portion 1201*e*, so that the lever lock member 1227 recedes to the outer side in the radial direction than the cancel position F2 due to a component force and becomes able to override the slope surface 1227*d*. Therefore, the lever lock member 1227 allows the lever portion 1201*b* to turn in the direction of the illustrated arrow, thus enabling turning the operation portion 1201 to the supplying position.

When the lever lock member 1227 is positioned at the cancel position F2, since the portion P2 is kept on the inner side of the turning locus R2, turning of the lever portion 1201*b* in a direction opposite to the direction of the arrow illustrated in FIG. 29A is restricted. Thus, at the cancel position F2, the lever lock member 1227 cancels restriction of movement of the operation portion 1201. In the third exemplary embodiment, providing an assembling phase of the operation portion 1201 in a direction in which turning is restricted satisfies both of preventing the operation portion 1201 from turning to the assembling phase after assembly and allowing the operation portion 1201 to turn to the supplying position.

<Supply Procedure for Toner>

Next, a supply procedure for toner using the supply pack 1210 is described with reference to FIGS. 21A to 21D to FIG. 30. First, as illustrated in FIGS. 21A to 21C, the user removes a recording material P on the discharge tray 1014 and then opens the discharge tray 1014 from the closed position to the opened position. This causes the supply portion 1200 to become exposed. Since the supply portion 1200 is provided near the front surface of the upper portion of the image forming apparatus 1001, it is easy to perform toner supply.

In a state in which the discharge tray 1014 is opened to the opened position and the supply portion 1200 is exposed, the operation portion 1201 is restricted by the above-mentioned first lock mechanism 1250 from rotation. Then, the operation portion 1201 is fixed in position at the operating position.

The user aligns the operation portion drive transmission projection 1201*d* (see FIG. 23A) provided at the supply portion 1200 and the position adjustment cutout (position adjustment portion) 1217 (see FIG. 27B) provided at the supply pack 1210 with each other and then attaches the supply pack 1210 to the supply portion 1200. In a case where the operation portion drive transmission projection 1201*d* and the position adjustment cutout 1217 do not coincide in position with each other, the supply pack 1210 interferes with the operation portion drive transmission projection 1201*d*, so that it is impossible to insert the supply pack 1210.

FIG. 21C is a perspective view illustrating a manner in which the supply pack 1210 has been attached to the supply portion 1200. In the third exemplary embodiment, as illustrated in FIG. 21C, when the direction of arrow D, which is the extension direction of the pouch end portion 1216, is parallel to the X-direction, it is possible to attach the supply pack 1210 to the supply portion 1200. When the supply pack 1210 is inserted all the way into the supply portion 1200, the drive transmission surfaces 1214*b*, which form the position adjustment cutout 1217, engage with the operation portion drive transmission projection 1201*d* of the operation portion 1201. Moreover, the drive transmission surfaces 1214*b* of the pack shutter portion 1214 engage with the main body shutter portion drive transmission projection 1206*a* of the main body shutter portion 1206.

Thus, the rotation of the operation portion 1201 is transmitted to the pack shutter portion 1214, and the rotation of the pack shutter portion 1214 is transmitted to the main body shutter portion 1206. This brings about a state in which the main body shutter portion 1206 and the pack shutter portion 1214 have engaged with each other and has become integrated with each other, so that the operation portion 1201, the pack shutter portion 1214, and the main body shutter portion 1206 interlock with each other. Moreover, when the supply pack 1210 is attached to the supply portion 1200, locking of the operation portion 1201 by the first lock mechanism 1250 is canceled, so that the operation portion 1201 becomes rotatable. Furthermore, in a state in which the supply pack 1210 is not attached to the supply portion 1200, the operation portion 1201 and the main body shutter portion 1206 do not interlock with each other.

Figure 30:
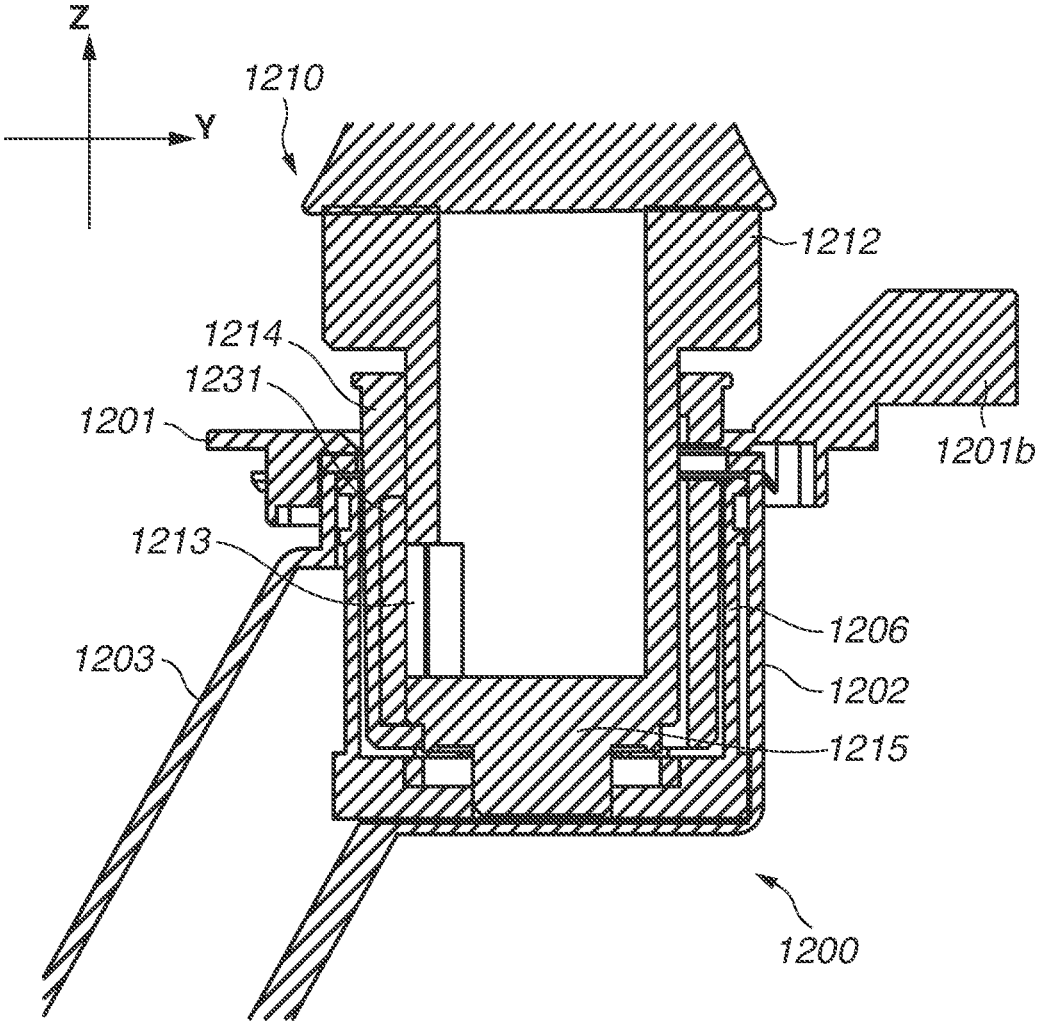
FIG. 30 is a sectional view illustrating a manner in which the supply pack has been attached to the supply portion.

FIG. 30 is a sectional view illustrating a manner in which the supply pack 1210 has been attached to the supply portion 1200. In FIG. 30, the operation portion 1201 is positioned at the operating position, and each of the main body shutter portion 1206 and the pack shutter portion 1214 is positioned at the closed position.

Then, as illustrated in FIG. 23C, the user rotates the lever portion 1201*b* of the operation portion 1201 by 90 degrees counterclockwise. This causes the operation portion 1201 to rotate from the operating position to the supplying position and causes each of the pack shutter portion 1214 and the main body shutter portion 1206 to rotate from the closed position to the opened position. As a result, the opening 1214*c* of the pack shutter portion 1214, the opening 1213 of the insertion portion 1212 of the supply pack 1210, the opening 1207 of the main body shutter portion 1206, and the side surface opening 1205 of the toner receiving portion 1202 overlap each other. This causes toner contained in the supply pack 1210 to be discharged to the storing portion 1018 through the supply path portion 1203.

In other words, when the operation portion 1201 is positioned at the supplying position, the supply portion 1200 enters into a supply-enabled state of being able to supply toner from the supply pack 1210 to the storing portion 1018. At this time, the opening 1213 of the supply pack 1210 and the side surface opening 1205 of the toner receiving portion 1202 communicate with each other.

When the supply of toner from the supply pack 1210 to the storing portion 1018 is completed, the user returns the operation portion 1201 from the supplying position to the operating position. Thus, the user rotates the lever portion 1201*b* of the operation portion 1201 90 degrees clockwise. This causes each of the pack shutter portion 1214 and the main body shutter portion 1206 to rotate from the opened position to the closed position.

In other words, when the operation portion 1201 is positioned at the operating position, the supply portion 1200 enters into a supply-disabled state of being unable to supply toner from the supply pack 1210 to the storing portion 1018. At this time, the opening 1213 of the supply pack 1210 and the side surface opening 1205 of the toner receiving portion 1202 do not communicate with each other.

Then, the user detaches the supply pack 1210 from the supply portion 1200. In this way, since, when the supply pack 1210 has been detached from the supply portion 1200, the pack shutter portion 1214 is positioned at the closed position, it is possible to prevent toner from leaking from the opening 1213 of the supply pack 1210.

<Description of Second Lock Mechanism>

Next, a second lock mechanism 1400 is described with reference to FIG. 31 to FIGS. 41A and 41B. In the third exemplary embodiment, the operation portion 1201 is restricted from rotation by the second lock mechanism 1400 in addition to the first lock mechanism 1250. The first lock mechanism 1250 restricts rotation of the operation portion 1201 in a state in which the supply pack 1210 is not attached to the supply portion 1200. The second lock mechanism 1400 restricts rotation of the operation portion 1201 under a predetermined non-energization condition even when the supply pack 1210 is attached to the supply portion 1200.

Figure 31:
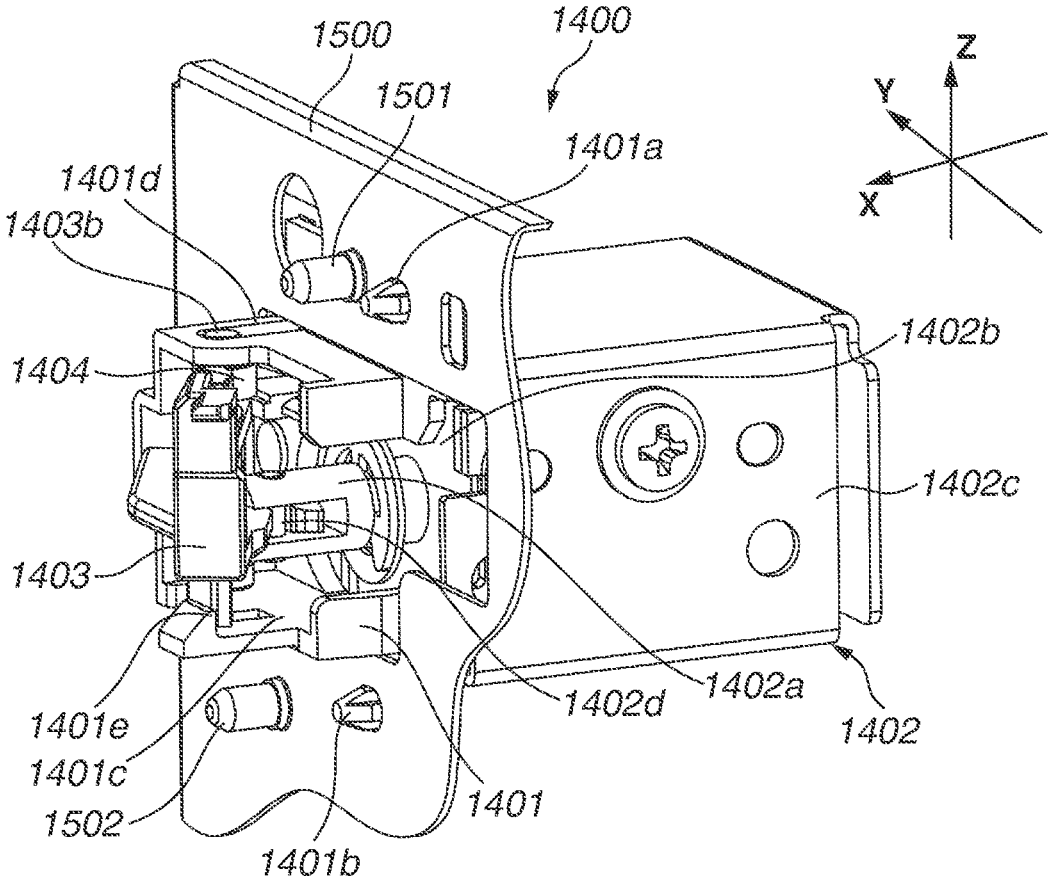
FIG. 31 is a perspective view illustrating a second lock mechanism.
Figure 32A:
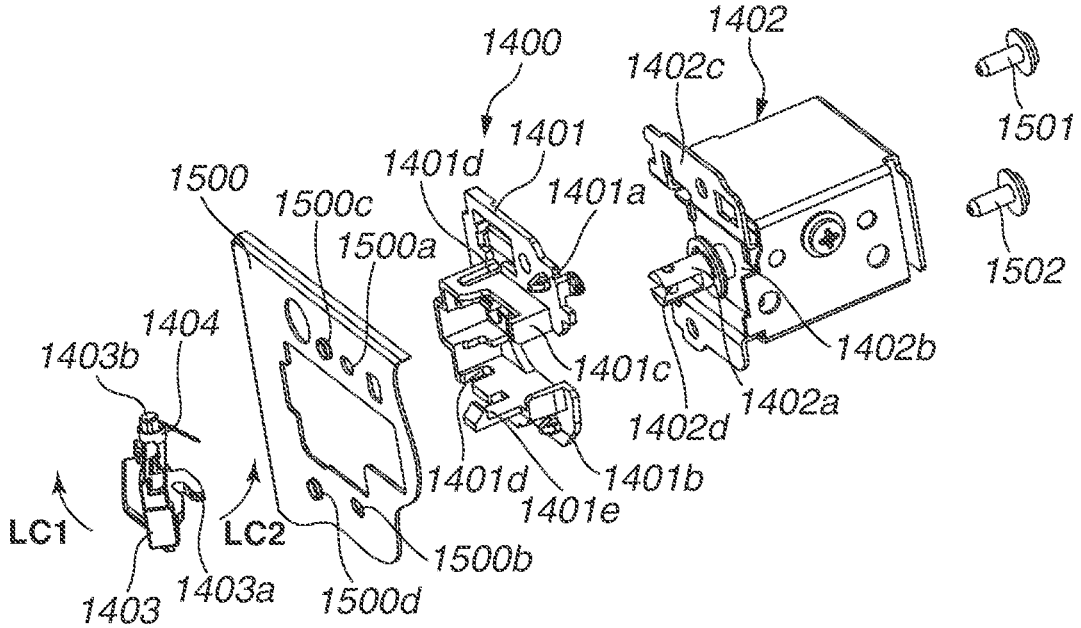
FIG. 32A is an exploded perspective view illustrating the second lock mechanism.
Figure 32B:
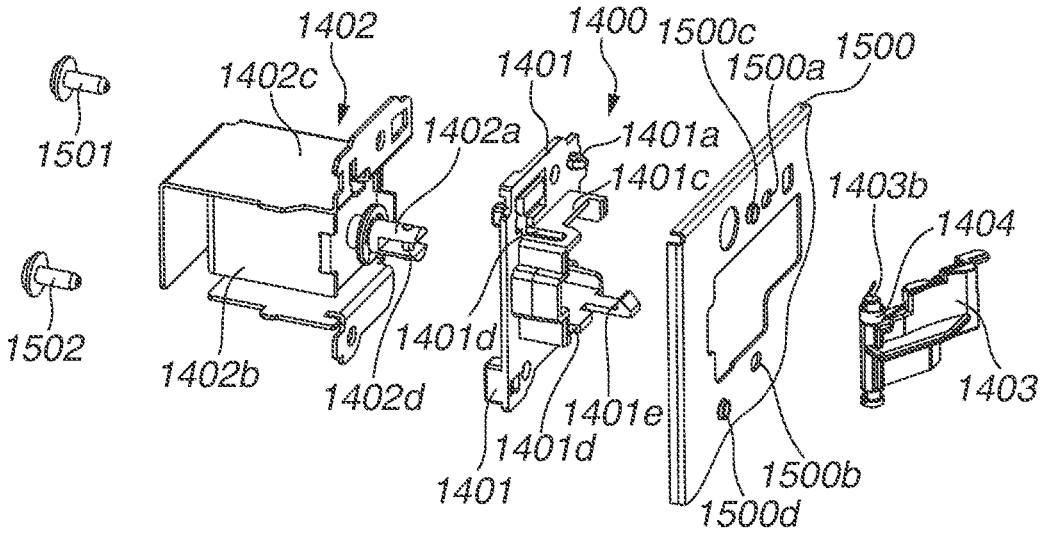
FIG. 32B is another exploded perspective view illustrating the second lock mechanism.

As illustrated in FIG. 31 and FIGS. 32A and 32B, the second lock mechanism 1400 is fixed to a side plate 1500, which is a frame member of the image forming apparatus 1001. Furthermore, in FIG. 31, FIGS. 32A and 32B, and FIGS. 34A and 34B, only a part of the side plate 1500 is illustrated. The second lock mechanism 1400 includes a holding member 1401 and a solenoid unit 1402, which are fixed to the side plate 1500, a lock lever 1403, a lock spring 1404, and a marking member 1405 (see FIG. 34A).

The holding member 1401 includes locating portions 1401*a* and 1401*b* and a holding portion 1401*c*, which holds the lock lever 1403, and is fixed in position to the side plate 1500 by the locating portions 1401*a* and 1401*b* being inserted into holes 1500*a* and 1500*b* of the side plate 1500, respectively. The solenoid unit 1402 includes a plunger 1402*a*, a solenoid 1402*b*, which is able to magnetically attract the plunger 1402*a* by being energized, and a solenoid frame 1402*c*. The solenoid frame 1402*c* holds the solenoid 1402*b*, which serves as an actuator.

The holding member 1401 and the solenoid frame 1402*c* are fixed to the side plate 1500 by being jointly fastened to fixing holes 1500*c* and 1500*d* of the side plate 1500 with screws 1501 and 1502. The lock lever 1403, which serves as a restriction member and a first restriction member, includes a latch portion 1403*a*, which is latched to a pin 1402*d* of the plunger 1402*a*, and is held in such a way as to be turnable with respect to the holding portion 1401*c* of the holding member 1401. More specifically, the holding portion 1401*c* includes a shaft supporting portion 1401*d*, which supports a shaft portion 1403*b* of the lock lever 1403 in a rotatable manner, and the lock lever 1403 is configured to be turnable around the shaft portion 1403*b*, which is supported by the shaft supporting portion 1401*d*.

The lock spring 1404 is a coil spring which is held by the shaft portion 1403*b*, and has one end latched to the holding portion 1401*c* of the holding member 1401 and the other end latched to the lock lever 1403. The lock lever 1403 is urged by the lock spring 1404 in the direction of arrow LC1 and is turned in the direction of arrow LC2 opposite to the direction of arrow LC1 by the plunger 1402*a*, which is magnetically attracted by the solenoid 1402*b*.

Moreover, the holding portion 1401*c* of the holding member 1401 has, formed therein, a collision portion 1401*e*, with which the lock lever 1403 collides. When the solenoid 1402*b* is in a non-energized state, the lock lever 1403 collides with the collision portion 1401*e* by the urging force of the lock spring 1404. This causes the lock lever 1403 to be held at a locked position E1 illustrated in FIG. 33A. In response to the plunger 1402*a* being magnetically attracted by the solenoid 1402*b* in an energized state, the lock lever 1403 turns in the direction of arrow LC2 from the locked position E1 and thus moves to an unlocked position E2 illustrated in FIG. 33B.

Figure 33A:
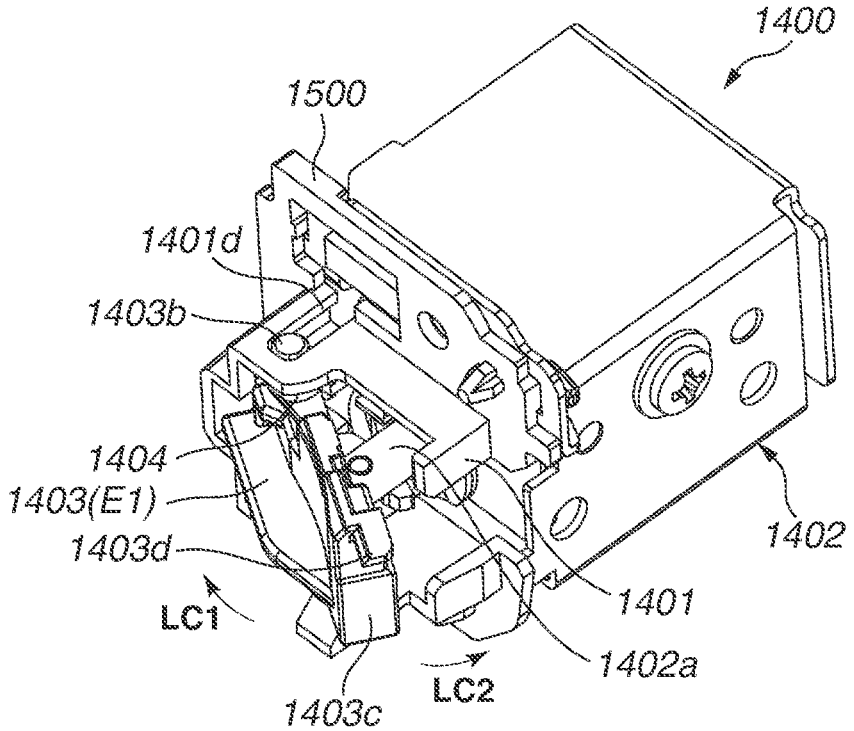
FIG. 33A is a perspective view illustrating the second lock mechanism being in a locked state.
Figure 33B:
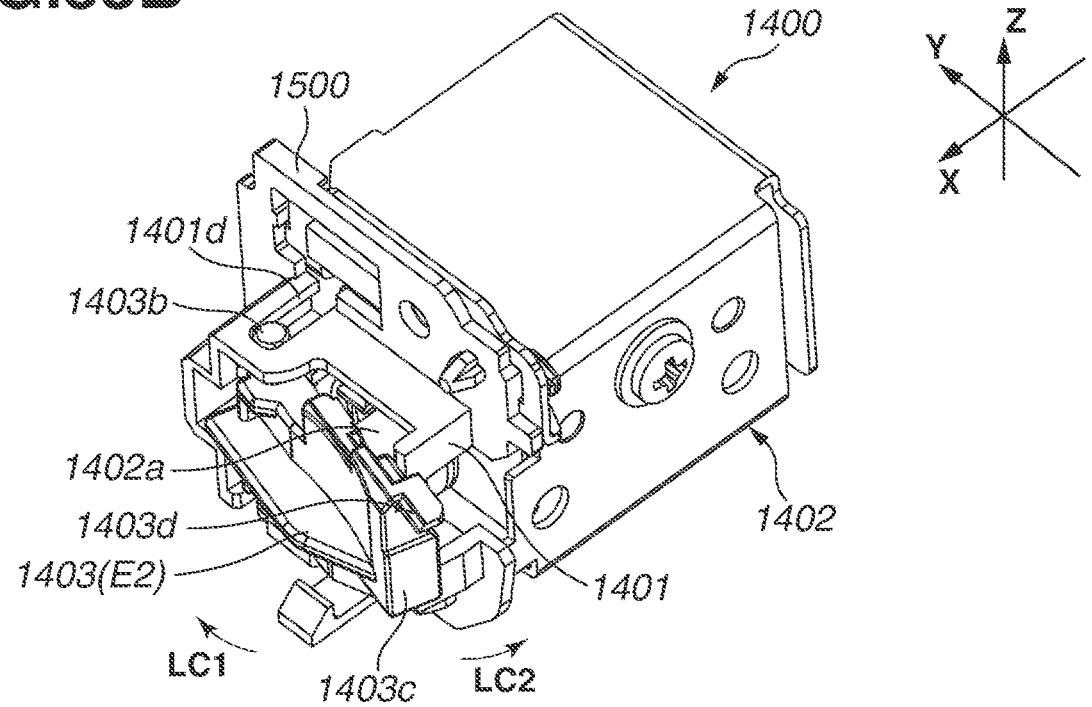
FIG. 33B is a perspective view illustrating the second lock mechanism being in an unlocked state.
Figure 34A:
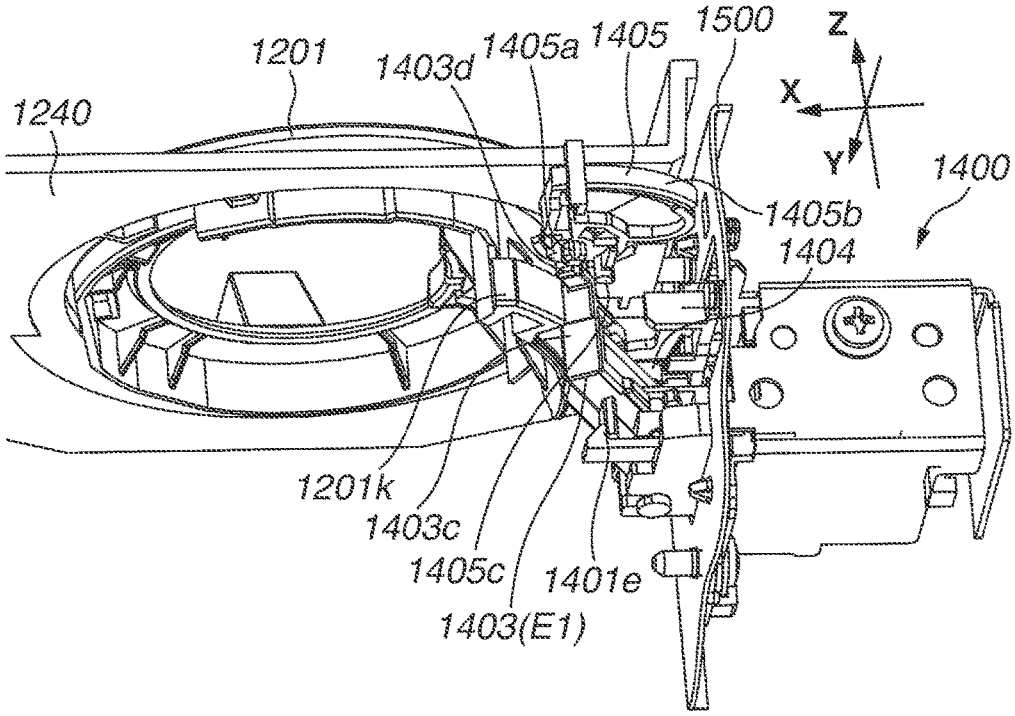
FIG. 34A is a perspective view, as viewed from the bottom side, illustrating the second lock mechanism being in the locked state.
Figure 34B:
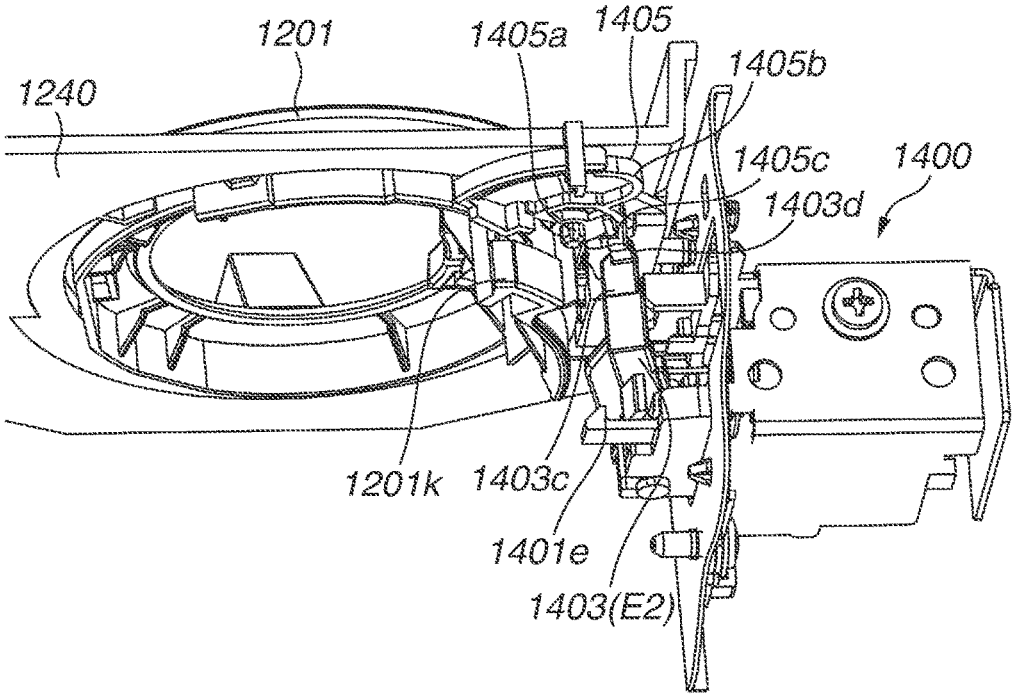
FIG. 34B is a perspective view, as viewed from the bottom side, illustrating the second lock mechanism being in the unlocked state.

FIG. 33A and FIG. 34A are perspective views illustrating the second lock mechanism 1400 in a state in which the lock lever 1403 is positioned at the locked position E1. FIG. 33B and FIG. 34B are perspective views illustrating the second lock mechanism 1400 in a state in which the lock lever 1403 is positioned at the unlocked position E2. As illustrated in FIGS. 33A and 33B and FIGS. 34A and 34B, the lock lever 1403 includes a first engagement portion 1403*c* and a second engagement portion 1403*d*, which is formed above the first engagement portion 1403*c* and in such a way as to protrude outward in the radial direction around the shaft portion 1403*b*.

When the lock lever 1403 is positioned at the locked position E1, which serves as a restriction position and a first restriction position, the first engagement portion 1403*c*, which serves as an engagement portion, is positioned at a position protruding to a movement locus 1420 (see FIG. 42B) of the detection target rib portion 1201*k* of the operation portion 1201. Moreover, when the lock lever 1403 is positioned at the unlocked position E2, which serves as a restriction cancel position and a first restriction cancel position, the first engagement portion 1403*c* is positioned at a position receding from the movement locus 1420 (see FIG. 41B) of the detection target rib portion 1201*k*. Thus, when the lock lever 1403 is positioned at the locked position E1, the first engagement portion 1403*c* is able to engage with the detection target rib portion 1201*k* of the operation portion 1201. The operation portion 1201 is restricted from rotation by the detection target rib portion 1201*k* engaging with the first engagement portion 1403*c*. Then, when the lock lever 1403 is positioned at the unlocked position E2, since the detection target rib portion 1201*k* never engages with the first engagement portion 1403*c*, the operation portion 1201 is never restricted from rotation by the first engagement portion 1403*c*.

Figure 35A:
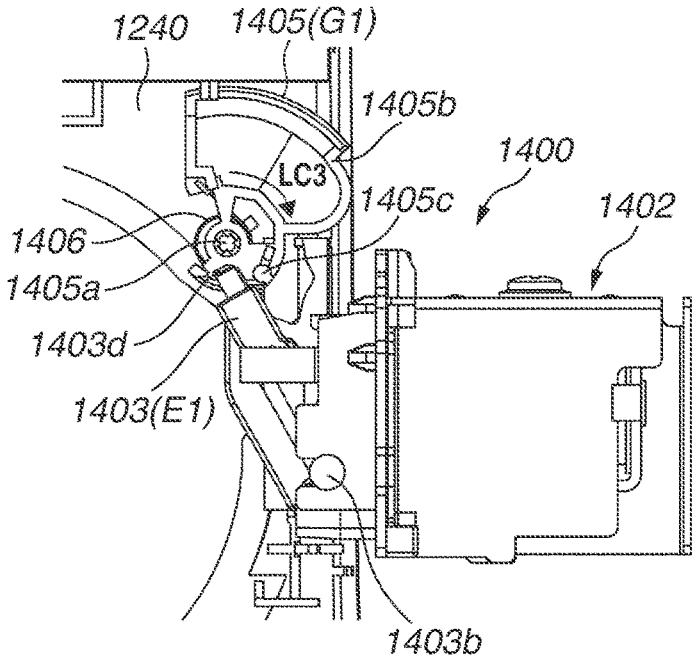
FIG. 35A is a bottom view illustrating the second lock mechanism being in the locked state.
Figure 35B:
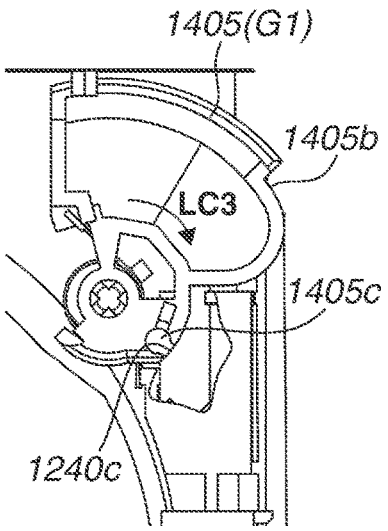
FIG. 35B is an enlarged view of FIG. 35A.
Figure 35C:
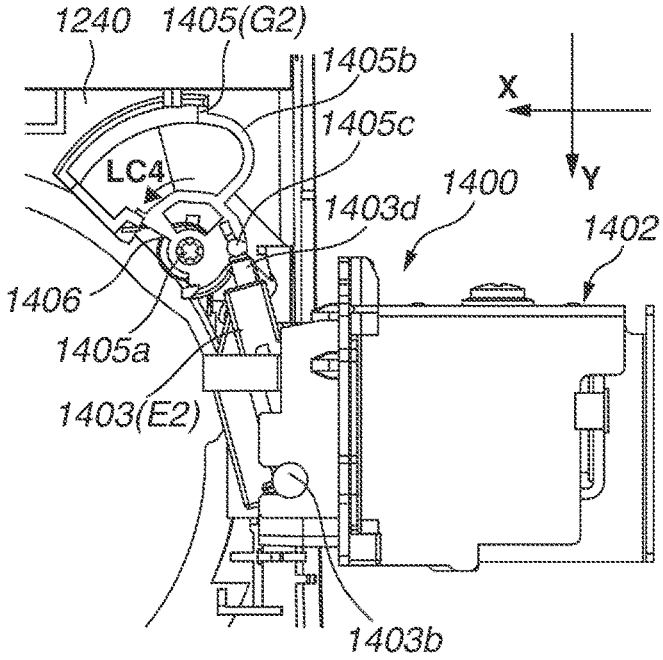
FIG. 35C is a bottom view illustrating the second lock mechanism being in the unlocked state.
Figure 36A:
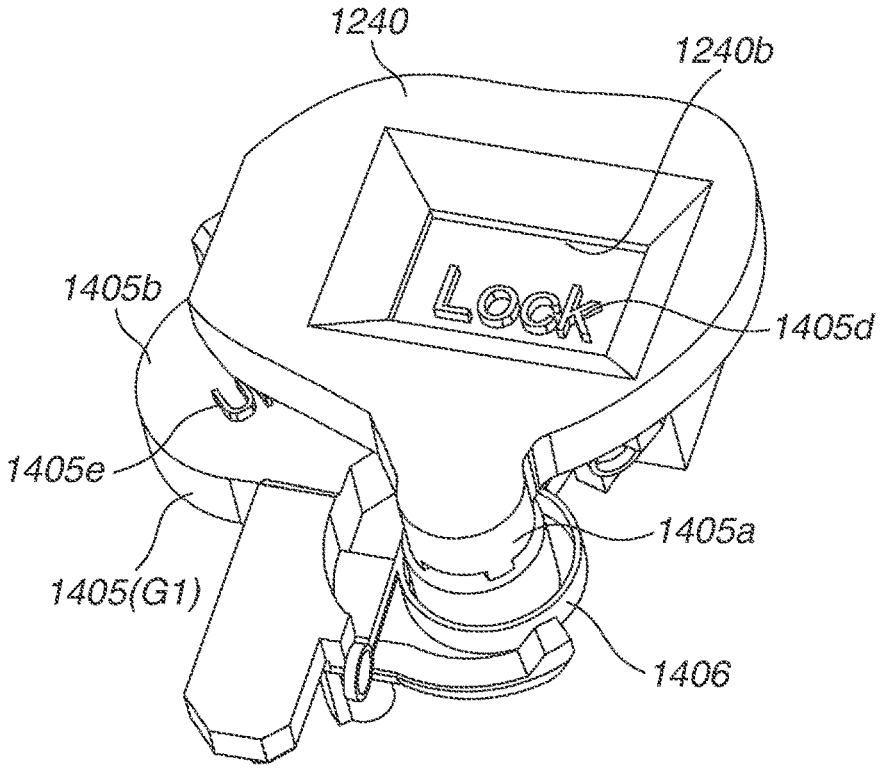
FIG. 36A is a perspective view illustrating a window portion and a first marking portion.
Figure 36B:
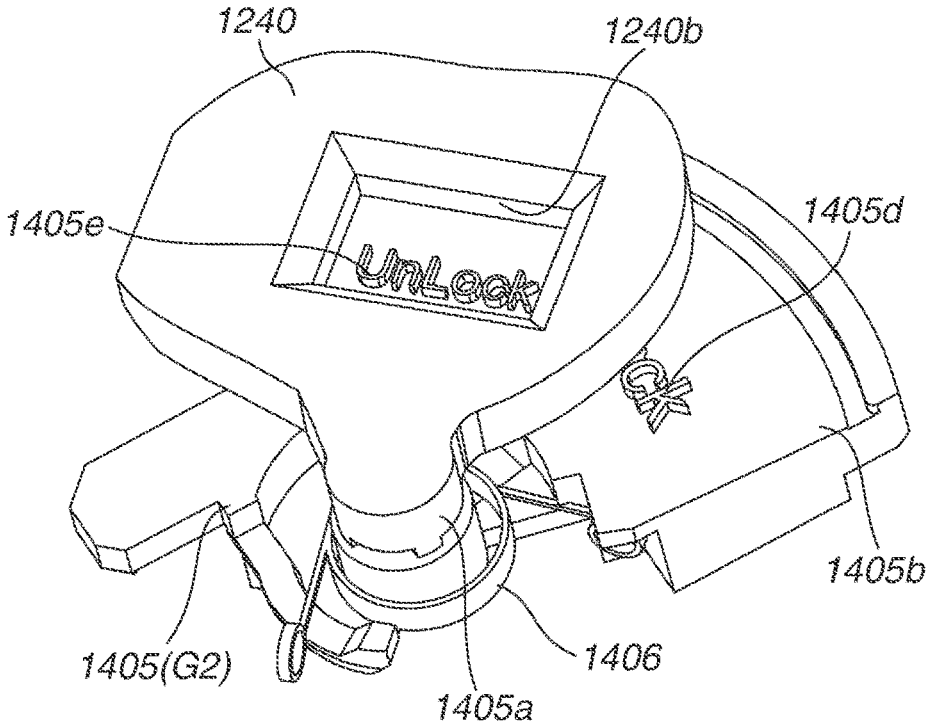
FIG. 36B is a perspective view illustrating the window portion and a second marking portion.

FIG. 35A is a bottom view illustrating the marking member 1405 when the lock lever 1403 is positioned at the locked position E1. FIG. 35B is an enlarged view of FIG. 35A. FIG. 35C is a bottom view illustrating the marking member 1405 when the lock lever 1403 is positioned at the unlocked position E2. FIG. 36A is a perspective view illustrating the marking member 1405 and the top surface portion 1240 as viewed from the top surface side when the lock lever 1403 is positioned at the locked position E1. FIG. 36B is a perspective view illustrating the marking member 1405 and the top surface portion 1240 as viewed from the top surface side when the lock lever 1403 is positioned at the unlocked position E2.

As illustrated in FIGS. 34A and 34B and FIGS. 35A and 35B, the marking member 1405 is supported to be turnable around a turning shaft 1405*a* with respect to the top surface portion 1240. The marking member 1405 includes a marking portion 1405*b*, which is formed in the form of an almost fan-shaped plate, and a boss portion 1405*c*, which protrudes downward from the marking portion 1405*b*. The marking member 1405 is urged in the direction of arrow LC3 by a coil spring 1406, which is held by the turning shaft 1405*a*. The coil spring 1406 has one end latched to the top surface portion 1240 and the other end latched to the marking member 1405.

When the lock lever 1403 is positioned at the locked position E1, the boss portion 1405*c* of the marking member 1405, which is urged in the direction of arrow LC3 by the coil spring 1406, collides with a collision surface 1240*c* provided at the bottom surface side of the top surface portion 1240. This causes the marking member 1405 to be positioned at a lock marking position G1 serving as a first position. As illustrated in FIGS. 36A and 36B, the top surface portion 1240, which serves as a cover, has, formed therein, a hole-shaped window portion 1240*b*, and a first marking 1405*d* and a second marking 1405*e* are provided on the upper surface of the marking portion 1405*b* of the marking member 1405.

The first marking 1405*d* and the second marking 1405*e* are arranged at respective different positions in the turning direction (the direction of arrow LC3 and the direction of arrow LC4) of the marking member 1405. In the third exemplary embodiment, the first marking 1405*d* has characters of "Lock" indicating that the lock lever 1403 is positioned at the locked position E1 and movement restriction is set to the operation portion 1201. The second marking 1405*e* has characters of "Unlock" indicating that the lock lever 1403 is positioned at the unlocked position E2 and movement restriction is not set to the operation portion 1201.

As illustrated in FIG. 36A, when the marking member 1405 is positioned at the lock marking position G1, the first marking 1405*d* is visually recognizable via the window portion 1240*b* from the upper surface side of the image forming apparatus 1001. Furthermore, while, in the third exemplary embodiment, the marking member 1405 is fixed in position at the lock marking position G1 due to the boss portion 1405*c* of the marking member 1405 being caused to collide with the collision surface 1240*c* of the top surface portion 1240, the third exemplary embodiment is not limited to this. For example, the marking member 1405 can be fixed in position at the lock marking position G1 due to a portion other than the boss portion 1405*c* of the marking member 1405 colliding with the top surface portion 1240. Moreover, the marking member 1405 can be fixed in position at the lock marking position G1 due to any portion of the marking member 1405 colliding with the side plate 1500.

As illustrated in FIG. 34B, FIG. 35B, and FIG. 36B, when the solenoid 1402*b* is energized and the lock lever 1403 moves from the locked position E1 to the unlocked position E2, the boss portion 1405*c* is pushed by the second engagement portion 1403*d* of the lock lever 1403. This causes the marking member 1405 to turn in the direction of arrow LC4 opposite to the direction of arrow LC3 against the urging force of the coil spring 1406. Then, the boss portion 1405*c* is held by the second engagement portion 1403*d* of the lock lever 1403 being positioned at the unlocked position E2, so that the marking member 1405 is held at an unlock marking position G2, serving as a second position, illustrated in FIG. 34B, FIG. 35B, and FIG. 36B. At this time, since the boss portion 1405*c* is in pressure contact with the second engagement portion 1403*d* by the urging force of the coil spring 1406, the marking member 1405 never becomes out of alignment with the unlock marking position G2.

As illustrated in FIG. 36B, when the marking member 1405 is positioned at the unlock marking position G2, the second marking 1405*e* is visually recognizable via the window portion 1240*b* from the upper surface side of the image forming apparatus 1001. When the solenoid 1402*b* enters from an energized state into a non-energized state, the lock lever 1403 moves from the unlocked position E2 to the locked position E1 by the urging force of the lock spring 1404. This causes the second engagement portion 1403*d* of the lock lever 1403 and the boss portion 1405*c* of the marking member 1405 to disengage from each other, so that the marking member 1405 moves from the unlock marking position G2 to the lock marking position G1 by the urging force of the coil spring 1406.

Thus, the marking member 1405 is configured to interlock with the operation of the solenoid 1402*b* in such a way as to be positioned at the lock marking position G1 when the lock lever 1403 is positioned at the locked position E1 and to be positioned at the unlock marking position G2 when the lock lever 1403 is positioned at the unlocked position E2.

<Control Block>

FIG. 37 is a block diagram used to explain functions of the circuit board 1100 in the third exemplary embodiment.

The circuit board 1100 includes a low-voltage power source portion 1110 and a high-voltage power source portion 1120. The low-voltage power source portion 1110 takes in electric power from an external power source via a power source input portion (not illustrated) mounted at the board end portion, and converts an alternating-current voltage into a stabilized direct-current voltage with use of a rectifying smoothing circuit including an electrolytic capacitor. After that, the low-voltage power source portion 1110 converts the direct-current voltage into a high-frequency alternating-current voltage with use of a switching element such as a transistor, and then inputs the high-frequency alternating-current voltage to a low-voltage power transformer. The low-voltage power transformer converts the high-frequency alternating-current voltage, serving as an input voltage, into an alternating-current voltage (output voltage) having a desired voltage value. The low-voltage power source portion 1110 converts the alternating-current voltage into a direct-current voltage again, and outputs the obtained direct-current voltage to the high-voltage power source portion 1120. Moreover, since, in the low-voltage power source portion 1110, losses of individual circuit components appear as heat, a heatsink (not illustrated) made from aluminum or iron is provided for heat dissipation.

The high-voltage power source portion 1120 converts a voltage (for example, at 24 volts (V)) supplied from the low-voltage power source portion 1110 into high voltages required for an image forming process, such as charging, developing, and transfer. The voltage supplied from the low-voltage power source portion 1110 is converted into a voltage for charging by a charging transformer (not illustrated) included in the high-voltage power source portion 1120, so that the voltage for charging is supplied to the charging roller 1017. The voltage supplied from the low-voltage power source portion 1110 is converted into a voltage for developing by a developing transformer (not illustrated) included in the high-voltage power source portion 1120, so that the voltage for developing is supplied to the developing roller 1012. The voltage supplied from the low-voltage power source portion 1110 is converted into a voltage for transfer by a transfer transformer (not illustrated) included in the high-voltage power source portion 1120, so that the voltage for transfer is supplied to the transfer roller 1007.

The low-voltage power source portion 1110 not only supplies a voltage to the high-voltage power source portion 1120 but also supplies a voltage (for example, at 3.3 V or 5 V) to the scanner unit 1050, the drive motor 1311, the engine controller 1130, and a video controller 1140. Here, the engine controller 1130, serving as a control unit, assumes the role of comprehensively controlling various process members and also controls the solenoid 1402*b*. The engine controller 1130 includes, for example, a central processing unit (CPU) (not illustrated), a random access memory (RAM), which is used for, for example, computation and temporary storage of data required for controlling the image forming apparatus 1001, and a read-only memory (ROM), which stores programs and various pieces of data for controlling the image forming apparatus 1001. The video controller 1140 assumes the role of performing communication with an external apparatus such as a personal computer, receiving print data, and notifying the engine controller 1130 of a result obtained by analyzing the print data. Furthermore, the engine controller 1130 and the video controller 1140 can be provided on a board different from the circuit board 1100 or can be provided on the same board.

Moreover, alternating-current power from a commercial power source, which the power source input portion has received, is supplied to not only the low-voltage power source portion 1110 but also the fixing heater 1009*c*. Furthermore, driving of, for example, a roller included in the fixing portion 1009 is performed by the drive motor 1311.

<Energization Determination Processing for Solenoid>

Next, energization determination processing for the solenoid 1402*b* corresponding to a series of supply operations performed by the user is described with reference to the flowcharts of FIG. 38 to FIG. 40. In other words, an energization condition for the solenoid 1402*b* is previously determined according to the flowcharts of FIG. 38 to FIG. 40. The solenoid 1402*b* is energized when, as described below, the discharge tray 1014 is opened to the opened position and an energization condition serving as a predetermined condition is satisfied, and is then de-energized when a non-energization condition is satisfied.

Figure 38:
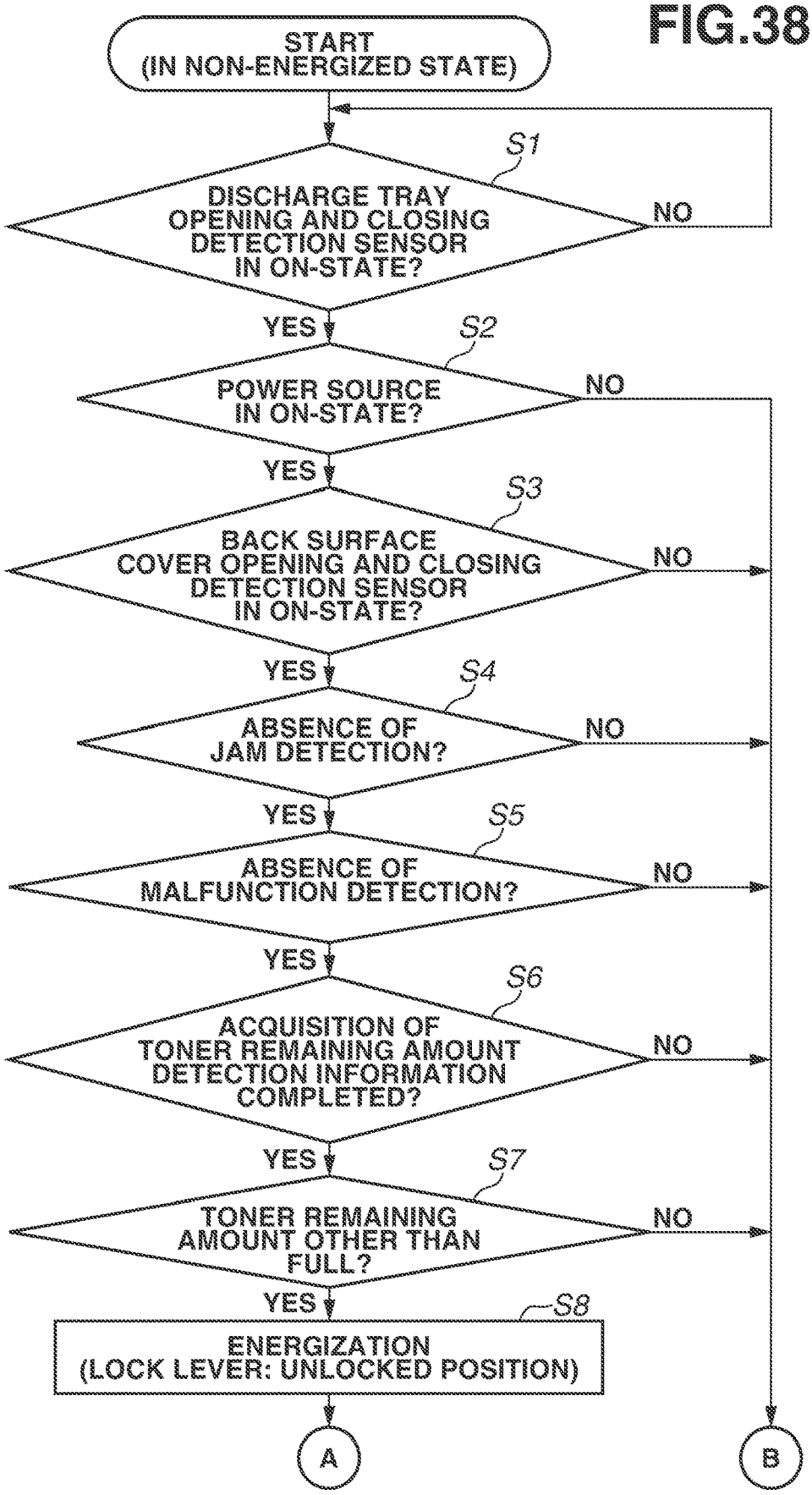
FIG. 38 is a flowchart illustrating energization determination processing for a solenoid in a supply operation to be performed by the user.

As illustrated in FIG. 38, in the energization determination processing for the solenoid 1402*b*, first, in step S1, the engine controller 1130 determines whether the discharge tray opening and closing detection sensor 1239 is in an on-state. Thus, the energization determination processing for the solenoid 1402*b* is started in response to the user opening the discharge tray 1014 as illustrated in FIG. 22C. Furthermore, at the start of the energization determination processing for the solenoid 1402*b*, the solenoid 1402*b* is not yet energized and is in a non-energized state.

If it is determined that the discharge tray opening and closing detection sensor 1239 is in an on-state, i.e., the discharge tray 1014 has been opened to the opened position (YES in step S1), then in step S2, the engine controller 1130 determines whether the power source of the image forming apparatus 1001 is in an on-state. If it is determined that the power source of the image forming apparatus 1001 is in an on-state (YES in step S2), then in step S3, the engine controller 1130 determines whether the back surface cover opening and closing detection sensor 1080 is in an on-state. As illustrated in FIGS. 18A to 18C, in a case where the back surface cover opening and closing detection sensor 1080 is in an on-state, the back surface cover 1073 is positioned at the closed position.

If it is determined that the back surface cover opening and closing detection sensor 1080 is in an on-state (YES in step S3), then in step S4, the engine controller 1130 determines whether a jam has been detected inside the image forming apparatus 1001. On a conveyance path inside the image forming apparatus 1001, there is one or a plurality of recording material detection sensors for detecting the position of a recording material which is conveyed through the conveyance path. For example, if, within a predetermined time after a recording material is fed by the pickup roller 1003, the fed recording material has not yet passed through the detection position of the recording material detection sensor, the engine controller 1130 determines that a jam has occurred.

If it is determined that there is no detection of a j am, i.e., any jam has not occurred (YES in step S4), then in step S5, the engine controller 1130 determines whether the detection of any malfunction of the image forming apparatus 1001 is absent. The malfunction of the image forming apparatus 1001 is determined with use of various sensors or signals in the image forming apparatus 1001. For example, in a case where a cable for sending a signal output from the remaining amount detection portion 1312 to the engine controller 1130 has dropped out and a communication between the remaining amount detection portion 1312 and the engine controller 1130 has stopped, the engine controller 1130 determines that there is a malfunction of the image forming apparatus 1001.

If it is determined that the detection of any malfunction of the image forming apparatus 1001 is absent (YES in step S5), then in step S6, the engine controller 1130 determines whether the acquisition of information about the remaining amount of toner stored in the storing portion 1018 (hereinafter referred to as "toner remaining amount detection information") from the remaining amount detection portion 1312 has been completed. In the third exemplary embodiment, the toner remaining amount detection information is previously stored in a RAM of the engine controller 1130. The toner remaining amount detection information is updated at intervals of a predetermined time during a period in which the agitation member 1060 is driven and the remaining amount of toner is being detected based on a signal output from the remaining amount detection portion 1312. Then, when the detection of the remaining amount of toner ends, the toner remaining amount detection information obtained at the time of ending of detection of the remaining amount of toner is stored in the above-mentioned RAM. Furthermore, for example, in a case where there is a malfunction in the remaining amount detection portion 1312, in a case where the image forming apparatus 1001 is a new one in which the detection of the remaining amount of toner is not yet performed, or in a case where a cable for sending a signal output from the remaining amount detection portion 1312 to the engine controller 1130 has dropped out, the engine controller 1130 is not able to acquire the toner remaining amount detection information.

If it is determined that the acquisition of the toner remaining amount detection information has been completed (YES in step S6), then in step S7, the engine controller 1130 determines whether the remaining amount of toner stored in the storing portion 1018 detected by the remaining amount detection portion 1312 is other than full. In a case where the detected remaining amount of toner stored in the storing portion 1018 is less than a predetermined amount, the remaining amount of toner is deemed to be other than full. The engine controller 1130 calculates the remaining amount of toner stored in the storing portion 1018, based on the length of a time for which the light receiving portion 1312*b* has detected light when toner stored in the storing portion 1018 is agitated for a given time by the agitation member 1060.

If it is determined that the remaining amount of toner is other than full (YES in step S7), then in step S8, the engine controller 1130 energizes the solenoid 1402*b* to cause the second lock mechanism 1400 to enter into an unlocked state in which the lock lever 1403 is positioned at the unlocked position E2.

Thus, the above-mentioned predetermined condition includes the power source of the image forming apparatus 1001 being in an on-state, the back surface cover opening and closing detection sensor 1080 being in an on-state, there being no jam detection and no malfunction detection, the acquisition of the toner remaining amount detection information being completed, and the remaining amount of toner being other than full. Then, when the predetermined condition is satisfied, the engine controller 1130 controls the solenoid 1402*b* in such a way as to cancel movement restriction of the operation portion 1201.

Figure 40:
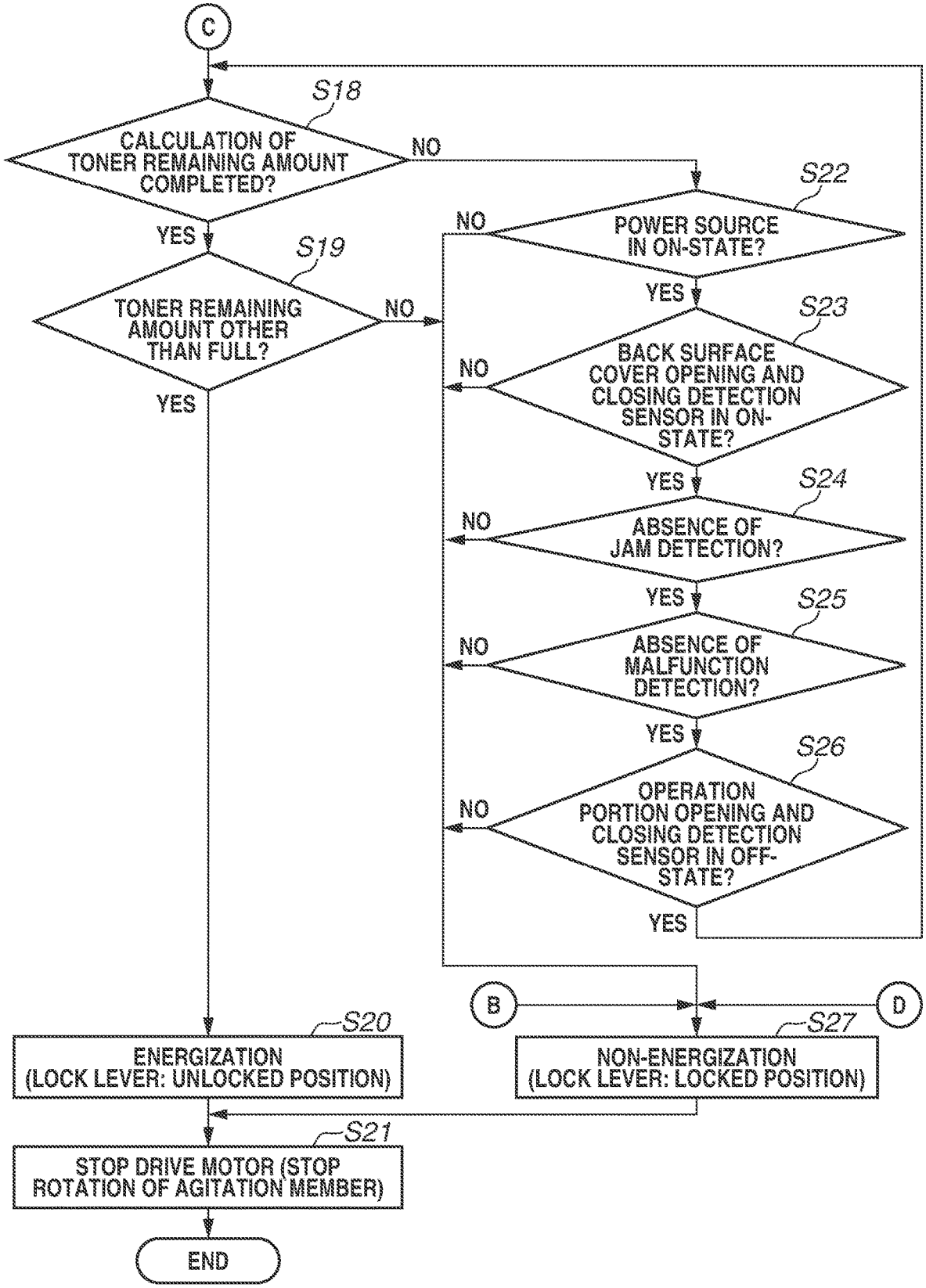
FIG. 40 is a flowchart illustrating energization determination processing for the solenoid in the supply operation to be performed by the user.

On the other hand, if it is determined that the power source of the image forming apparatus 1001 is not in an on-state (NO in step S2), if it is determined that the back surface cover opening and closing detection sensor 1080 is in an off-state (NO in step S3), if it is determined that there is jam detection or malfunction detection (NO in step S4 or NO in step S5), if it is determined that the acquisition of the toner remaining amount detection information has not yet been completed (NO in step S6), or if it is determined that the remaining amount of toner is full (NO in step S7), the engine controller 1130 advances the processing to step S27 illustrated in FIG. 40. Step S27 is described below.

Figure 39:
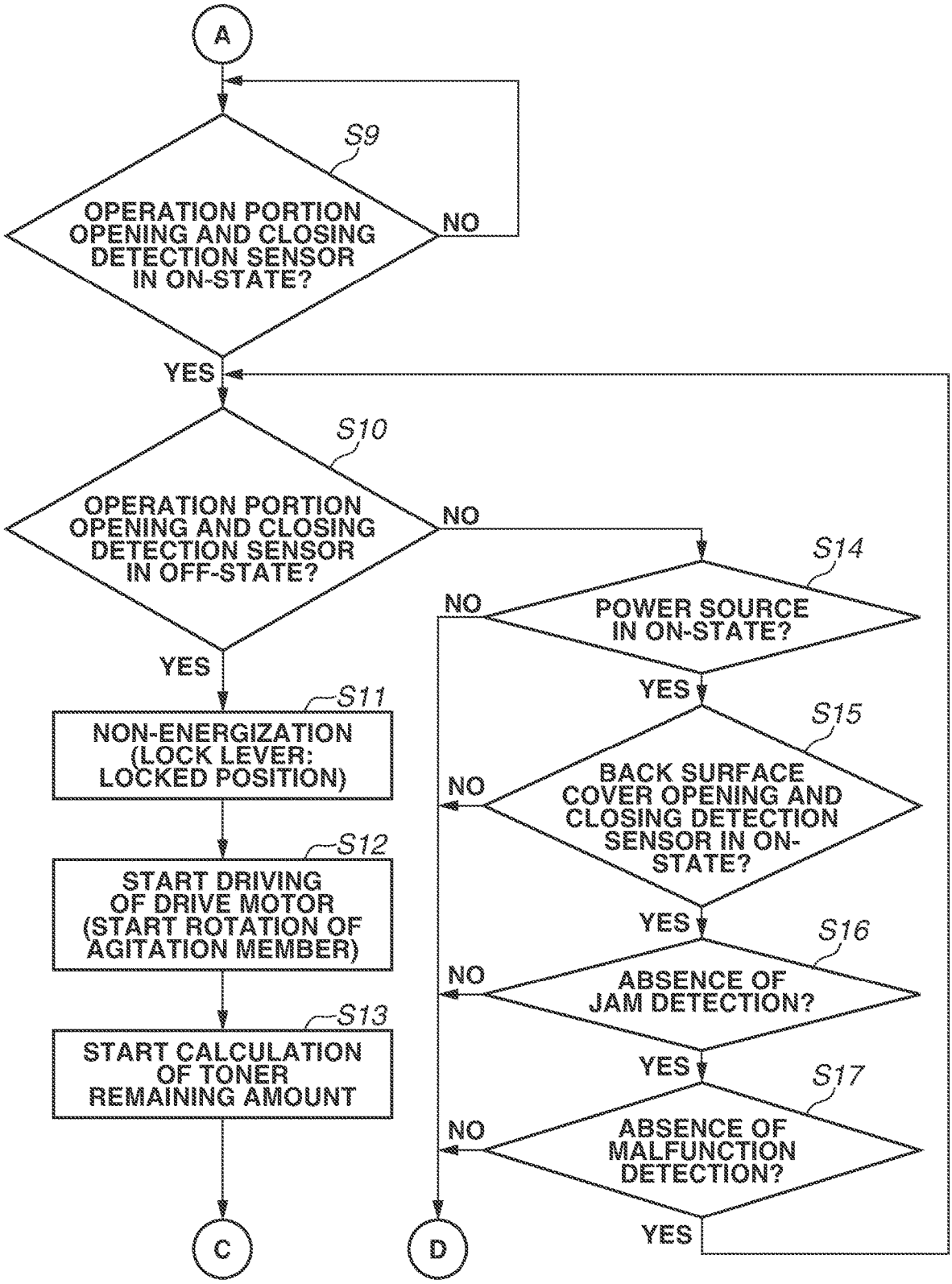
FIG. 39 is a flowchart illustrating energization determination processing for the solenoid in the supply operation to be performed by the user.

After the solenoid 1402*b* is energized in step S8, then in step S9, as illustrated in FIG. 39, the engine controller 1130 determines whether the operation portion opening and closing detection sensor 1225 is in an on-state. Thus, when the second lock mechanism 1400 comes into an unlocked state, the user is allowed to turn the operation portion 1201 from the operating position to the supplying position. When the user turns the operation portion 1201 about 90° counterclockwise from the operating position to the supplying position, the operation portion opening and closing detection sensor 1225 switches from an off-state to an on-state.

If it is determined that the operation portion opening and closing detection sensor 1225 is in an on-state (YES in step S9), then in step S10, the engine controller 1130 determines whether the operation portion opening and closing detection sensor 1225 is in an off-state. Thus, when the user turns the operation portion 1201 from the operating position to the supplying position in step S9, a supply operation for supplying toner from the supply pack 1210 to the developing container 1230 is started. Then, when the user finishes the supply operation and then turns the operation portion 1201 clockwise from the supplying position to the operating position, the operation portion opening and closing detection sensor 1225 switches from an off-state to an on-state.

If it is determined that the operation portion opening and closing detection sensor 1225 is in an off-state (YES in step S10), then in step S11, the engine controller 1130 deenergizes the solenoid 1402*b*, so that the solenoid 1402*b* enters into a non-energized state. This causes the second lock mechanism 1400 to enter into a locked state in which the lock lever 1403 is positioned at the locked position E1. Here, switching the second lock mechanism 1400 to a locked state enables preventing the user from, before the calculation of the remaining amount of toner described below is completed (NO in step S18), replacing the attached supply pack 1210 by another supply pack 1210 and performing a supply operation again. This enables preventing the user from re-performing a supply operation in a state in which toner supply is unfavorable, such as a case where the remaining amount of toner stored in the storing portion 1018 is made full by the supply pack 1210 first attached.

Furthermore, while, in the third exemplary embodiment, the engine controller 1130 deenergizes the solenoid 1402*b* at timing at which the operation portion opening and closing detection sensor 1225 has switched from an off-state to an on-state in step S10, the third exemplary embodiment is not limited to this. For example, the engine controller 1130 can deenergize the solenoid 1402*b* after a predetermined time T1 has elapsed from the timing at which the operation portion opening and closing detection sensor 1225 has switched from an off-state to an on-state. In this case, for the above-mentioned reason, it is desirable to set the predetermined time T1 to a time shorter than a time required for the user to replace the attached supply pack 1210 by another supply pack 1210. Moreover, step S11 can be omitted and energization of the solenoid 1402*b* can be maintained at least until the calculation of the remaining amount of toner is completed. In this case, for the above-mentioned reason, it is also desirable to complete the calculation of the remaining amount of toner in a time shorter than a time required for the user to replace the attached supply pack 1210 by another supply pack 1210.

Next, in step S12 and step S13, the engine controller 1130 starts driving of the drive motor 1311 to start rotation of the agitation member 1060 and then causes the remaining amount detection portion 1312 to start calculation of the remaining amount of toner stored in the storing portion 1018. Driving of the drive motor 1311 is started after a predetermined time elapses after the operation portion opening and closing detection sensor 1225 has come into an off-state in step S10. If the rotation of the agitation member 1060 is started immediately after the operation portion opening and closing detection sensor 1225 has come into an off-state, drive noise occurring in the agitation member 1060 and the drive motor 1311 may confuse the user with respect to a supply operation. Therefore, driving the drive motor 1311 after a predetermined time elapses after the user has completed a turning operation on the operation portion 1201 enables preventing or reducing a user's confusion and prompting a smooth supply operation. In the third exemplary embodiment, the drive motor 1311 is configured to be driven 2.5 seconds after it is detected that the operation portion opening and closing detection sensor 1225 enters into an off-state.

Here, if, in step S10, it is determined that the operation portion opening and closing detection sensor 1225 is in an on-state (NO in step S10), the engine controller 1130 determines whether the solenoid 1402*b* satisfies an energization condition. Thus, during a period before the operation portion 1201 is returned to the operating position after the user moves the operation portion 1201 to the supplying position, an energization condition defined in step S14 to step S17 is determined.

Step S14 to step S17 are similar to step S2 to step S5 illustrated in FIG. 38, respectively, and, therefore, the detailed description thereof is omitted. Then, if the energization condition defined in step S14 to step S17, i.e., any one of the power source of the image forming apparatus 1001 being in an on-state, the back surface cover opening and closing detection sensor 1080 being in an on-state, jam detection being absent, and malfunction detection being absent, is not satisfied, the engine controller 1130 advances the processing to step S27. Step S27 is described below.

After step S13, as illustrated in FIG. 40, in step S18, the engine controller 1130 determines whether the calculation of the remaining amount of toner has been completed. If it is determined that the calculation of the remaining amount of toner has been completed (YES in step S18), then in step S19, the engine controller 1130 determines whether the remaining amount of toner stored in the storing portion 1018 is other than full.

If it is determined that the remaining amount of toner stored in the storing portion 1018 is other than full (YES in step S19), then in step S20, the engine controller 1130 energizes the solenoid 1402*b* again. This causes the second lock mechanism 1400 to enter into an unlocked state in which the lock lever 1403 is positioned at the unlocked position E2. In this case, the user is allowed to perform a supply operation again. Moreover, if, in step S19, it is determined that the remaining amount of toner is larger than or equal to a predetermined amount, i.e., full (NO in step S19), the engine controller 1130 advances the processing to step S27.

Moreover, if, in step S18, it is determined that the calculation of the remaining amount of toner has not yet been completed (NO in step S18), the engine controller 1130 determines whether the solenoid 1402*b* satisfies an energization condition. Thus, during a period before the calculation of the remaining amount of toner is competed (NO in step S18) after the calculation of the remaining amount of toner is started (step S13), an energization condition defined in step S22 to step S26 is determined.

Step S22 to step S26 are similar to step S2 to step S5 illustrated in FIG. 38 and step S10 illustrated in FIG. 39, respectively, and, therefore, the detailed description thereof is omitted. Then, if the energization condition defined in step S22 to step S26, i.e., any one of the power source of the image forming apparatus 1001 being in an on-state, the back surface cover opening and closing detection sensor 1080 being in an on-state, jam detection being absent, malfunction detection being absent, and the operation portion opening and closing detection sensor 1225 being in an off-state, is not satisfied, the engine controller 1130 advances the processing to step S27.

In step S27, the engine controller 1130 causes the solenoid 1402*b* to enter into a non-energized state and causes the second lock mechanism 1400 to enter into a locked state in which the lock lever 1403 is positioned at the locked position E1.

After ending step S20 or step S27, then in step S21, the engine controller 1130 stops the drive motor 1311, so that the rotation of the agitation member 1060 is stopped. Thus, the energization determination processing for the solenoid 1402*b* ends. Furthermore, in a case where the solenoid 1402*b* has entered into a non-energized state (step S27) due to the energization condition defined in step S22 to step S26 not being satisfied, the calculation operation for the remaining amount of toner also stops along with stopping of the drive motor 1311 (step S21).

Figure 41A:
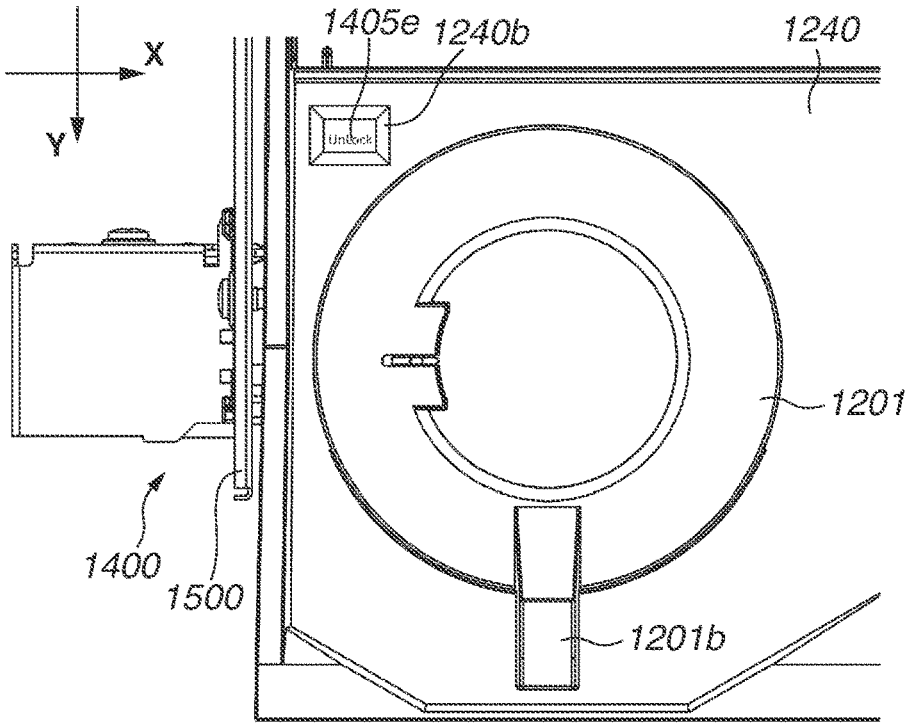
FIG. 41A is a plan view illustrating the second lock mechanism being in the unlocked state and the operation portion.

Here, when the second lock mechanism 1400 has entered into an unlocked state, as illustrated in FIG. 41A, as the image forming apparatus 1001 in a state in which the discharge tray 1014 is opened is viewed from the upper surface side, the second marking 1405*e* of the marking member 1405 is visually recognizable via the window portion 1240*b*. Therefore, the user is able to readily visually recognize that it is possible to supply toner to the supply portion 1200 using the supply pack 1210, so that usability can be increased. Moreover, as the image forming apparatus 1001 in a state in which the discharge tray 1014 is opened is viewed from the upper surface side, the detection target rib portion 1201*k* of the operation portion 1201 and the lock lever 1403 are not visually recognizable. Therefore, it is possible to prevent or reduce the lock lever 1403 from being inadvertently touched by the user.

Figure 41B:
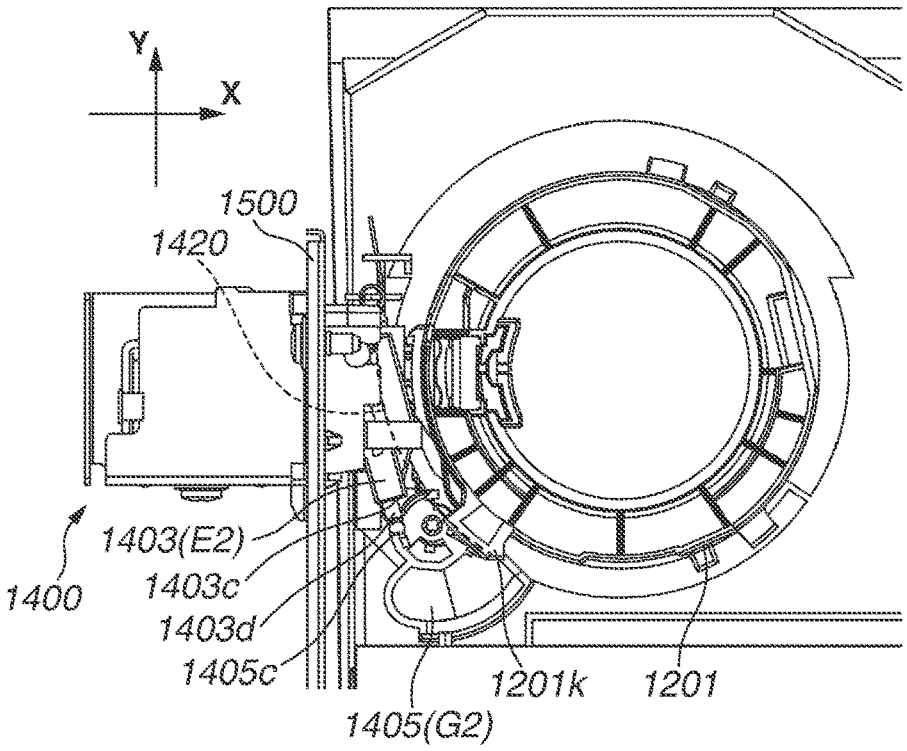
FIG. 41B is a bottom view illustrating the second lock mechanism being in the unlocked state and the operation portion.

Moreover, as illustrated in FIG. 41B, the first engagement portion 1403*c* of the lock lever 1403 positioned at the unlocked position E2 is in the state of receding from the movement locus 1420 of the detection target rib portion 1201*k* of the operation portion 1201, so that the operation portion 1201 is never restricted from rotation by the lock lever 1403. Moreover, the second engagement portion 1403*d* of the lock lever 1403 positioned at the unlocked position E2 is holding the boss portion 1405*c* of the marking member 1405 positioned at the unlock marking position G2.

Figure 42A:
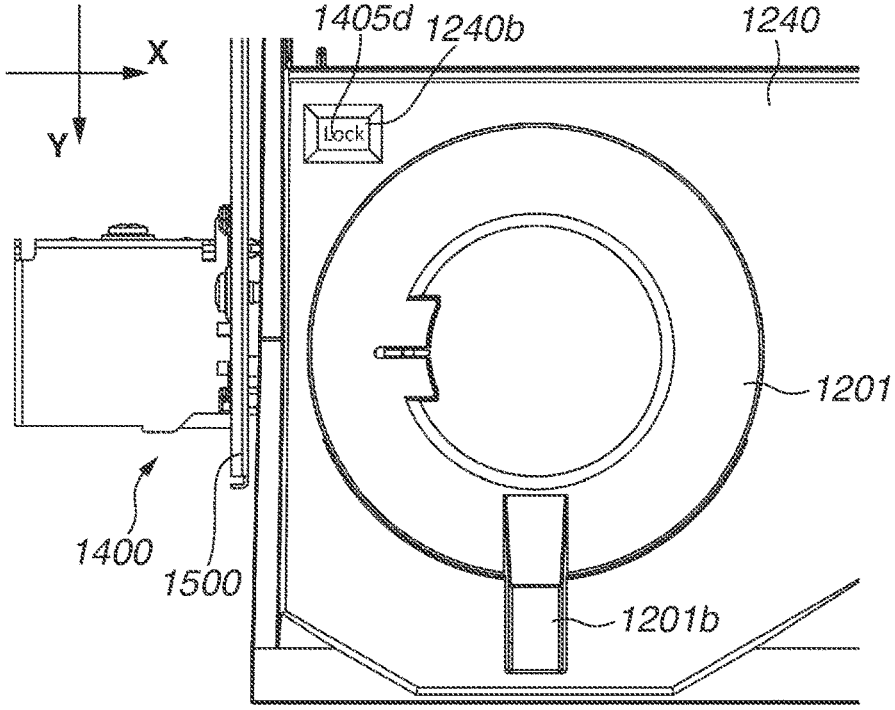
FIG. 42A is a plan view illustrating the second lock mechanism being in the locked state and the operation portion.

On the other hand, when the second lock mechanism 1400 has entered into a locked state, as illustrated in FIG. 42A, as the image forming apparatus 1001 in a state in which the discharge tray 1014 is opened is viewed from the upper surface side, the first marking 1405*d* of the marking member 1405 is visually recognizable via the window portion 1240*b*. Therefore, the user is able to readily visually recognize that it is impossible to supply toner to the supply portion 1200 using the supply pack 1210, so that usability can be increased.

Moreover, as illustrated in FIG. 21D, even in a state in which the supply pack 1210 has been attached to the supply portion 1200, the user is able to visually recognize the first marking 1405*d* via the window portion 1240*b*.

Therefore, even after attaching the supply pack 1210 to the supply portion 1200, the user is able to recognize that the second lock mechanism 1400 is in a locked state, so that usability can be increased. Furthermore, in a state in which the supply pack 1210 has been attached to the supply portion 1200, even in a case where the second marking 1405*e* has been shown via the window portion 1240*b*, the user is similarly able to visually recognize the second marking 1405*e*.

Figure 42B:
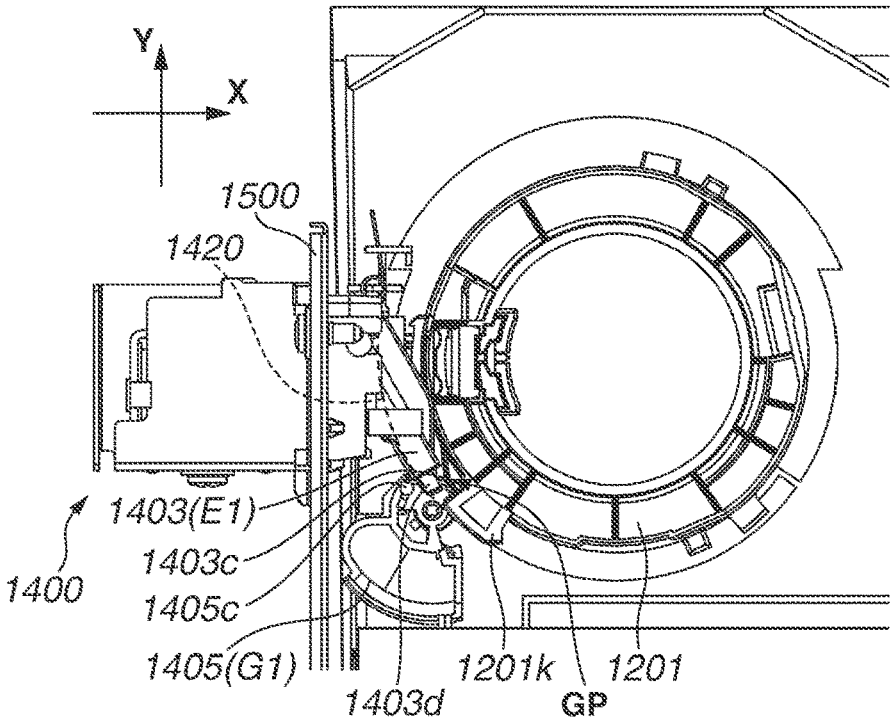
FIG. 42B is a bottom view illustrating the second lock mechanism being in the locked state and the operation portion.

As illustrated in FIG. 42B, the first engagement portion 1403*c* of the lock lever 1403 positioned at the locked position E1 is protruded to the movement locus 1420 of the detection target rib portion 1201*k* of the operation portion 1201.

At this time, the first engagement portion 1403*c* of the lock lever 1403 is away from the detection target rib portion 1201*k* of the operation portion 1201 with a predetermined gap GP left therebetween with respect to the circumferential direction of the operation portion 1201. Providing the gap GP between the first engagement portion 1403*c* and the detection target rib portion 1201*k* enables preventing a frictional force from occurring between the first engagement portion 1403*c* and the detection target rib portion 1201*k* when the solenoid 1402*b* has been energized, so that the solenoid 1402*b* can be configured as a low-powered and small-sized solenoid.

Here, in a state in which the supply pack 1210 is not attached to the supply portion 1200, the operation portion 1201 is fixed in position at the operating position by the first lock mechanism 1250. More specifically, the lever lock pressing portion 1227*a* of the lever lock member 1227 being inserted into the opening portion 1201*e* of the operation portion 1201 causes the operation portion 1201 to be fixed in position at the operating position. Therefore, in a state in which the supply pack 1210 is not attached to the supply portion 1200, the operation portion 1201 is always positioned at the operating position, so that the gap GP is kept between the first engagement portion 1403*c* and the detection target rib portion 1201*k*.

In other words, when the lock lever 1403 is positioned at the locked position E1 and the lever lock member 1227 is positioned at the restriction position F1, the lever lock member 1227 restricts the movement of the operation portion 1201 in such a way as to prevent the operation portion 1201 from coming into contact with the first engagement portion 1403*c* of the lock lever 1403. Therefore, the solenoid 1402*b* being energized enables easily moving the lock lever 1403 of the second lock mechanism 1400 from the locked position E1 to the unlocked position E2.

Figure 43A:
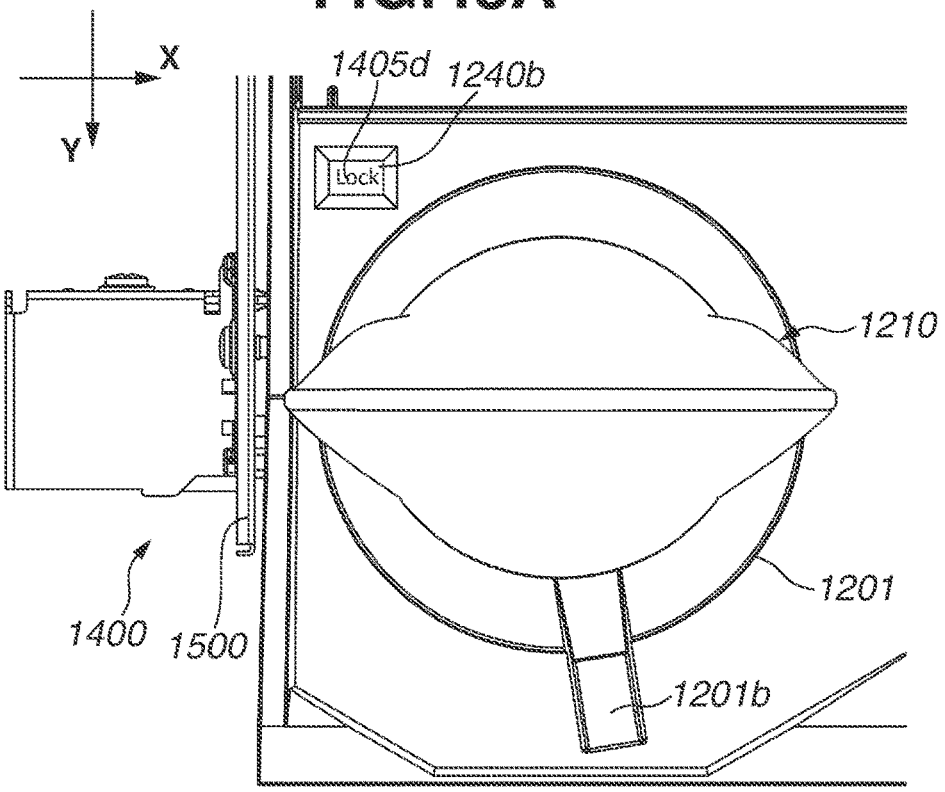
FIG. 43A is a plan view illustrating a manner in which the operation portion has been operated when the second lock mechanism is in the locked state.
Figure 43B:
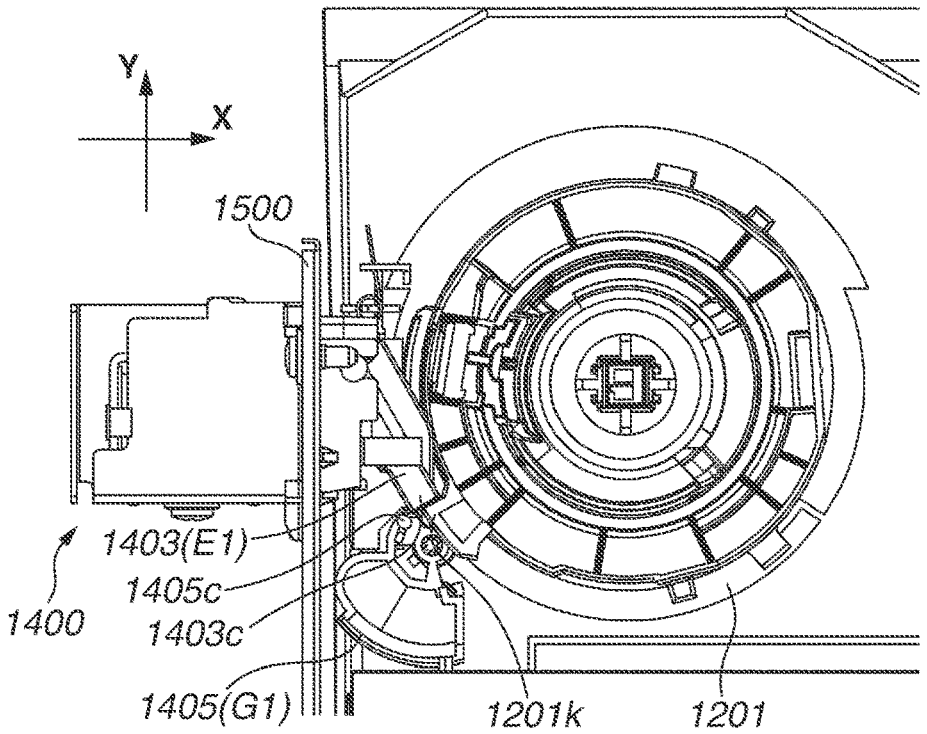
FIG. 43B is a bottom view illustrating a manner in which the operation portion has been operated when the second lock mechanism is in the locked state.

Turning the lever portion 1201*b* of the operation portion 1201 toward the supplying position when the second lock mechanism 1400 is in a locked state causes the detection target rib portion 1201*k* of the operation portion 1201 to move by the gap GP and collides with the second engagement portion 1403*d*, as illustrated in FIG. 43B. This causes the operation portion 1201 to be restricted from rotation. Furthermore, at this time, since the lock lever 1403 never moves from the locked position E1, the marking member 1405, which interlocks with the lock lever 1403, is also kept held at the lock marking position G1. Therefore, as illustrated in FIG. 43A, the first marking 1405*d*, which is visually recognizable via the window portion 1240*b*, also never moves.

As described above, in the third exemplary embodiment, the user opening the discharge tray 1014 enables the second lock mechanism 1400, which is switched between a locked state and an unlocked state by the solenoid 1402*b*, to restrict or derestrict movement of the operation portion 1201. Since, when the above-mentioned non-energization condition is satisfied, it is unfavorable to perform toner supply, restricting an operation (rotation) of the operation portion 1201 enables easily restricting toner supply to the image forming apparatus 1001. Moreover, since the energization determination processing for the solenoid 1402*b* is started in response to the discharge tray 1014 being opened, which is a trigger for a series of supply operations to be performed by the user, it becomes possible to prompt a smooth supply operation without causing the user to perform a cumbersome process.

Furthermore, while, in the third exemplary embodiment, the energization determination processing for the solenoid 1402*b* is started in response to the discharge tray opening and closing detection sensor 1239 detecting that the discharge tray 1014 has been opened, the third exemplary embodiment is not limited to this. For example, separately from the discharge tray 1014, a lid member which is capable of covering only the supply portion 1200 and is openable and closable can be provided, and the energization determination processing for the solenoid 1402*b* can be started in response to the provided lid member being opened. Moreover, a part of the discharge tray can be configured to be a separate member as the lid member.

Moreover, while, in the third exemplary embodiment, the solenoid 1402*b*, which is of the magnetic attraction type, is used as an actuator for driving the lock lever 1403 of the second lock mechanism 1400, the third exemplary embodiment is not limited to this. For example, instead of the solenoid 1402*b*, a push solenoid or a self-holding solenoid can be applied. Moreover, instead of the solenoid 1402*b*, for example, a motor or a linear actuator can be applied. Moreover, an interlocking mechanism for the solenoid unit 1402, the lock lever 1403, and the marking member 1405 is not limited to that described in the third exemplary embodiment. For example, the marking member 1405 can be moved by being pressed by not the second engagement portion 1403*d* of the lock lever 1403 but the plunger 1402*a*.

Moreover, while, in the third exemplary embodiment, each of the first marking 1405*d* and the second marking 1405*e* is configured with a mark having characters applied thereto, the third exemplary embodiment is not limited to this. For example, the first marking can have a pictogram indicating that a key is locked, and the second marking can have a pictogram indicating that a key is unlocked. Additionally, a distinction can be made between the first marking and the second marking by, for example, a character, color, pictograph, raised and recessed pattern, or material to display a locked state and an unlocked state for the second lock mechanism 1400.

Moreover, the third exemplary embodiment is not limited to the energization condition for the solenoid 1402*b* (step S2 to step S7) illustrated in the flowchart of FIG. 38. For example, with regard to the energization condition defined in step S2 to step S7 illustrated in FIG. 38, even if any one of the back surface cover opening and closing detection sensor 1080 being in an on-state, there being no jam detection, there being no malfunction detection, and the acquisition of the toner remaining amount detection information being completed is not satisfied, the solenoid 1402*b* can be configured to be energized. However, it is favorable that, unless the power source of the image forming apparatus 1001 being in an on-state and the condition for the remaining amount of toner are necessarily satisfied, the solenoid 1402*b* is configured not to be energized.

Moreover, a communication for a memory tag being successful can be included in the above-mentioned energization condition (step S2 to step S7). For example, the toner receiving portion 1202 is provided with a main body contact serving as an electrical contact, and a memory tag having predetermined authentication information stored therein is configured to be held by the holding portion 1215 provided at the fore-end of the insertion portion 1212 of the supply pack 1210. Then, a configuration in which, when the supply pack 1210 has been inserted all the way into the supply portion 1200, the memory tag of the supply pack 1210 electrically comes into contact with the main body contact and becomes able to perform communication, thus allowing predetermined information to be read out therefrom, can be employed.

Moreover, the present disclosure can be implemented by processing for supplying a program for implementing one or more functions of the above-described exemplary embodiment to a system or apparatus and causing one or more processors included in a computer of the system or apparatus to read out and execute the program. Moreover, the present disclosure can be implemented by using a circuit which implements such one or more functions (for example, an application specific integrated circuit (ASIC)).

As described above, according to an aspect of the present disclosure, it is possible to prevent a supply agitation operation from being performed in a state in which the door is opened or a jam is occurring and to prevent a conveyance unit from being driven in that state. This enables preventing the user from inadvertently touching the conveyance unit operating during the supply agitation operation in a configuration in which an agitation member and the conveyance unit are driven by a drive source in common in the above-described exemplary embodiment. Moreover, this enables preventing load from being applied to the conveyance unit and the drive source or their supporting portions.

According to an aspect of the present disclosure, with regard to an image forming apparatus in which a conveyance unit for conveying a recording material and an agitation member for agitating a developer are driven by a drive source in common, it is possible to provide an image forming apparatus capable of restricting a supply agitation operation of the agitation member under a specific situation.

According to an aspect of the present disclosure, it is possible to use an actuator to restrict movement of an operation member.

Embodiment(s) of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc™ (BD)), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-106014 filed Jun. 25, 2021, and Japanese Patent Application No. 2021-205341 filed Dec. 17, 2021, which are hereby incorporated by reference herein in their entirety.

What is claimed is:

1. An image forming apparatus comprising:

an image bearing member configured to bear an electrostatic latent image on the image bearing member;

a developer bearing member configured to develop the electrostatic latent image;

a supply portion including a supply port to which a supply container in which a developer is stored is detachably attached and a developer opening through which the developer supplied from the supply container passes;

a developing container configured to store the developer supplied from the supply container;

a shutter configured to be movable between a closing position at which the shutter covers the supply port and a receding position at which the shutter recedes from the closing position;

an operation portion configured to be movable between a first position to cause the shutter to be positioned at the closing position and a second position to cause the shutter to be positioned at the receding position;

an operation detection portion configured to detect that the operation portion has been moved;

a conveyance unit configured to convey a recording material along a conveyance path;

a detection unit configured to detect the recording material being present on the conveyance path;

a door openable and closable and, when the door is in an opened state, causing the conveyance unit to be exposed;

a door detection portion configured to detect a state of the door;

an agitation member configured to agitate the developer stored in the developing container;

a drive portion configured to transmit drive force to the agitation member and the conveyance unit; and a control unit configured to control the drive portion, wherein the control unit controls the drive portion in such a manner that, in a case where the operation detection portion has detected movement of the operation portion, a supply agitation operation in which the agitation member agitates the developer stored in the developing container is performed, and wherein the control unit controls the drive portion in such a manner that, in a case where, in a state in which the supply agitation operation is being performed, the door detection portion has detected the opened state of the door or the detection unit has detected the recording material, the supply agitation operation is stopped.

2. An image forming apparatus comprising:

an image bearing member configured to bear an electrostatic latent image on the image bearing member;

a developer bearing member configured to develop the electrostatic latent image;

a supply portion including a supply port to which a supply container in which a developer is stored is detachably attached and a developer opening through which the developer supplied from the supply container passes;

a developing container configured to store the developer supplied from the supply container;

a shutter configured to be movable between a closing position at which the shutter covers the supply port and a receding position at which the shutter recedes from the closing position;

an operation portion configured to be movable between a first position to cause the shutter to be positioned at the closing position and a second position to cause the shutter to be positioned at the receding position;

an operation detection portion configured to detect that the operation portion has been moved;

a lock portion configured to restrict movement of the operation portion;

a conveyance unit configured to convey a recording material along a conveyance path;

a detection unit configured to detect the recording material being present on the conveyance path;

a door openable and closable and, when the door is in an opened state, causing the conveyance unit to be exposed;

a door detection portion configured to detect a state of the door;

an agitation member configured to agitate the developer stored in the developing container;

a drive portion configured to transmit drive force to the agitation member and the conveyance unit; and a control unit configured to control the lock portion and the drive portion, wherein the control unit controls the drive portion in such a manner that, in a case where the operation detection portion has detected movement of the operation portion, a supply agitation operation in which the agitation member agitates the developer stored in the developing container is performed, and wherein the control unit controls the lock portion in such a manner that, in a case where the door detection portion has detected the opened state of the door or the detection unit has detected the recording material, movement of the operation portion is restricted by the lock portion.

3. The image forming apparatus according to claim 2, wherein the control unit starts the supply agitation operation when the shutter has entered into an opened state.

4. The image forming apparatus according to claim 2, wherein the control unit ends the supply agitation operation when a remaining amount calculation for calculating an amount of the developer stored in the developing container has ended.

5. The image forming apparatus according to claim 4, wherein the control unit ends the remaining amount calculation a predetermined time after the shutter has entered into a closed state.

6. The image forming apparatus according to claim 2, wherein the supply container is attachable to the image forming apparatus in a state in which a part of the supply container is exposed from the image forming apparatus.

7. The image forming apparatus according to claim 2, wherein the control unit restricts image formation from being performed in a state in which the supply container has been attached.

8. The image forming apparatus according to claim 2, wherein the operation portion and the shutter are interlocked with each other via the supply container.

9. An image forming apparatus comprising:

an image bearing member configured to bear an electrostatic latent image on the image bearing member;

a developer bearing member configured to develop the electrostatic latent image;

a supply portion including a supply port to which a supply container in which a developer is stored is detachably attached and a developer opening through which the developer supplied from the supply container passes;

a developing container configured to store the developer supplied from the supply container;

a shutter configured to be movable between a closing position at which the shutter covers the supply port and a receding position at which the shutter recedes from the closing position;

an operation portion configured to be movable between a first position to cause the shutter to be positioned at the closing position and a second position to cause the shutter to be positioned at the receding position;

an operation detection portion configured to detect that the operation portion has been moved;

a conveyance unit configured to convey a recording material along a conveyance path;

a detection unit configured to detect the recording material being present on the conveyance path;

a door openable and closable and, when the door is in an opened state, causing the conveyance unit to be exposed;

a door detection portion configured to detect a state of the door;

an agitation member configured to agitate the developer stored in the developing container;

a drive portion configured to transmit drive force to the agitation member and the conveyance unit; and a control unit configured to control the drive portion, wherein the control unit controls the drive portion in such a manner that a supply agitation operation in which the agitation member agitates the developer stored in the developing container is performed, and wherein, in a case where the operation detection portion has detected movement of the operation portion, the control unit starts the supply agitation operation (i) when the door detection portion is detecting a closed state of the door and the detection unit is not detecting the recording material, and does not perform the supply agitation operation (ii) when the door detection portion is detecting the opened state of the door or when the detection unit is detecting the recording material.

10. An image forming apparatus to which a toner container including an opening portion for supplying toner and a container shutter for opening and closing the opening portion is detachably attachable, the image forming apparatus comprising:

an attachment portion, to which the toner container is attachable, including a reception port for receiving toner supplied from the toner container and an operation member configured to be movable together with the container shutter and for externally operating opening and closing of the container shutter in a state in which the toner container is attached to the attachment portion;

a toner storing portion configured to store toner received via the reception port;

a lid portion provided to be openable and closable between a closed position at which the lid portion covers the attachment portion and an opened position at which the lid portion causes the attachment portion to be exposed exteriorly;

a detection portion configured to output a signal corresponding to a position of the lid portion;

an actuator configured to perform movement restriction of the operation member; and a control unit configured to control the actuator, wherein the control unit controls the actuator in such a way as to cancel the movement restriction of the operation member in a case where it is detected by the detection portion that the lid portion is positioned at the opened position and a predetermined condition is satisfied.

11. The image forming apparatus according to claim 10, further comprising a restriction member including an engagement portion engageable with the operation member and configured to be movable between a restriction position in which the engagement portion protrudes to a movement locus of the operation member and a restriction cancel position in which the engagement portion has receded from the movement locus of the operation member, wherein the actuator is configured to cause the restriction member to move between the restriction position and the restriction cancel position, and wherein the control unit controls the actuator in such a manner that, in a case where it is detected by the detection portion that the lid portion is positioned at the opened position and the predetermined condition is satisfied, the restriction member moves from the restriction position to the restriction cancel position.

12. The image forming apparatus according to claim 11, wherein the restriction member, the restriction position, and the restriction cancel position are a first restriction member, a first restriction position, and a first restriction cancel position, respectively, the image forming apparatus further comprising a second restriction member configured to be movable between a second restriction position for restricting movement of the operation member and a second restriction cancel position for canceling restriction of movement of the operation member, wherein the second restriction member is configured to be positioned at the second restriction position when the toner container is not attached to the attachment portion and to be positioned at the second restriction cancel position when the toner container is attached to the attachment portion, and wherein, when the first restriction member is positioned at the first restriction position and the second restriction member is positioned at the second restriction position, the second restriction member restricts movement of the operation member in such a manner that the operation member does not come into contact with the engagement portion of the first restriction member.

13. The image forming apparatus according to claim 11, further comprising:

a marking member including a first marking and a second marking provided at respective different positions; and a cover provided with a window portion configured in such a manner that any one of the first marking and the second marking is visually recognizable, wherein the marking member is configured to be movable between a first position in which the first marking is visually recognizable in the window portion and a second position in which the second marking is visually recognizable in the window portion, and wherein the marking member is configured to be movable in conjunction with an operation of the actuator in such a manner that the marking member is positioned at the first position when the operation member is positioned at the restriction position and is positioned at the second position when the operation member is positioned at the restriction cancel position.

14. The image forming apparatus according to claim 10, further comprising:

a marking member including a first marking and a second marking provided at respective different positions; and a cover provided with a window portion configured in such a manner that any one of the first marking and the second marking is visually recognizable, wherein the marking member is configured to be movable with respect to the cover between a first position in which the first marking is visually recognizable in the window portion and a second position in which the second marking is visually recognizable in the window portion, and wherein the marking member is configured to move in conjunction with an operation of the actuator in such a manner that the marking member is positioned at the first position when the movement restriction of the operation member is performed and is positioned at the second position when the movement restriction of the operation member is canceled.

15. The image forming apparatus according to claim 14, wherein the first marking has characters indicating that the movement restriction of the operation member is performed, and the second marking has characters indicating that the movement restriction of the operation member is not performed.

16. The image forming apparatus according to claim 10, wherein the lid portion is a discharge tray configured to support a recording material discharged to outside the image forming apparatus when in the closed position.

17. The image forming apparatus according to claim 10, further comprising a sensor configured to output a signal with an intensity corresponding to a remaining amount of toner stored in the toner storing portion, wherein the predetermined condition includes information about the remaining amount of toner stored in the toner storing portion having been able to be acquired, based on the signal output from the sensor.

18. The image forming apparatus according to claim 10, wherein the predetermined condition includes a remaining amount of toner stored in the toner storing portion being less than a predetermined amount.

19. The image forming apparatus according to claim 10, wherein the predetermined condition includes a power source of the image forming apparatus being in an on-state.

20. The image forming apparatus according to claim 10, further comprising:

an image forming portion configured to form an image on a recording material;

a conveyance portion configured to convey the recording material toward the image forming portion;

a conveyance path through which the recording material conveyed by the conveyance portion passes;

an opening and closing member configured to be movable between a closed position for covering the conveyance path and an opened position for causing the conveyance path to be exposed exteriorly; and an opening and closing detection sensor configured to detect opening and closing of the opening and closing member, wherein the predetermined condition includes a position of the opening and closing member being detected at the closed position by the opening and closing detection sensor.

21. The image forming apparatus according to claim 20, wherein the predetermined condition includes no sheet being jammed in the conveyance path.

22. The image forming apparatus according to claim 10, further comprising:

an agitation member configured to agitate toner stored in the toner storing portion; and a drive source configured to drive the agitation member, wherein the control unit controls the actuator in such a manner that the operation member is restricted from movement after the movement restriction of the operation member is canceled and the container shutter is opened and closed by movement of the operation member and before the agitation member is driven by the drive source.

23. The image forming apparatus according to claim 10, wherein the toner container includes a pouch for storing toner and includes a nozzle portion having the opening portion and communicating with an inside of the pouch.

24. An image forming apparatus comprising:

a reception portion including a reception port for receiving toner externally supplied, a main body shutter configured to open and close the reception port, and an operation member configured to externally operate opening and closing of the main body shutter;

a toner storing portion configured to store toner received via the reception port;

a lid portion provided to be openable and closable between a closed position at which the lid portion covers the operation member and an opened position at which the lid portion causes the operation member to be exposed exteriorly;

a detection portion configured to output a signal corresponding to a position of the lid portion;

an actuator configured to perform movement restriction of the operation member; and a control unit configured to control the actuator, wherein the control unit controls the actuator in such a way as to cancel the movement restriction of the operation member in a case where it is detected by the detection portion that the lid portion is positioned at the opened position and a predetermined condition is satisfied.

* * * * *